US008220397B2

(12) United States Patent
Sperling

(10) Patent No.: US 8,220,397 B2
(45) Date of Patent: Jul. 17, 2012

(54) METHOD AND APPARATUS FOR RETRIEVING AND PLACING TIE PLATES

(75) Inventor: Fred S. Sperling, Canton, OH (US)

(73) Assignee: Sperling Railway Services, Inc., Canton, OH (US)

( * ) Notice: Subject to any disclaimer, the term of this patent is extended or adjusted under 35 U.S.C. 154(b) by 93 days.

(21) Appl. No.: 12/820,642

(22) Filed: Jun. 22, 2010

(65) Prior Publication Data

US 2011/0308058 A1 Dec. 22, 2011

(51) Int. Cl.
*E01B 29/32* (2006.01)

(52) U.S. Cl. ..... 104/16

(58) Field of Classification Search ..... 104/2, 16
See application file for complete search history.

(56) References Cited

U.S. PATENT DOCUMENTS

| | | | | |
|---|---|---|---|---|
| 3,943,858 | A | 3/1976 | Dieringer et al. | |
| 4,241,663 | A | 12/1980 | Lund et al. | |
| 4,691,639 | A | 9/1987 | Holley | |
| 4,942,822 | A * | 7/1990 | Cotic | 104/16 |
| 4,974,518 | A * | 12/1990 | Cotic et al. | 104/16 |
| 5,331,899 | A | 7/1994 | Holley | |

* cited by examiner

*Primary Examiner* — S. Joseph Morano
*Assistant Examiner* — Zachary Kuhfuss
(74) *Attorney, Agent, or Firm* — Sand & Sebolt

(57) ABSTRACT

A vehicle comprising a machine having wheels, a placing conveyor secured to the machine and having a distal end with a drop mechanism, a trigger operatively connected to a door in the drop mechanism, and wherein the drop mechanism door is opened over a railroad tie when the trigger contacts an edge of the railroad tie with the machine moving.

28 Claims, 50 Drawing Sheets

METHOD AND APPARATUS FOR RETRIEVING AND PLACING TIE PLATES

BACKGROUND OF THE INVENTION

1. Technical Field

The invention relates generally to a method and apparatus for retrieving and locating tie plates on a railroad tie. More particularly, the invention relates to a machine capable of picking up tie plates and positioning them on a railroad tie. Specifically, the invention relates to a machine capable of traveling down railroad rails and precisely placing tie plates on railroad ties at high speed.

2. Background Information

Construction and repair of railroad tracks can be a cumbersome and difficult process due to the remote locations and various terrain that must be traveled on. When a portion of the railroad track needs a new rail or the railroad ties must be replaced, the tie plates are removed and a new railroad tie may be utilized. However, the original tie may be suitable if it is not worn.

A tie plate is required on each side of a tie to hold the rail and as many as 3,000 tie plates are required for only one mile of track. Further, tie plates can weigh up to 34 pounds each and must be precisely placed on the railroad tie in order to facilitate rail replacement. Therefore, it is unreasonable to expect a laborer to lift a 30 pound tie plate and precisely place 3,000 tie plates in an efficient and effective manner.

A number of prior machines have been used to locate tie plates on railroad ties using a variety of methods. Some of these methods use magnets to travel over the railroad tie plates resting on the railroad ties after the rail has been removed to pick up the plates and dispose of them accordingly. Still other machines use magnets on a drum to locate the tie plate as the drum rotates during forward movement of the machine. These second machines utilize a stop-and-go methodology wherein the device stops in order to permit the tie plate to be released during operation.

SUMMARY OF THE INVENTION

The present invention broadly comprises a vehicle including a machine having wheels, a placing conveyor secured to the machine and having a distal end with a drop mechanism, a trigger operatively connected to a door in the drop mechanism, and wherein the drop mechanism door is opened over a railroad tie when the trigger contacts an edge of the railroad tie with the machine moving.

The present invention also broadly comprises a method of placing railroad tie plates comprising the steps of locating a railroad tie plate on a placing conveyor perpendicular to a railroad tie longitudinal axis, stopping the railroad tie plate at a first staging position, dropping the railroad tie plate within a drop box, controlling a drop box arm with a trigger, actuating the trigger, and opening the drop box arm to place the railroad tie plate on the railroad tie.

BRIEF DESCRIPTION OF THE DRAWINGS

The preferred embodiment of the invention, illustrative of the best mode in which Applicant has contemplated applying the principles of the invention, are set forth in the following description and are shown in the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of the ordinary skill in the art to which this invention belongs. Although any methods, devices or materials similar or equivalent to those described herein can be used in the practice or testing of the invention, the preferred methods, devices, and materials are now described.

Figure 1:
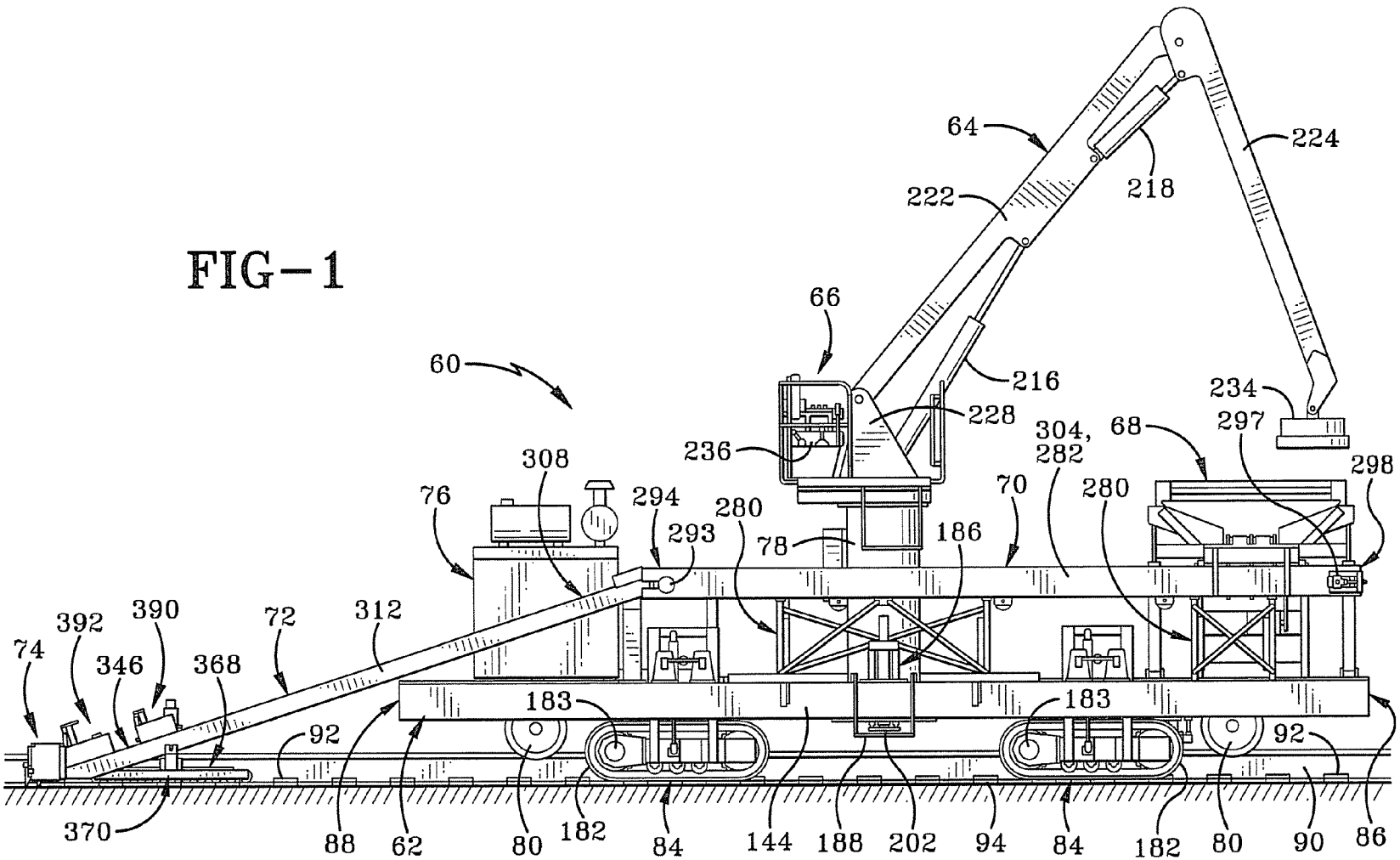
FIG. 1 is a left side elevational view of a machine assembly.
Figure 2:
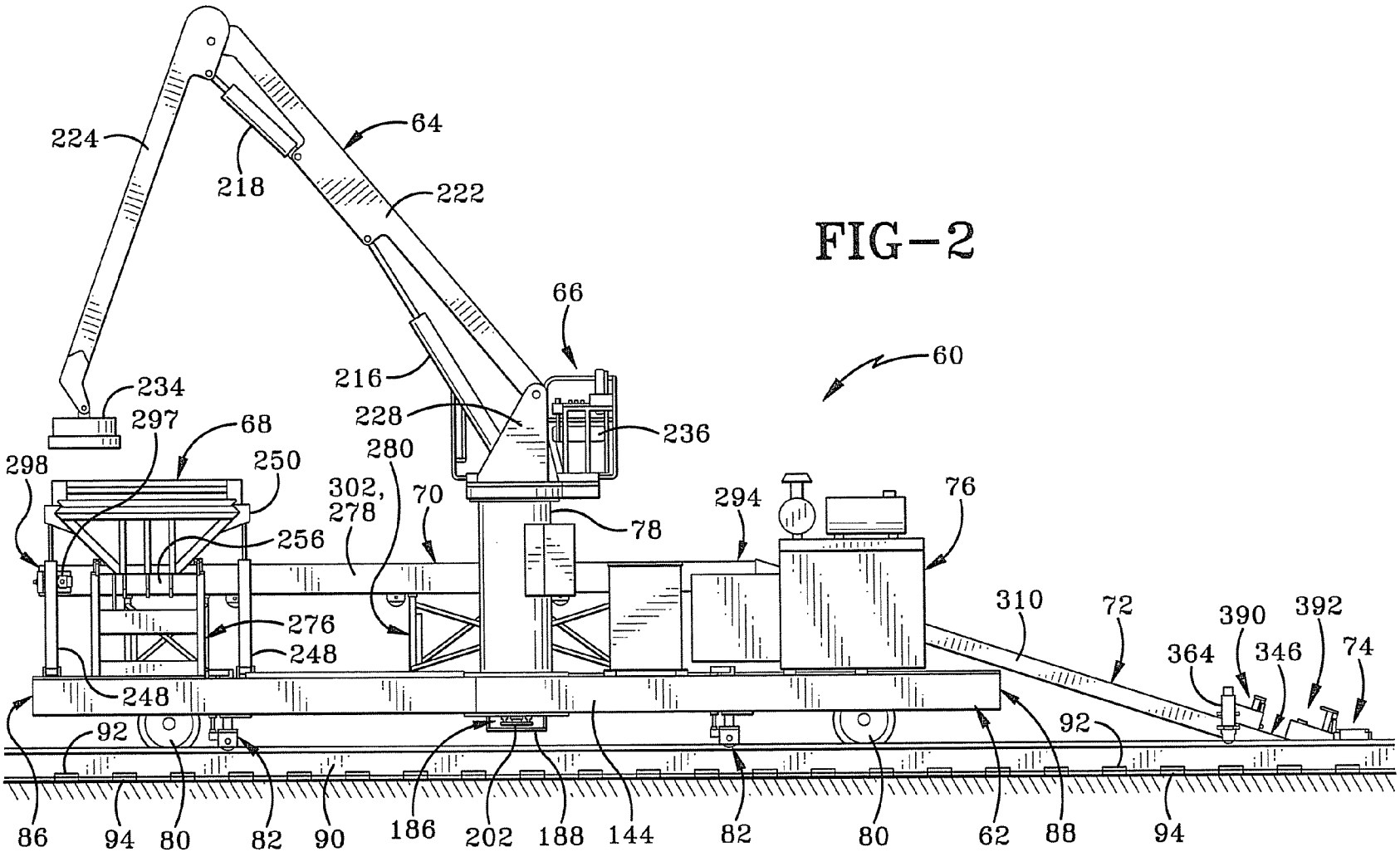
FIG. 2 is a right side elevational view of the machine assembly.
Figure 56:
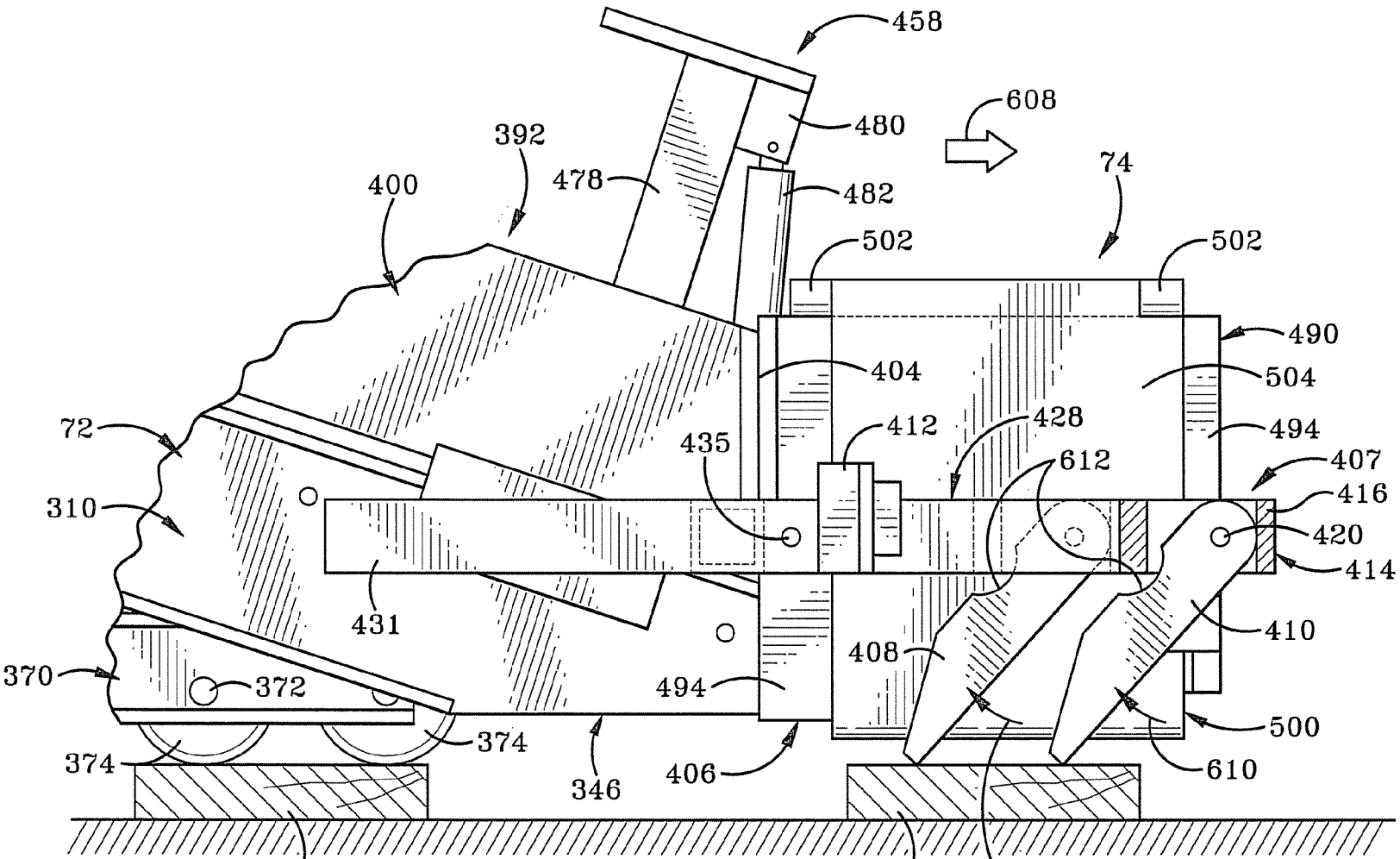

The machine of the present invention is indicated generally at 60, and is particularly shown in FIGS. 1 through 56. As particularly shown in FIGS. 1 and 2, a preferred embodiment machine assembly 60 includes a base 62, a crane or boom 64 with an operator chair 66, a hopper 68, a conveyor 70, a placing conveyor 72 with a drop mechanism 74, and a driving motor 76. The assembly also includes a column 78 supporting operators chair 66 and a plurality of rail-engaging railroad wheels 80 similar to traditional railroad wheels. The assembly also includes a pair of guides 82 extending downward from the side of the machine that is opposite crawlers 84.

In a preferred arrangement, operators chair 66 is centrally located along base 62 so that the operator can see all of the machine during operation. Hopper 68 is preferably arranged along a forward end 86 of the machine while drive motor 76 and placing conveyor 72 are located on a back end 88. Advantageously, conveyor 70 then extends from forward end 86 to back end 88 where it meets placing conveyor 72. The conveyor may also extend inward proximate driving motor 76 as particularly shown in FIGS. 1 and 2. Machine assembly 60 and particularly railroad wheels 80 ride along rails 90 which in turn rest on tie plates 92 and railroad ties 94 as well known in the art.

Figure 3:
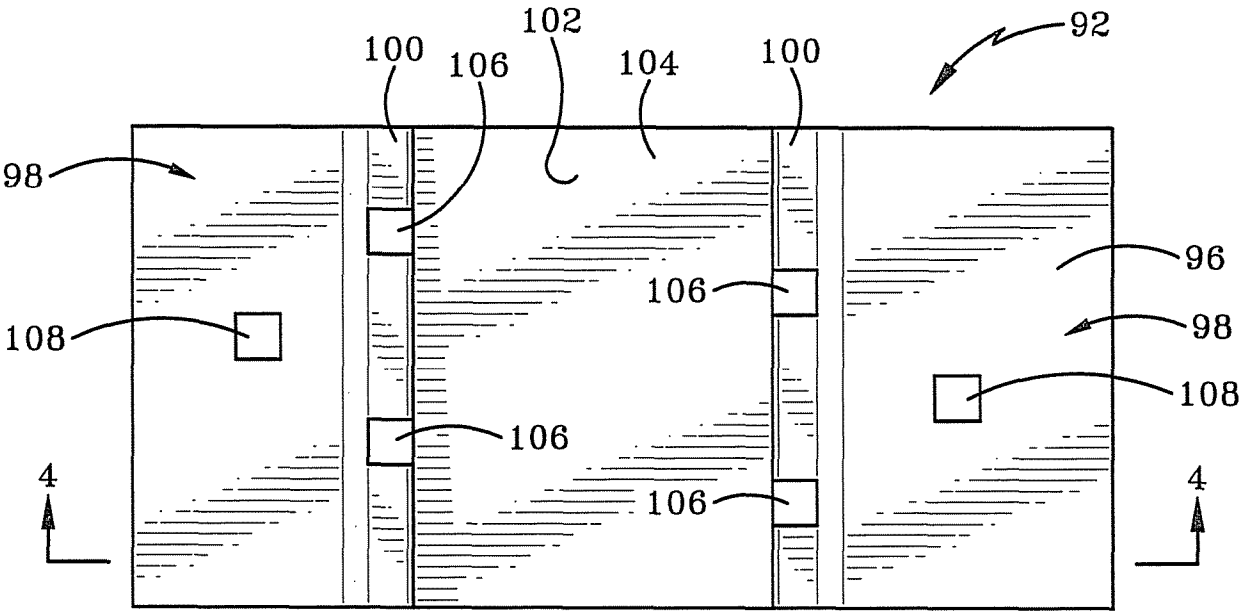
FIG. 3 is a top plan view of a railroad tie plate.
Figure 4:
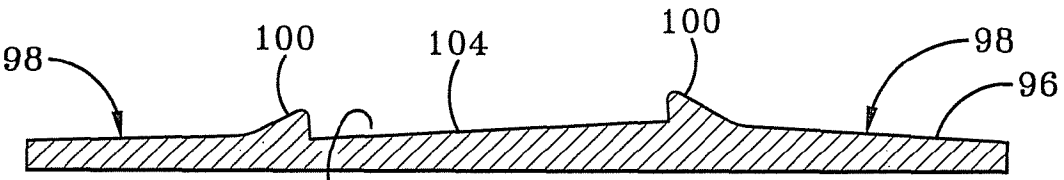
FIG. 4 is a cross-sectional view of the tie plate taken generally about line 4-4 in FIG. 3.

Referring now to FIGS. 3 and 4, tie plate 92 is shown in greater detail. Tie plate 92 includes a top surface 96 having an angled outer portion 98 and a pair of angled stops 100 defining a slot 102 that has a base 104. Further, a plurality of notches 106 are located within stops 100 for securing rail 90 to tie plate 92. Finally, a pair of through holes 108 are located on angled outer portion 98 to receive spikes to secure the tie plate to the railroad tie. Accordingly, base 104 is angled to one side to permit rail 90 to be angled slightly inward and ensure that the railroad wheels are biased slightly inward to keep the machine on the rails.

Figure 5:
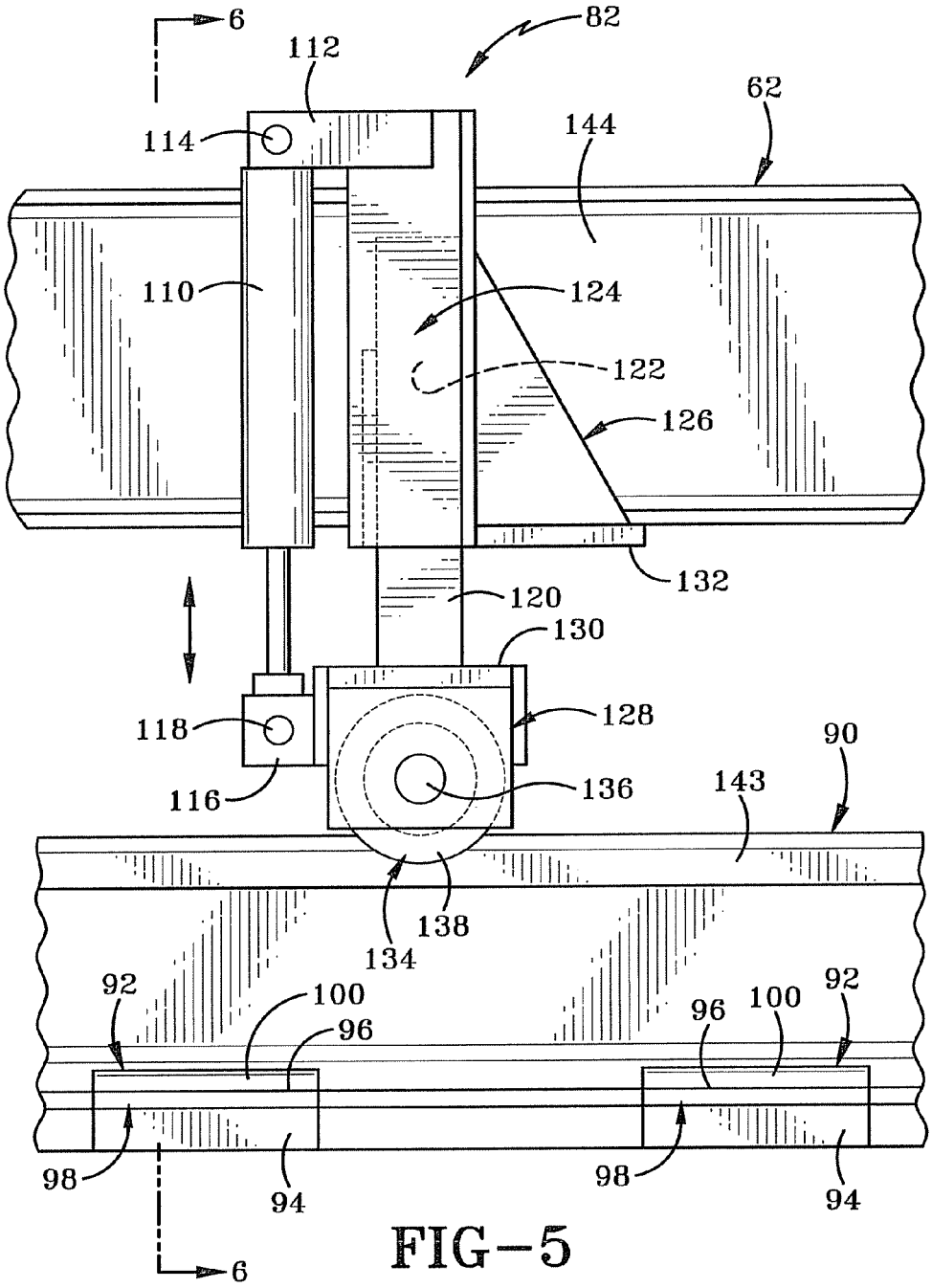
FIG. 5 is an enlarged side view of the guide assembly.
Figure 6:
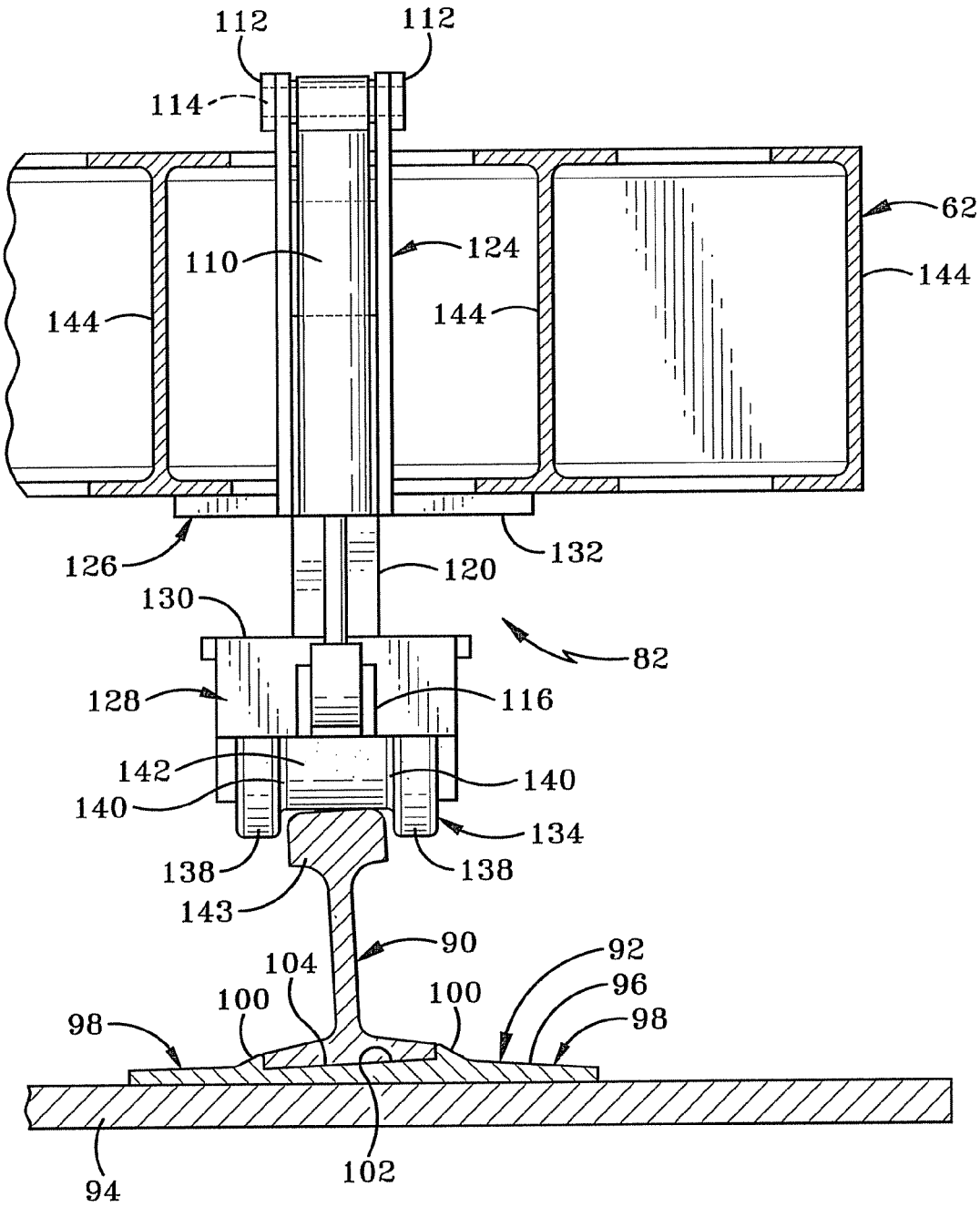
FIG. 6 is a front partial cross-sectional view taken generally about line 6-6 in FIG. 5.
Figure 7:
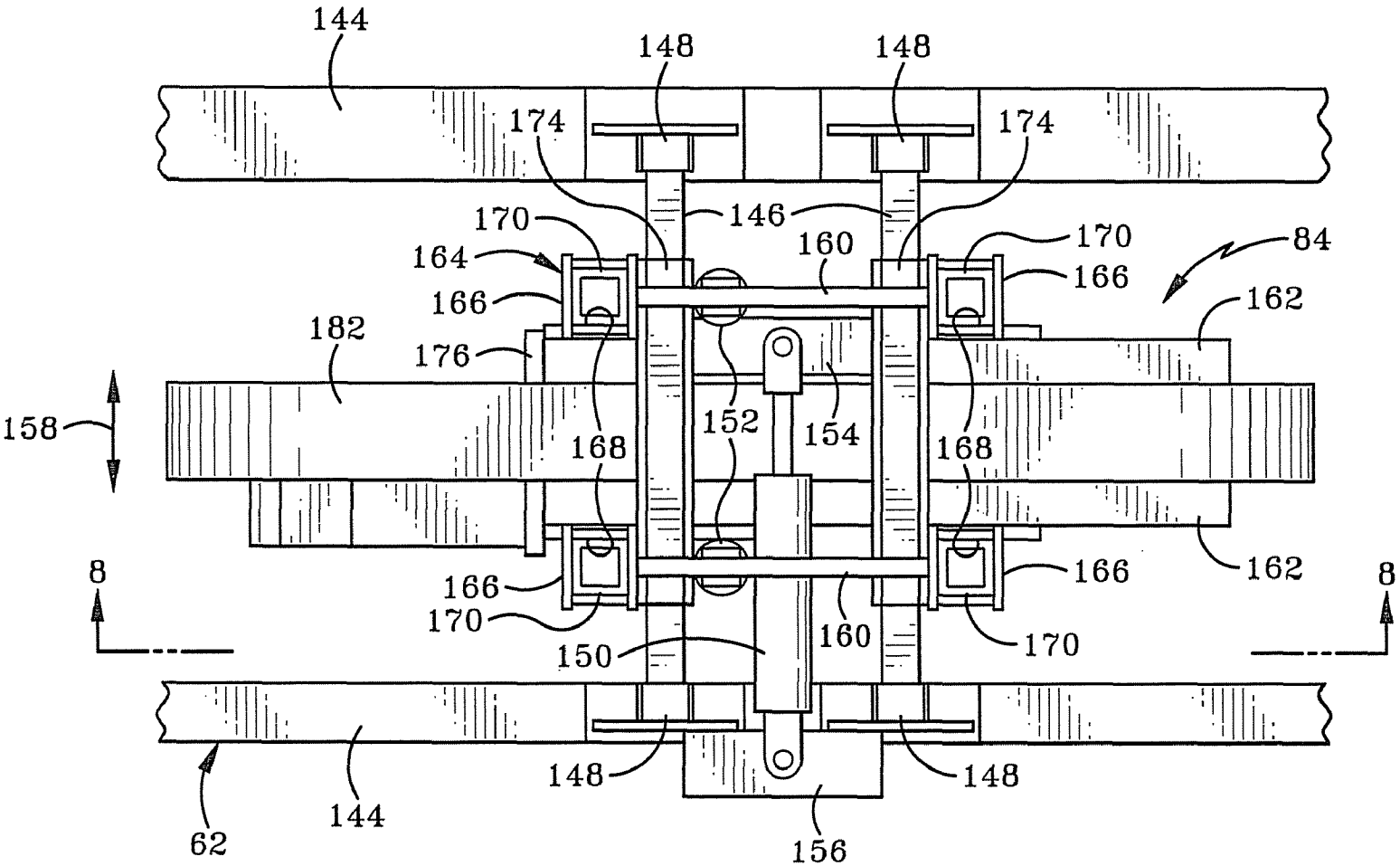
FIG. 7 is a top view of a crawler subassembly.
Figure 8:
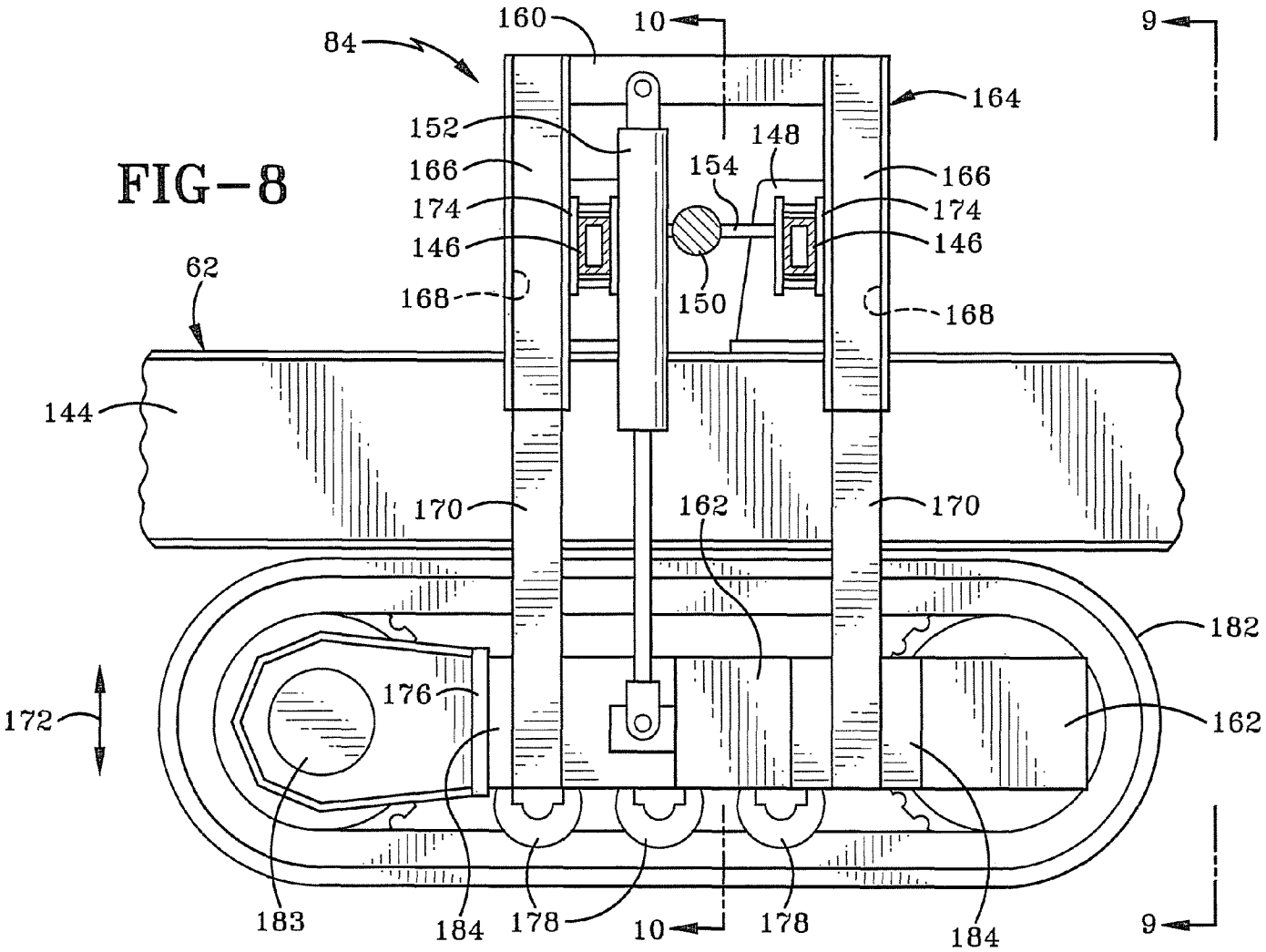
FIG. 8 is a side view taken generally about line 8-8 in FIG. 7.
Figure 10:
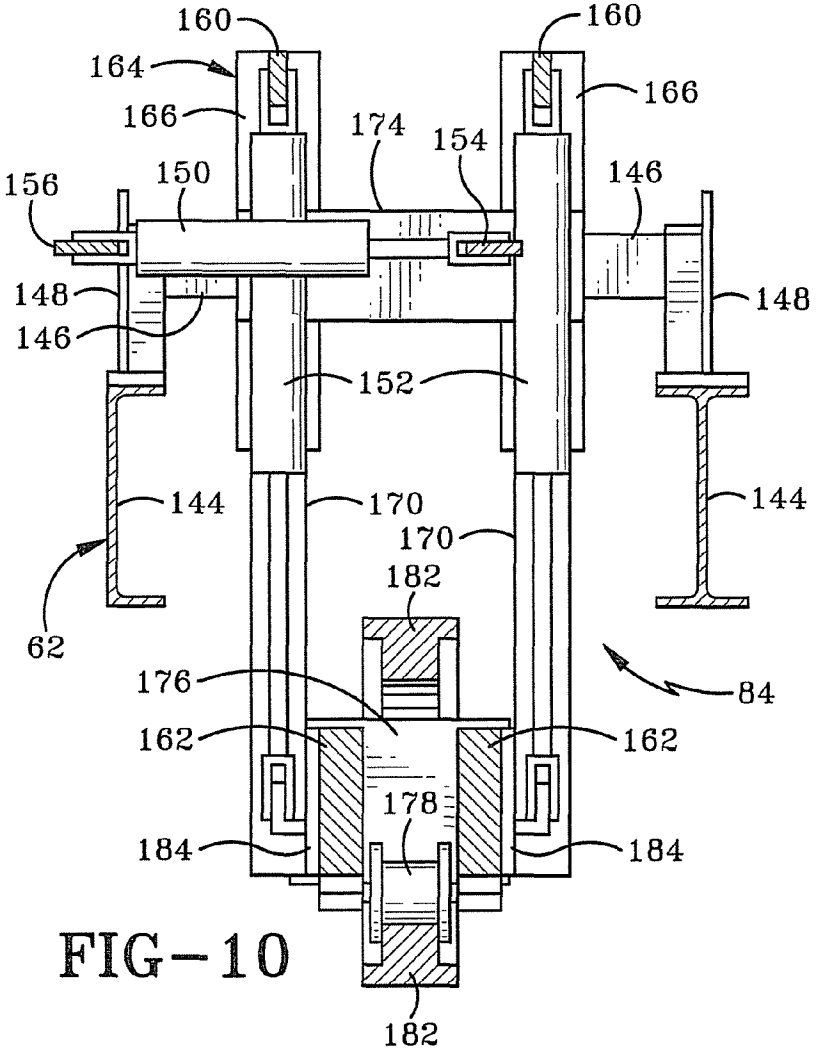
FIG. 10 is a cross-sectional view taken generally about line 10-10 in FIG. 8.
Figure 9:
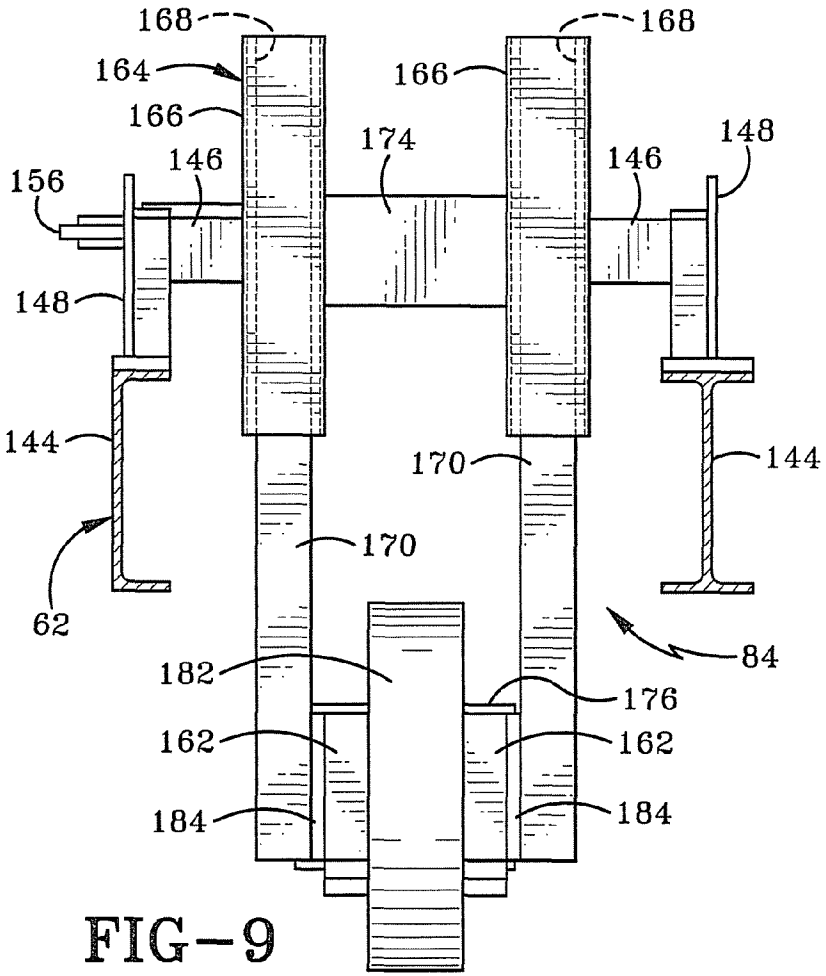
FIG. 9 is a front view taken generally about line 9-9 in FIG. 8.

FIGS. 5 and 6 illustrate enlarged views of guides 82. Guides 82 include a moveable cylinder 110 disposed between a top support 112 connected with pin 114 and a bottom support 116 connected with a pin 118. A moveable shaft 120 travels within a cavity 122 formed in guide body 124. A guide mount 126 secures the body 124 to base 62 and permits the shaft 120 to move within cavity 122 until a guide wheel body 128 with a top surface 130 contacts a bottom surface 132 of mount 126. Specifically, a guide wheel 134 is connected to guide wheel body 128 with a pin 136 to permit rotatable movement therein. Guide wheel 134 includes a pair of outer members 138 with inner angled portions 140 on each side of a central surface 142. Central surface 142 is arranged to ride along a head portion 143 of rail 90 and to ensure that the guides and the railroad wheels 80 ride along rails 90 during operation of crawlers 84 on the opposite side of the machine.

Referring now to FIGS. 7 through 10, crawler 84 is shown in greater detail. Crawler 84 is particularly disposed between a pair of longitudinally extending beams 144 that form a portion of base 62. A pair of support beams 146 extend transverse to longitudinal beams 144 and are connected to beams 144 with mounts 148. The crawler also includes a horizontal moveable cylinder 150 and a vertical moveable cylinder 152 each connected to a support beam to permit vertical and horizontal movement of crawlers 84. Horizontal cylinder 150 connects to crawler assembly 84 with a support beam 154 and a base mount 156 on longitudinal beam 144. The connection between support beam 154 and mount 156 permits moveable cylinder 150 to displace crawler 84 in a horizontal direction by moving the entire assembly in the direction associated with arrows 158. Vertical cylinders 152 extend on both sides of crawler 84 and are connected between a top cross beam 160 and a bottom crawler support 162.

Specifically, crawler assembly 84 is secured to an upper support 164 extending downward from cross beam 160 and having four receiving beams 166 each having a cavity 168 that is opened downward to receive the complementary shaped control beam 170 that extends into the receiving beam as the crawler is moved in the direction associated with arrows 172 by moveable cylinders 152. Similarly, a horizontal receiving beam 174 is connected to the receiving beams 166 and is complementary shaped to support beams 146 such that receiving beams 174 slide around support beams 146 during horizontal movement of moveable cylinder 150.

Crawler 84 also includes a motor mount plate 176 with a guide wheel 178 supporting crawler belt 182 which is operated by a motor 183. Crawler body 176 is connected to upper support 164 through control beams 170 and particularly at control beam mounts 184.

Figure 11:
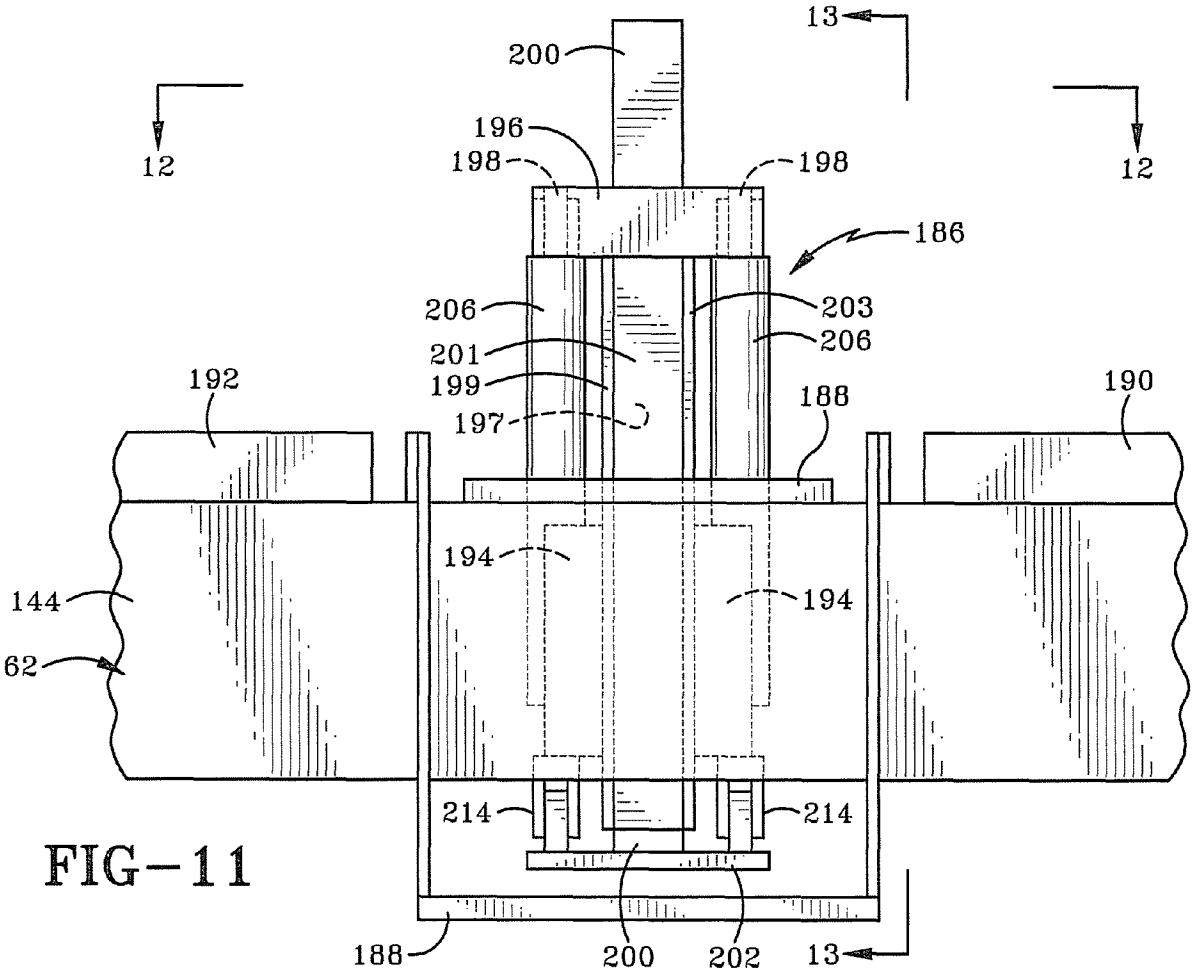
FIG. 11 is a side view of the lift assembly.
Figure 12:
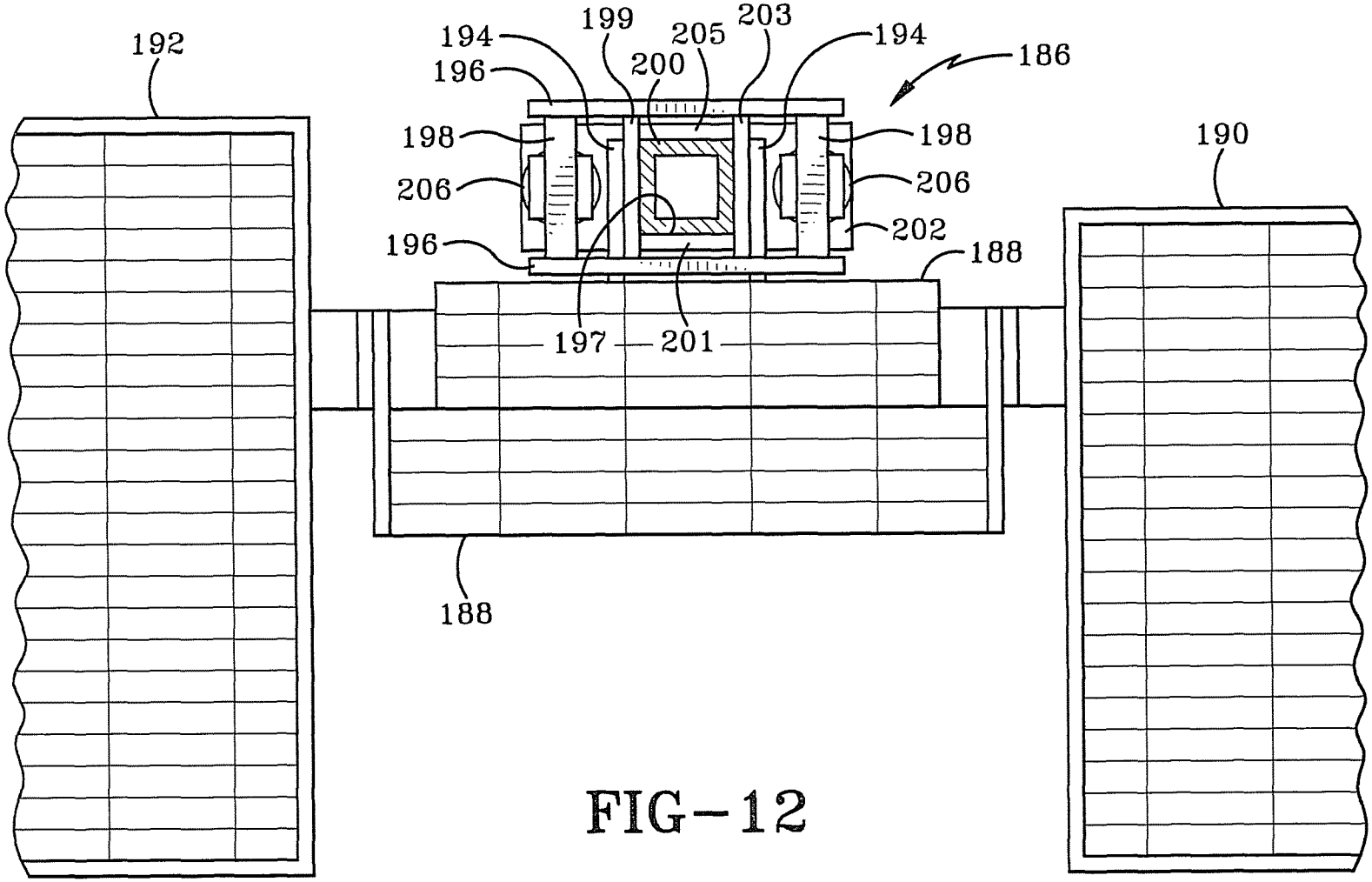
FIG. 12 is a top partial cross-sectional view taken generally about line 12-12 in FIG. 11.
Figure 13:
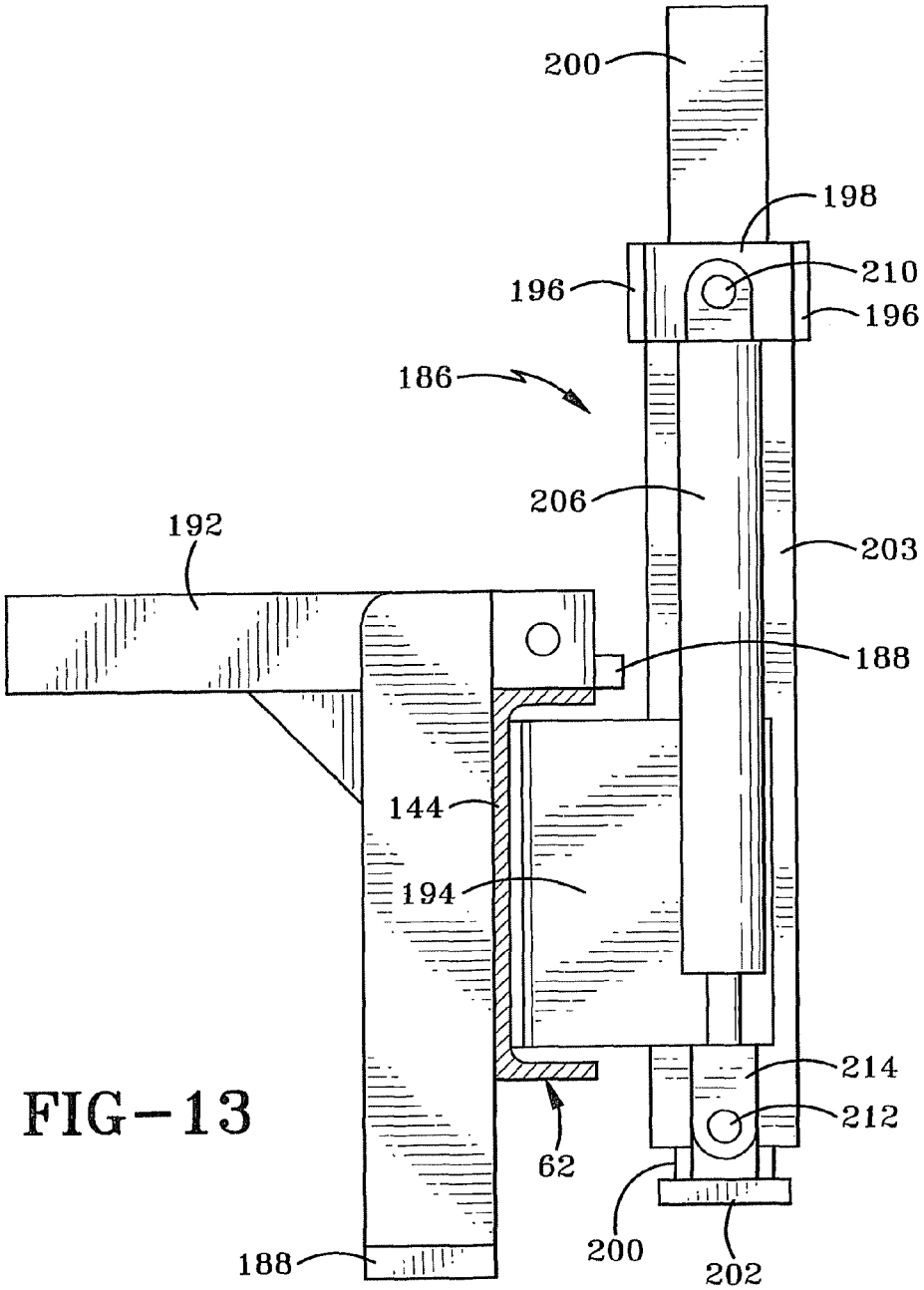
FIG. 13 is a front view taken generally about line 13-13 in FIG. 11.

Referring now to FIGS. 11 through 13, a preferred embodiment lift assembly 186 is shown in greater detail. Lift assembly 186 is secured proximate a set of steps 188 for entering machine assembly 60 and is preferably located between operator pads 190 and 192. Lift assembly 186 is connected to base 62 with beams 194 extending inward into the machine where a pair of cross beams 196 define a portion of the perimeter and a pair of mounting beams 198 extend horizontally between cross beams 196. A channel 197 is formed by guide beams 199, 201, 203, and 205 for central rod 200 to pass there through. A central rod 200 extends throughout the length of lift assembly 186 terminating at a platform 202 at the bottom. Hydraulic cylinders 206 are located between a top plate 208 being mounted with pins 210 to mounting beams 198. Further, platform 202 is preferably mounted to central rod 200 with a pair of pins 212 connecting the rod portion 214. Advantageously, this arrangement permits the lift assembly to be used on any number of surfaces.

Figure 14:
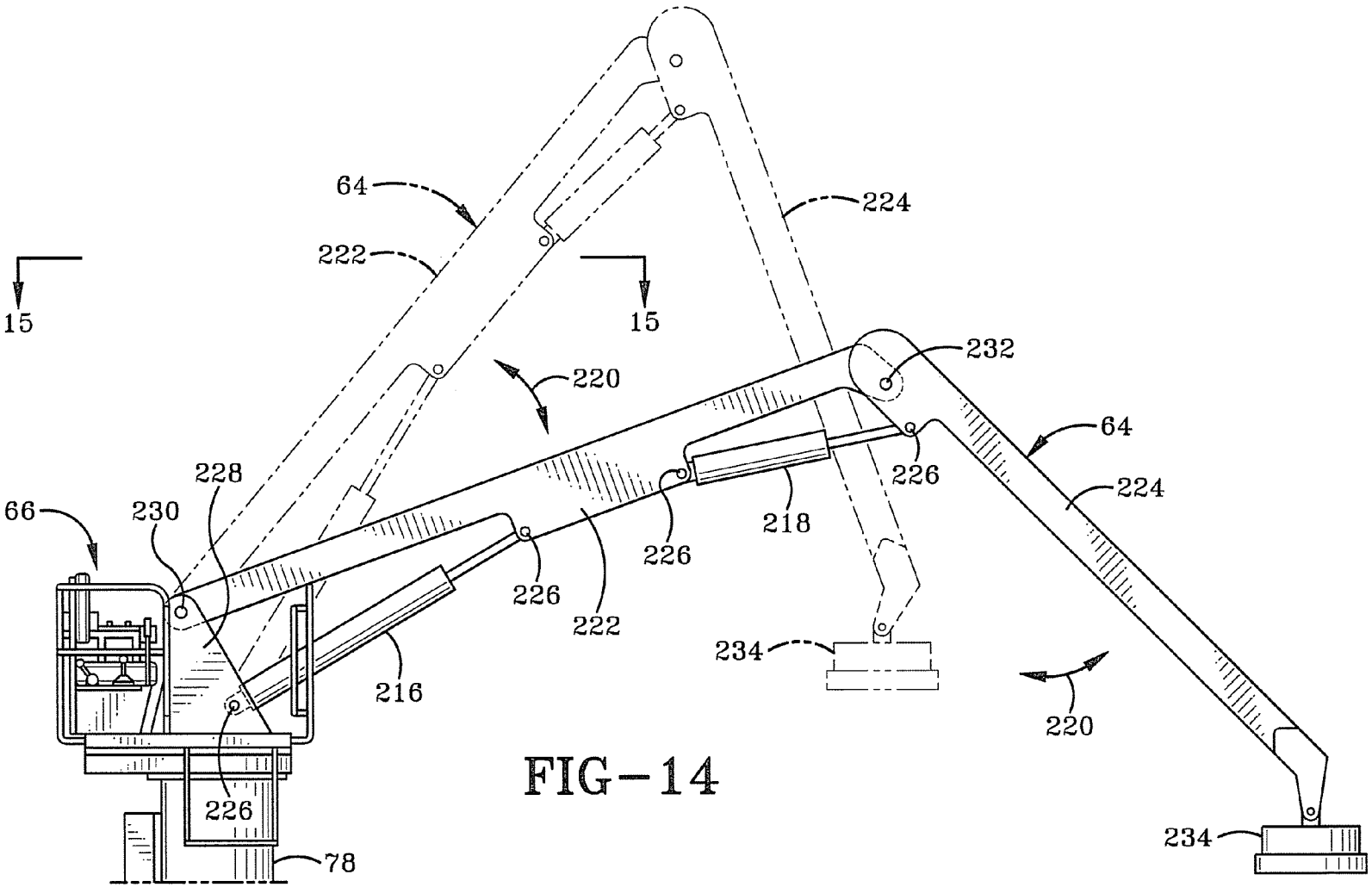
FIG. 14 is a side view illustrating the boom assembly.
Figure 15:
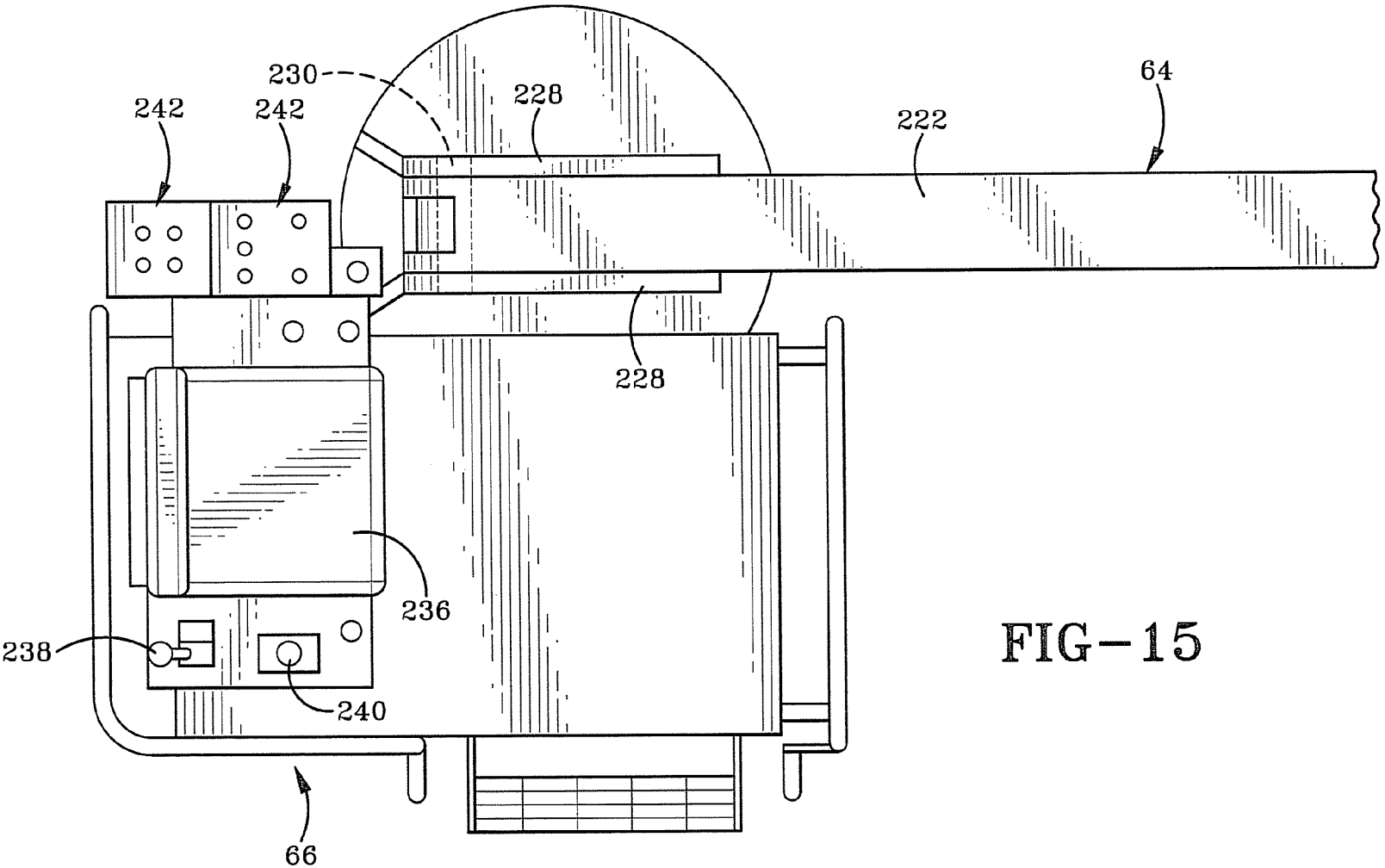
FIG. 15 is a top view of the boom operator's cockpit.
Figure 16:
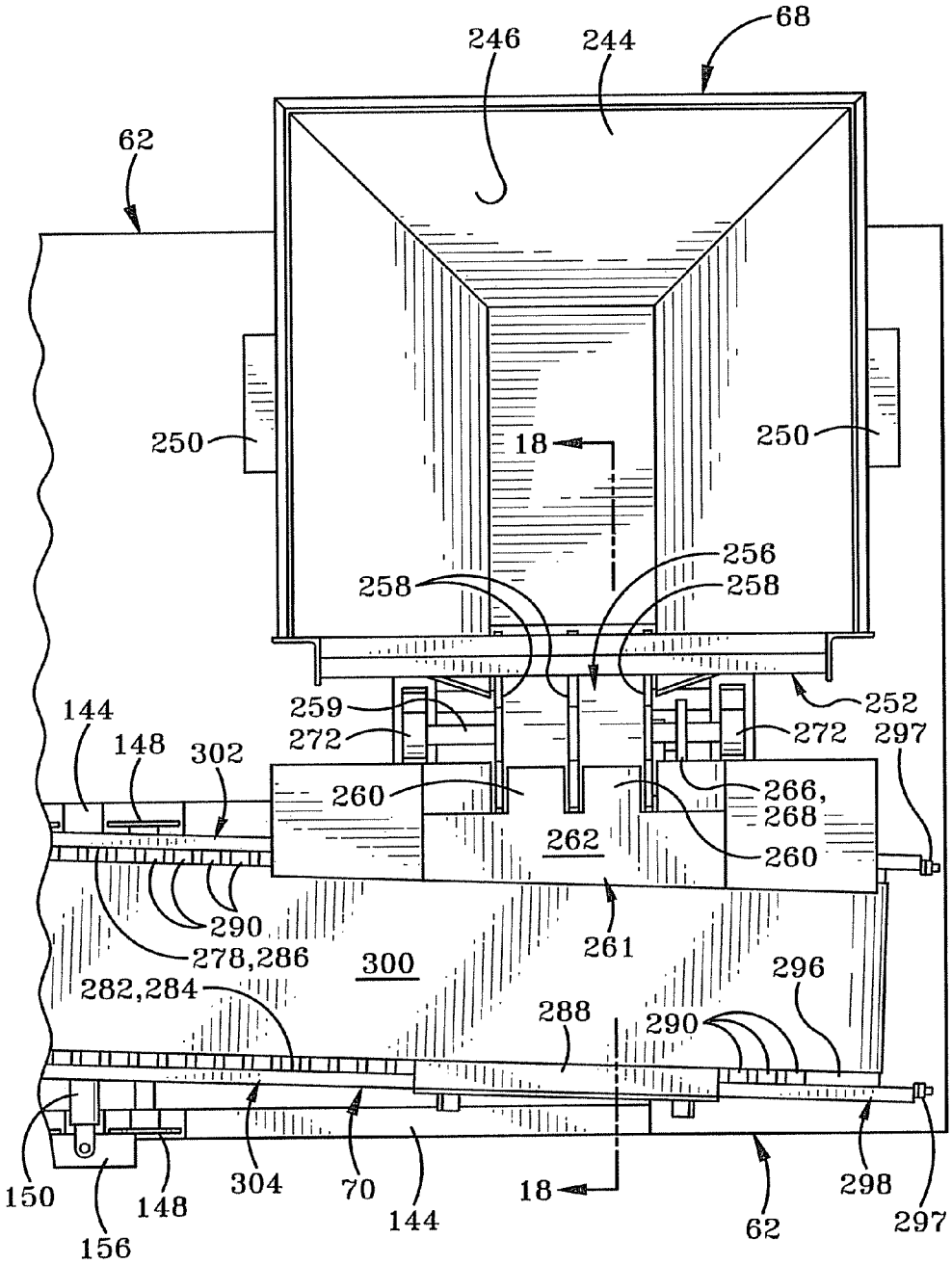
FIG. 16 is a top view of a hopper and a first end of the conveyor.
Figure 17:
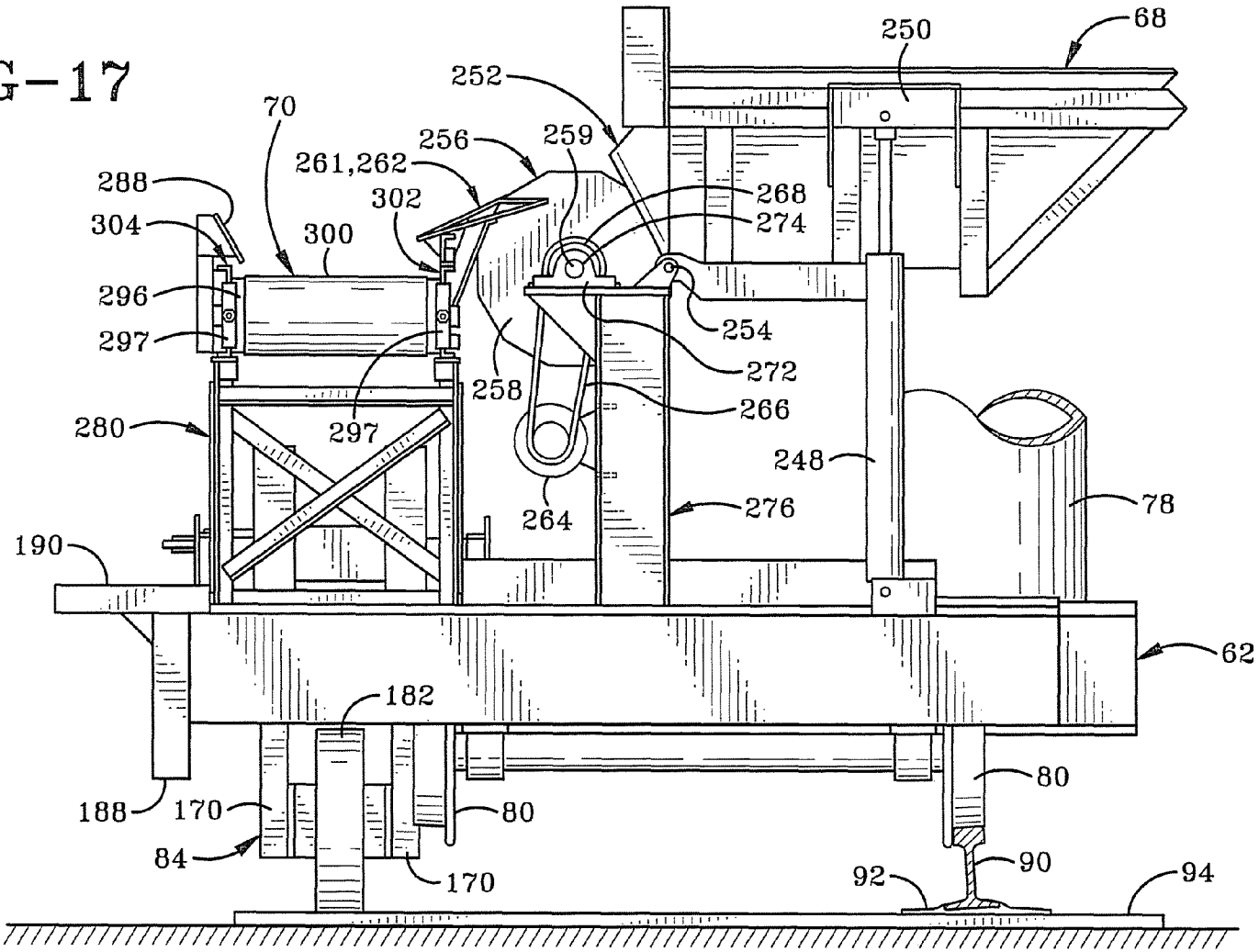
FIG. 17 is a front view with the hopper in the resting position and the conveyor.
Figure 18:
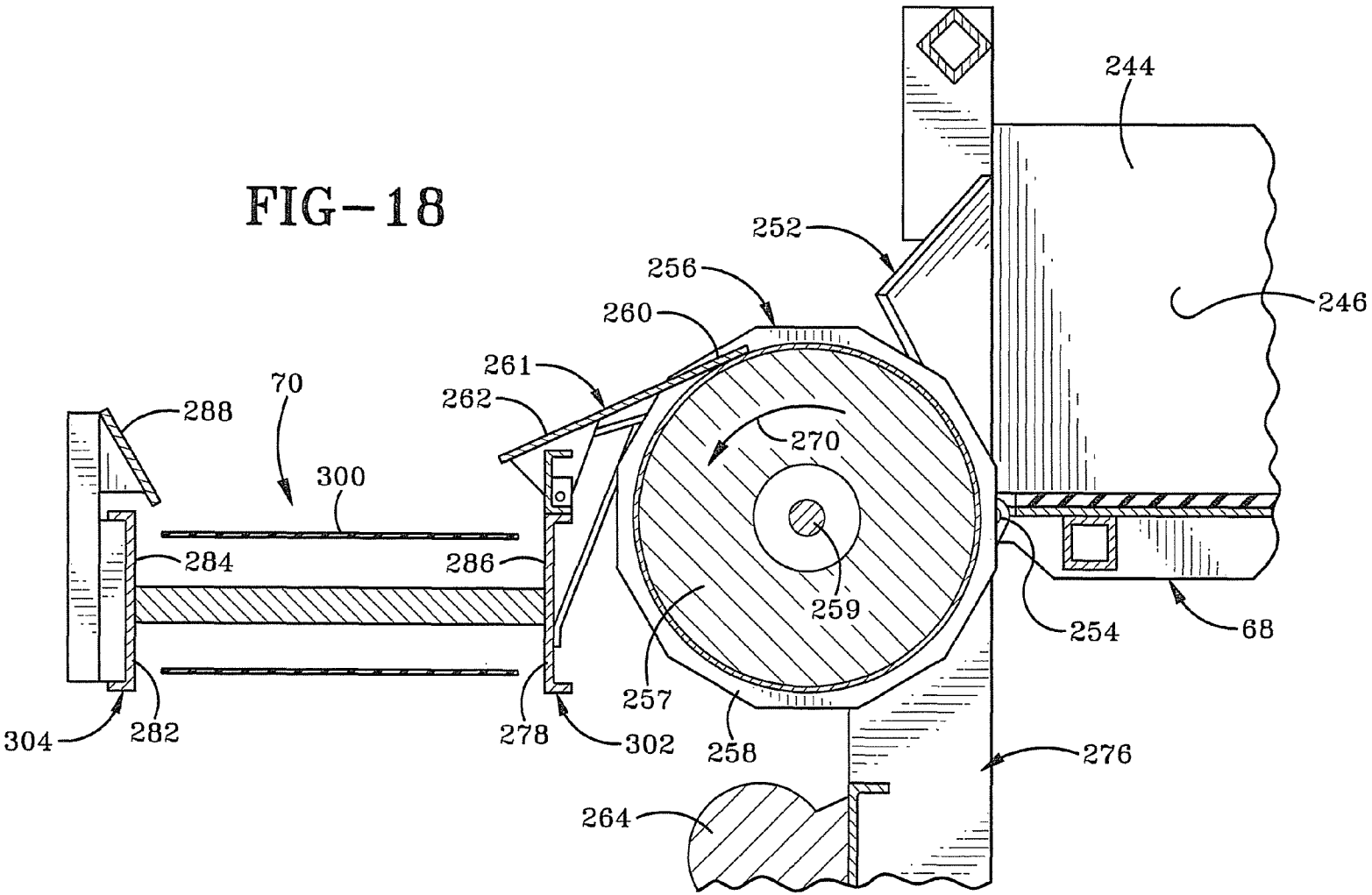
FIG. 18 is a cross-sectional view taken generally about line 18-18 in FIG. 16.

Referring now to FIGS. 14 and 15, a preferred embodiment crane or boom will now be described in detail. Boom 64 is attached to operators chair 66 and includes a pair of hydraulic cylinders 216 and 218 arranged to provide the movement shown between the solid figure and the dash figure in the directions associated with arrows 220 and beyond. In a preferred embodiment, cylinders 216 and 218 can be any form of moveable cylinder and are connected to a first member 222 and a second member 224 with pins 226. Specifically, cylinder 216 is connected to operators chair 66 with a front mount 228 and first member 222, while cylinder 218 is connected to first member 222 and second member 224. First member 222 is pivotally connected to operator chair 66 with a pin 230, while the opposite end of the first member is connected to the second member with a pin 232 extending through a hole therein. At the opposite end of second member 224, a pick-up magnet 234 is pivotably mounted to arrange for pick-up and drop-off of tie plates during operation. Further, operators chair 66 is arranged to provide swivelable movement about column 78 so that the operator can rotate magnet 234 about column 78 and provide movement of the first and second members in the directions associated with arrows 220.

Operators chair 66 includes a seat 236 arranged for easy view of the boom and hopper as well as the track so that the operator can easily manipulate the boom during movement of the machine. In particular, on the right side of the operators seat is a throttle 238 for controlling the movement of the machine along the track and a joystick 240 for controlling the position of the boom. A further array of controls 242 may be positioned on the left side of the operator to control any number of suitable tasks, including the speed of the conveyor, the speed of the magnet wheel, the position of the lift assembly, the position of the crawlers, and the position of the hopper. While control panel 242 is described as incorporating the above-referenced controls, any suitable operation may be controlled from the operators chair without departing from the spirit and scope of the present invention as claimed and the examples provided are merely exemplary of any number of operations.

Referring now to FIGS. 16-21, a preferred embodiment hopper, conveyor, and placing conveyor are shown in greater detail. Hopper 68 preferably includes an inner surface 244 arranged to define a cavity 246 for receiving a plurality of tie plates therein. The hopper also includes a pair of cylinders 248 connected to an outer mount 250 of the hopper and base 62 to extend a back portion of the hopper upwards and allowing a front end 252 of the hopper to pivot about a pivot point 254 and direct the front end 252 towards a magnet wheel 256.

Magnet wheel 256 includes an outer section 258 that is radially outward of an exit ramp 260 for the tie plates and a magnetized portion 257 with an axle 259. Particularly, exit ramp 260 contacts magnet wheel 256 between outer portions 258 such that the tie plates contact the ramp 260 and travel down a connector ramp 261 and are forced down a top surface 262 of the exit ramp and the connector ramp. Magnet wheel 256 is operated by a motor 264 which in turn rotates a belt 266 connected to a pulley 268 on the magnet wheel thus imparting a counter clockwise rotation as indicated by arrow 270. Magnet wheel 256 preferably rotates about a pair bearing blocks 272 each having a through hole 274 therein to provide the rotational movement. Further, a support mount 276 extends upward from base 62 and holds bearing block 274 and connects to pivot point 254 of hopper 68 such that the magnet wheel and the hopper are at the same height. Still further, the ramp 260 is preferably secured to conveyor 70 and particularly a vertical wall 278 of conveyor 70.

Conveyor 70 preferably rests atop support structure 280 arranged to locate the conveyor at a height approximately equal to magnet wheel 256. The conveyor preferably includes a vertical wall 282 of a beam 304 having an inner surface 284 on the outside and inner surface 286 on the vertical wall 278 of a beam 302. The conveyor preferably includes a backstop 288 connected to vertical wall 282 which is arranged to prevent a tie plate from extending beyond the edge of the conveyor. Conveyor 70 also includes a plurality of rollers 290 secured between inner surfaces 284 and 286 with a drive wheel 292 connected to a motor 293 at a second end 294 of the conveyor, and a tensioner wheel 296 with a tensioner 297 proximate a first end 298. A conveyor track 300 extends both above and below rollers 290 and preferably extends from first end 298 to second end 294. In order to maintain tie plates on track 300 during operation, an inner sidewall 302 and an outer sidewall 304 are preferably incorporated. An alignment wall 306 is connected to inner wall 302 and preferably reduces a width W of conveyor 70 as the conveyor extends from the first end to the second end. Alignment wall 306 is disposed proximate second end 294 of the conveyor and is particularly useful given that conveyor 70 may be disposed at an angle with respect to the placing conveyor 72 due to the size, placement, and orientation of hopper 68.

Figure 19:
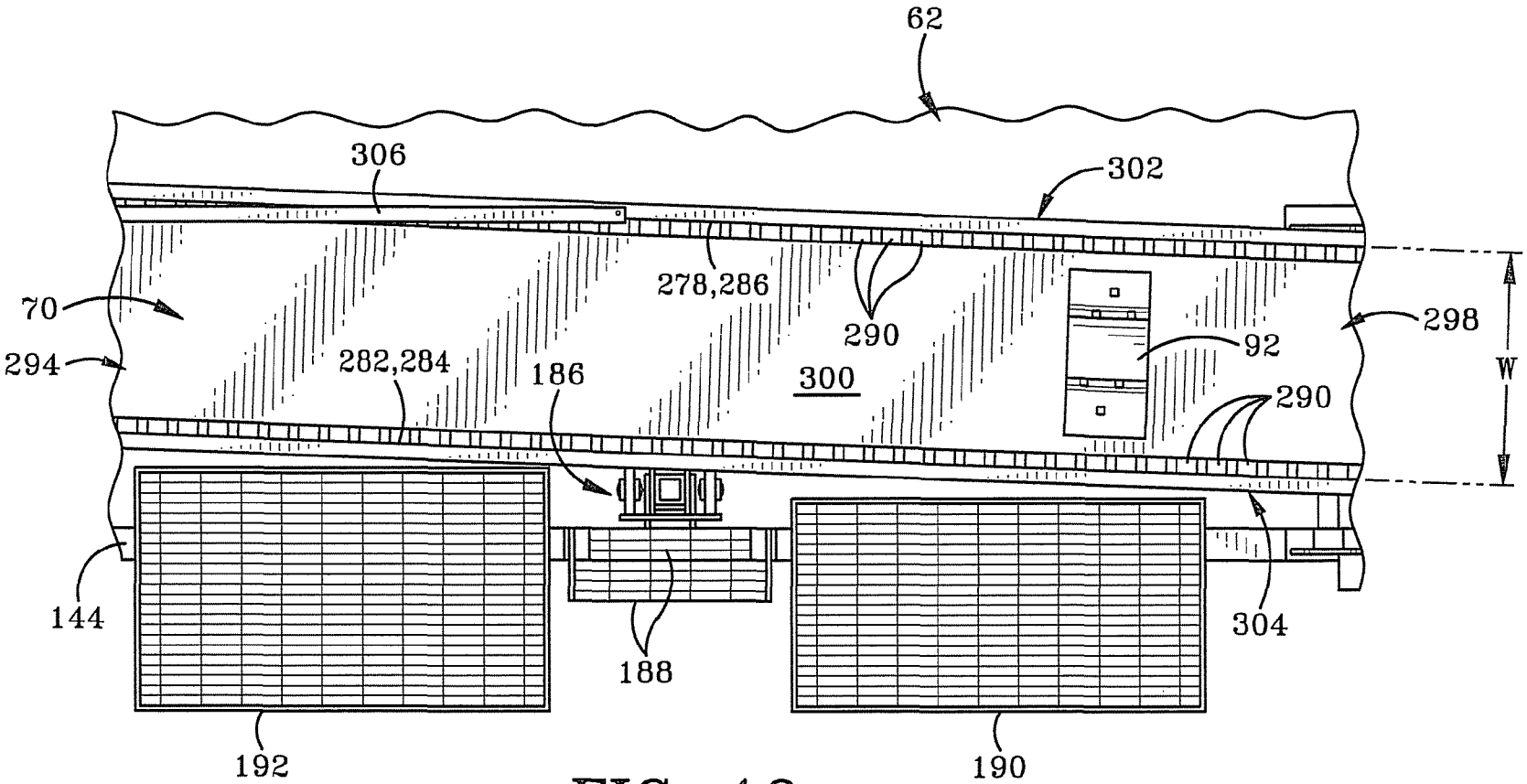
FIG. 19 is a top view of a portion of the conveyor with a tie plate traveling down the belt.

As particularly seen in FIG. 19, operator pads 190 and 192 are on each side of steps 188 and are preferably disposed along outer sidewall 304 and positioned proximate the outer wall 282 so that operators can stand on the pads and orient tie plates as they travel from the first end to the second end of conveyor 70.

Figure 20:
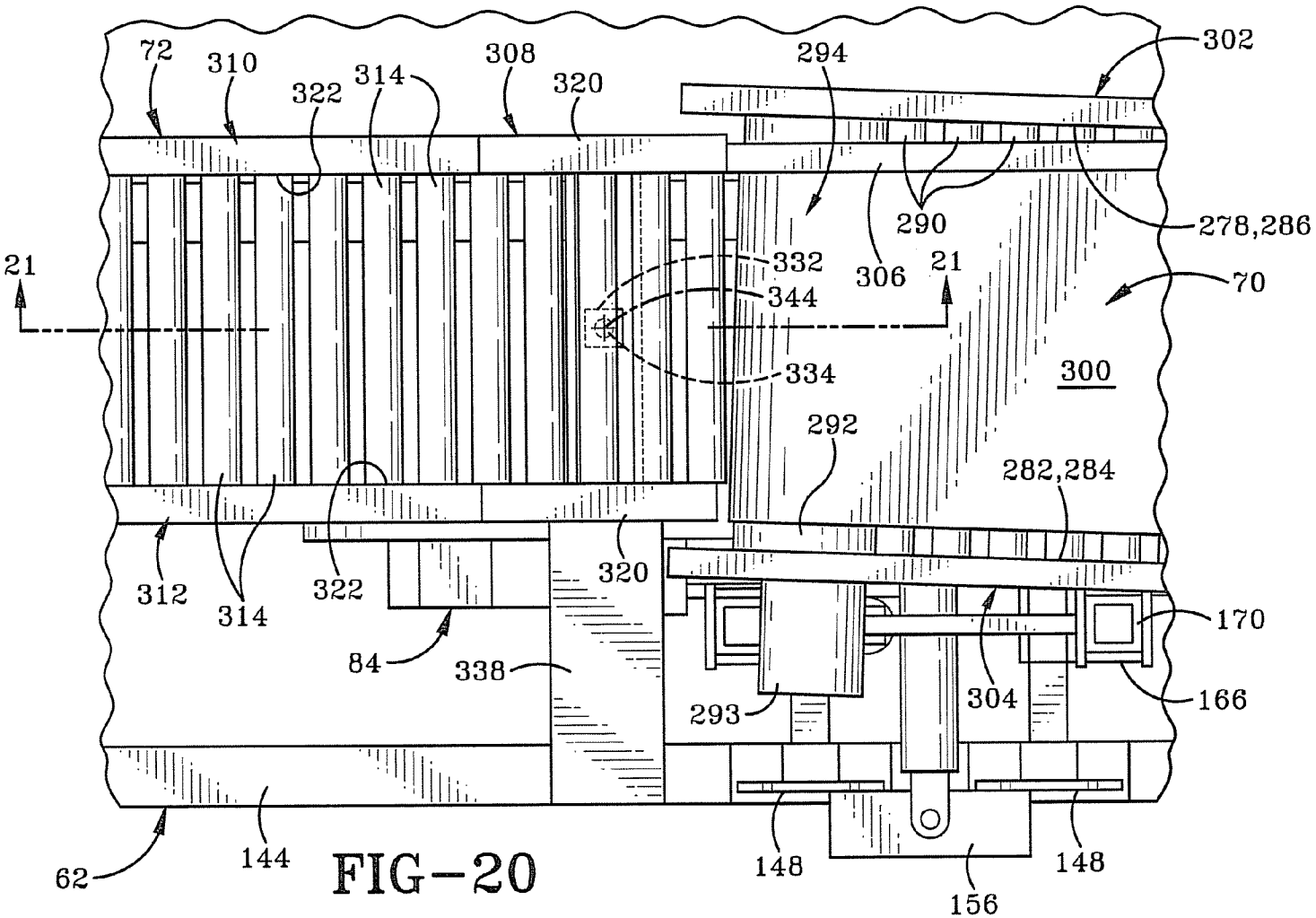
FIG. 20 is a top view illustrating the interaction between the conveyor and the ramp.
Figure 21:
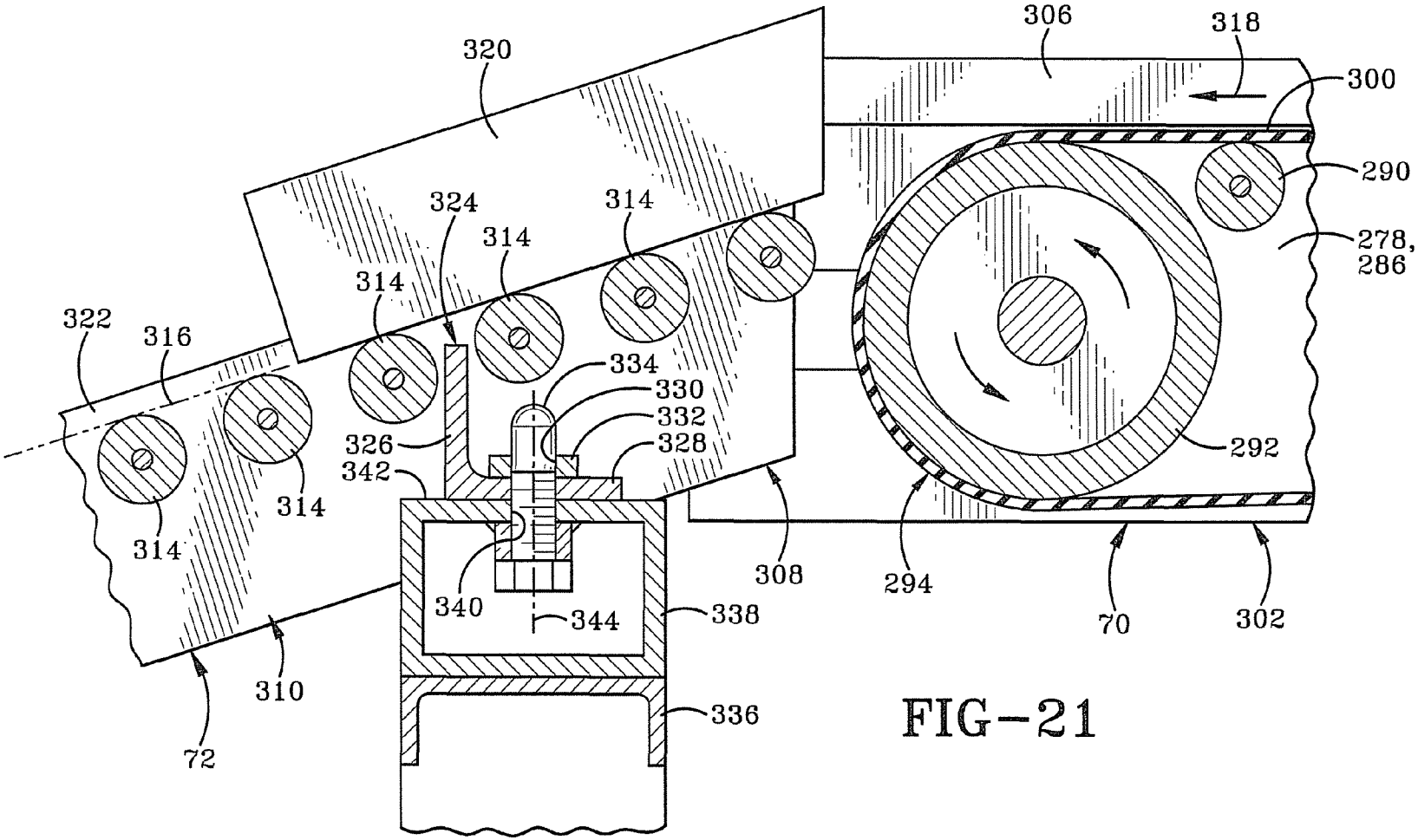
FIG. 21 is a cross-sectional view taken generally about line 21-21 in FIG. 20.
Figure 22:
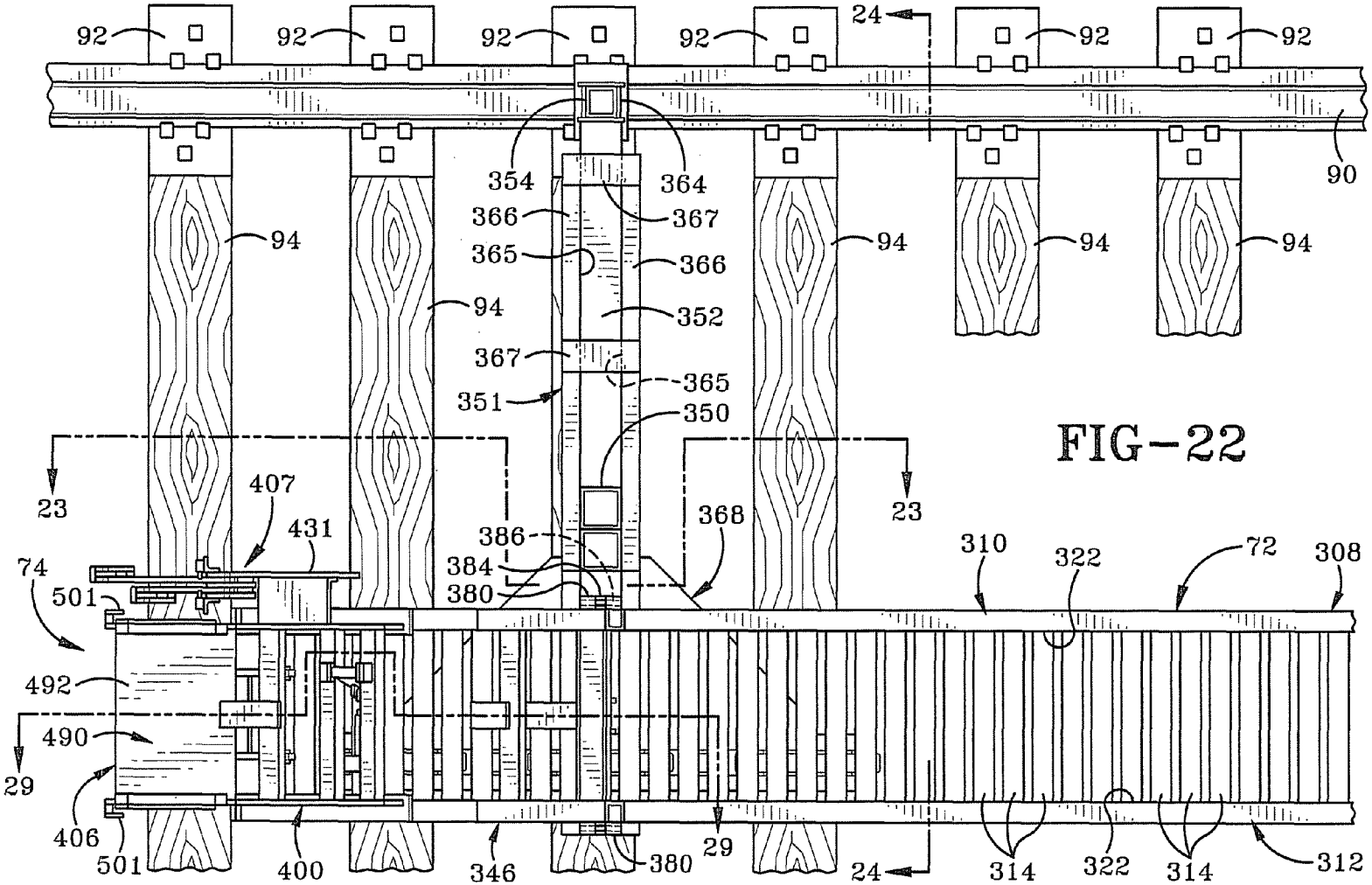
FIG. 22 is a top view of the placing conveyor and stabilizing arm.
Figure 23:
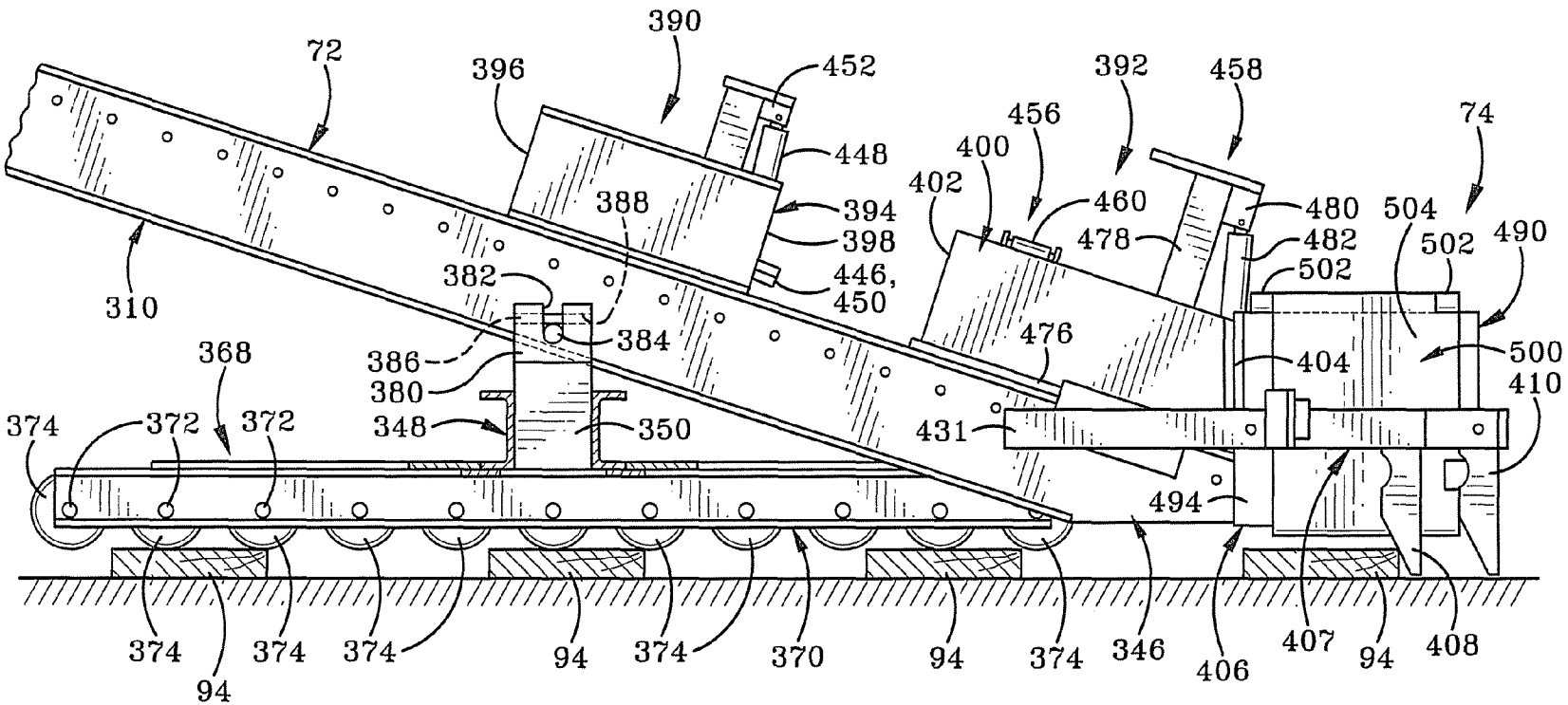
FIG. 23 is a partial cross-sectional view taken generally about line 23-23 in FIG. 22.
Figure 24:
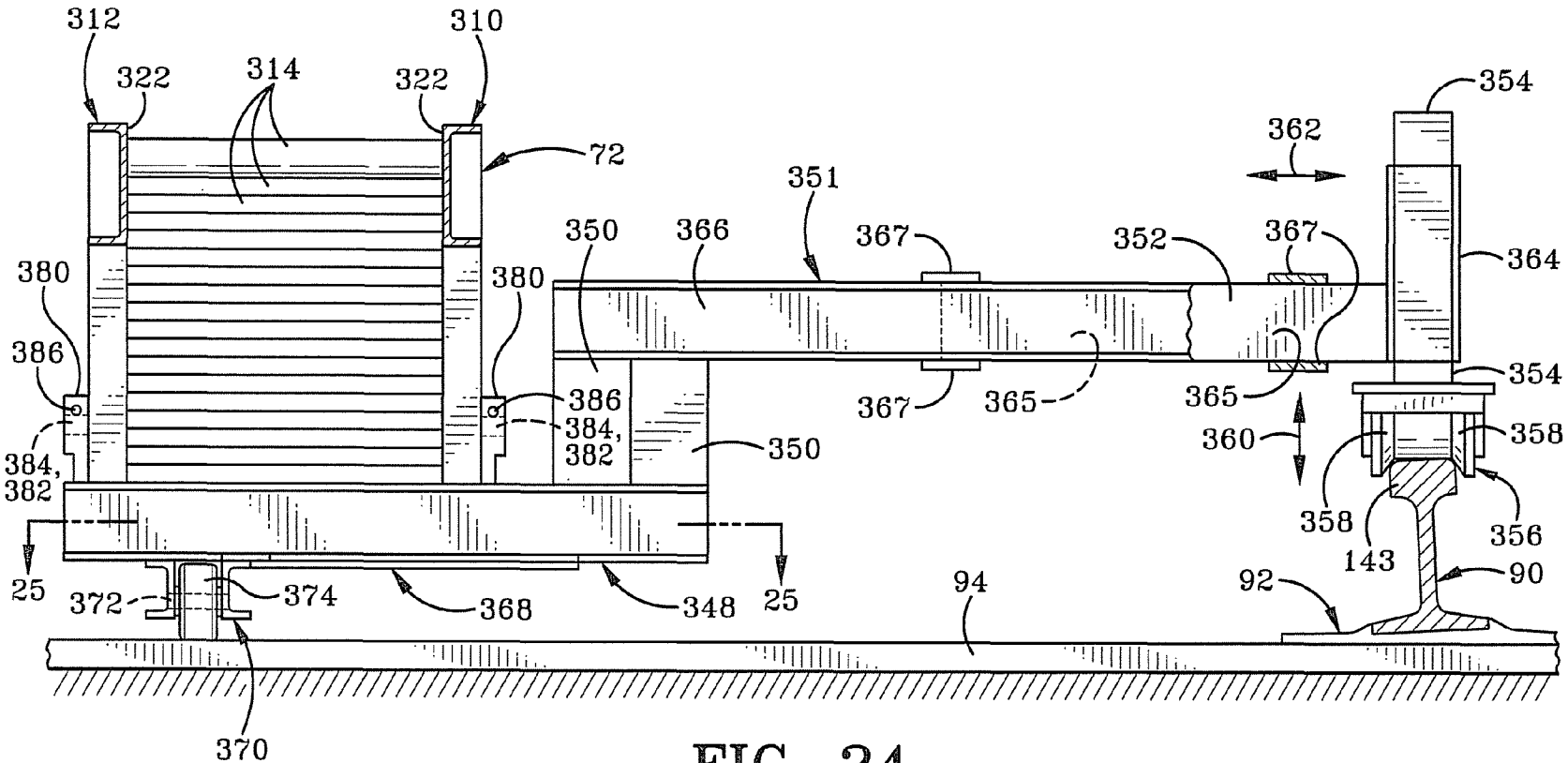
FIG. 24 is a front cross-sectional view taken generally about line 24-24 in FIG. 22.
Figure 25:
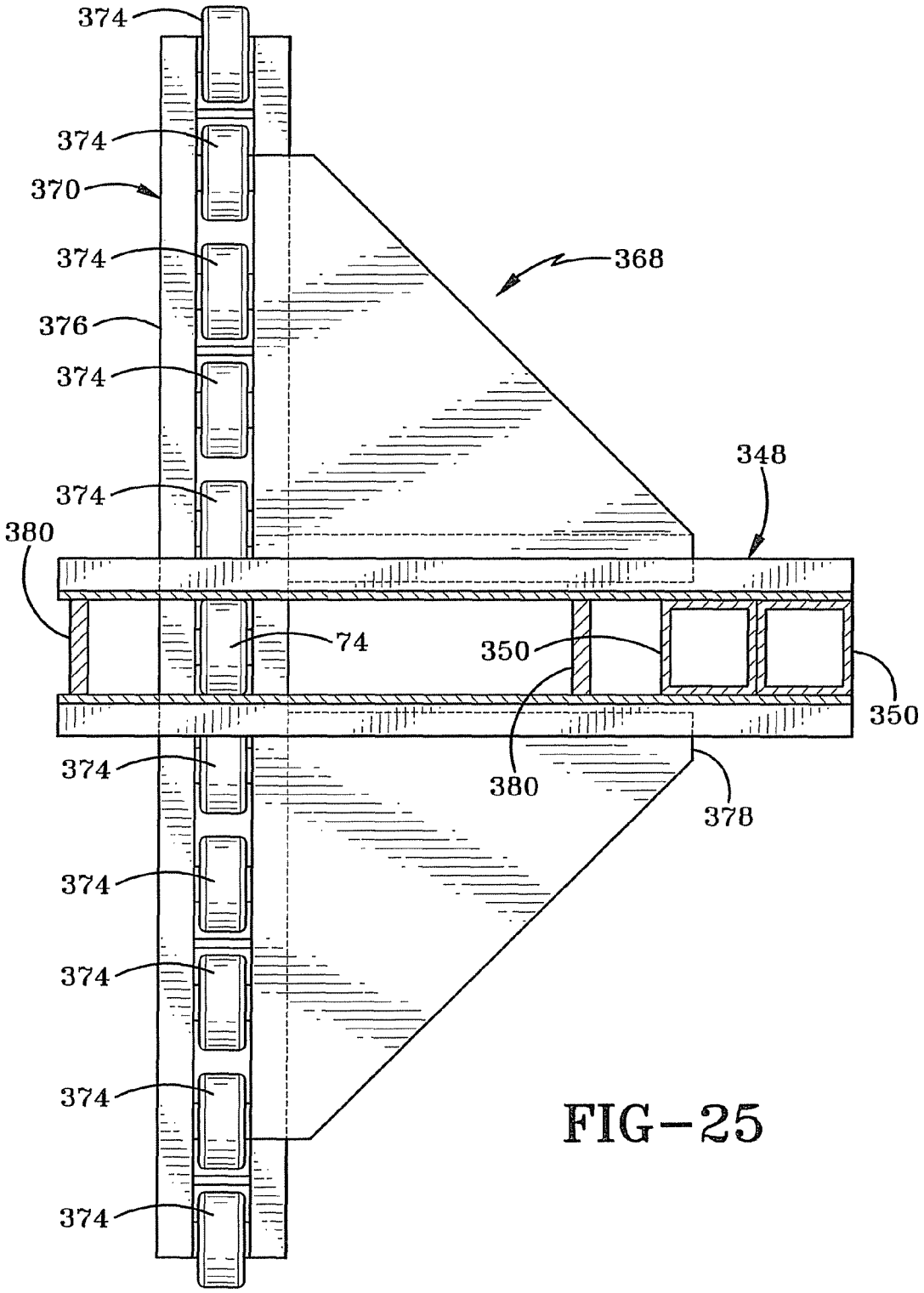
FIG. 25 is a top cross-sectional view taken generally about line 25-25 in FIG. 24.
Figure 26:
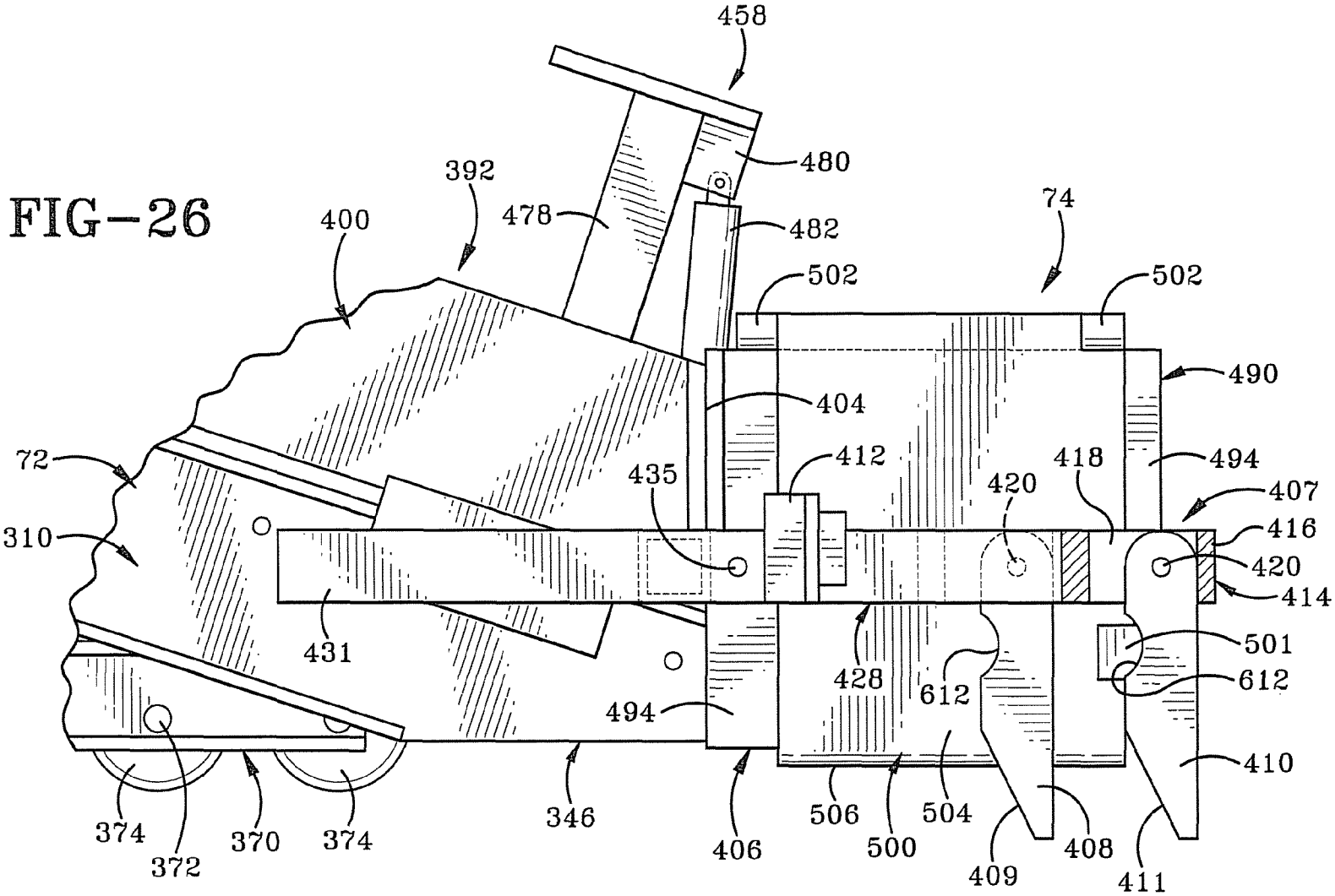
FIG. 26 is a side view of the drop mechanism and triggers.
Figure 27:
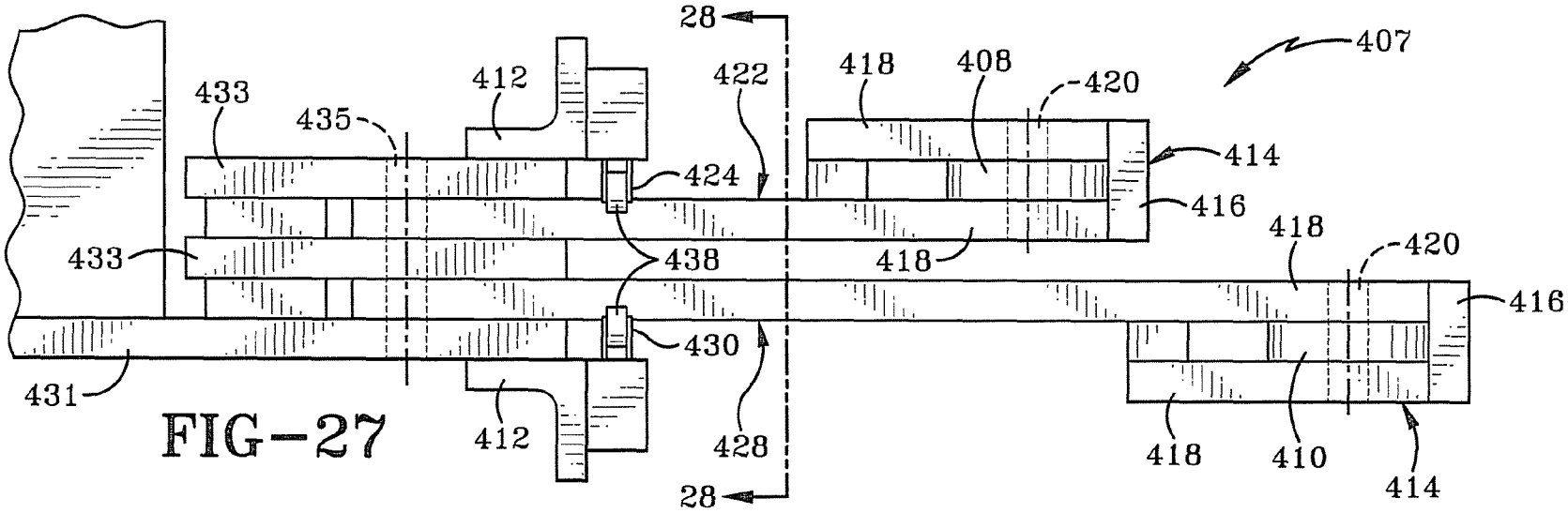
FIG. 27 is a top view of the triggers.
Figure 28:
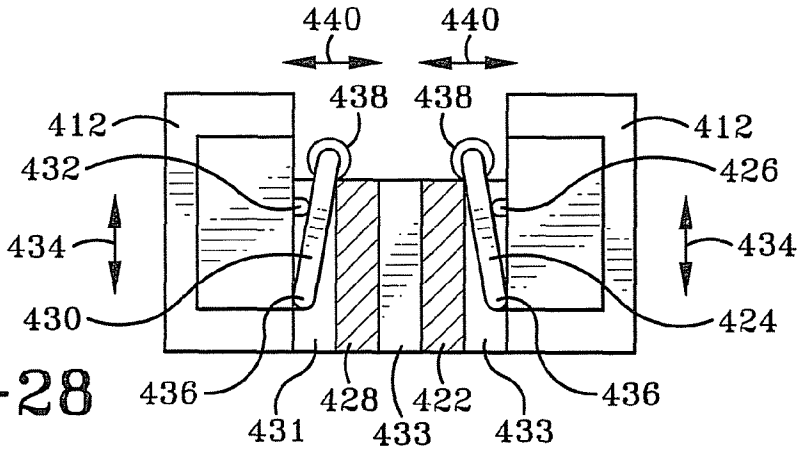
FIG. 28 is a cross-sectional view taken generally about line 28-28 in FIG. 27.

Referring to FIGS. 20 and 21, second end 294 of conveyor 70 and a first end 308 of placing conveyor 72 are both shown in greater detail. Conveyor 70 and particularly alignment wall 306 of conveyor 70 are preferably angled with respect to inner sidewall 302. Further, alignment wall 306 is preferably parallel to and aligned with an inner wall 310 of placement conveyor 72. Placing conveyor 72 also preferably includes an outer wall 312 that need not necessarily be aligned with conveyor 70 outer sidewall 304.

Placing conveyor 72 includes rollers 314 defining a plane 316 arranged to receive tie plates on a tangential top surface of the rollers 314 after leaving track 300 in the direction associated with arrow 318. Placing conveyor 72 preferably includes a pair of guide walls 320 proximate first end 308 to ensure that the tie plates remain on the placing conveyor during operation. Still further, inner sidewall 310 and outer sidewall 312 both include a raised lip portion 322 arranged to contact at least a portion of the tie plates and maintain the tie plates on rollers 314 during operation.

Placing conveyor 72 also includes a mounting bracket 324 having an L-shaped cross-section with a top leg 326 and a bottom leg 328. Bottom leg 328 includes a through hole 330 and a support ring 332 adapted to receive mounting pin 334. Base 62 includes a pair of support beams 336 extending upwards and housing cross beam 338 extending between support beams 336. The cross beam includes a through hole 340 extending through a top surface 342. Mounting pin 334 is preferably welded to cross beam 338 and extends upward beyond top surface 342 and is adapted to extend through through hole 330 to connect placing conveyor 72 to machine assembly 60 and to preferably locate first end 308 adjacent second end 294. Mounting pin 334 also includes a pivot axis 344 adapted to permit pivotal movement of placing conveyor 72 about axis 344 during operation.

Referring now to FIGS. 22 through 25, placing conveyor 72 is shown in greater detail. Placing conveyor 72 preferably includes a second end 346 opposite first end 308, with the second end having drop mechanism 74. The placing conveyor preferably includes a support base 348 having a riser 350 adapted to connect to an alignment beam 352. Alignment beam 352 includes a horizontal alignment portion 351 and a vertical alignment beam 354 with a roller wheel 356 having a pair of angled sidewalls 358 that are preferably sized to fit on either side of rail 90. In particular, vertical alignment beam 54 is adjustable in the directions associated with arrows 360, while alignment beam 352 is moveable in a direction associated with arrows 362 and particularly is used to ensure that placing conveyor 72 is aligned at the proper distance from rail 90 to locate the tie plates along the railroad ties. Vertical beam 354 is preferably slidable within a sleeve 364 to permit the vertical movement, while horizontal alignment beam 352 is slidable within a cavity 365 formed by sleeves 366 and cross slides 367 to prevent the horizontal movement.

Below and attached to support base 348 is a placing conveyor roller assembly 368. Roller assembly 368 includes a carriage 370 having a plurality of pins 372 attaching roller wheels 374 along a singular plane. Roller wheels 374 are preferably a single row and disposed along a single axis to provide consistent alignment for the placing conveyor. Specifically, the roller wheels can span the length of several railroad ties to permit a consistent and even surface for the placing conveyor.

Carriage 370 preferably a wedge shaped plate that includes an outer edge 376 and an inner edge 378 to provide stability for the placing conveyor and may be generally triangular in shape to accommodate a plurality of roller wheels 374 along outer edge 376. Base 348 may also include a pair of support legs 380 extending on each side of placing conveyor 72 with each leg having a notch 382 arranged to receive a strut 384 extending outward from placing conveyor 72. Strut 384 is secured in place by inserting a pin 386 through a locking cavity 388 in leg 380. Advantageously, this arrangement permits placing conveyor 72 to pivot about strut 384 yet limits axial movement side-to-side.

Placing conveyor 72 may also include a first stop mechanism 390 and a second stop mechanism 392 upstream from drop mechanism 74 while the second stop and drop mechanism are each located near second end 346. Preferably, first stop 390 includes a housing 394 adapted to receive a tie plate in first end 396 with a tie plate leaving a second end 398. Similarly, second stop 392 includes a housing 400 having a first end 402 and a second end 404 which leads into drop mechanism 74. Finally, drop mechanism 74 includes a housing 406 which is preferably located proximate housing 400.

FIGS. 26 through 31 illustrate the detailed components of the first stop 390, second stop 392, and drop mechanism 74. A trigger assembly 407 includes a first trigger 408 with an angled portion 409 and a second trigger 410 with an angled portion 411 and each trigger is arranged to activate a switch located within switchbox 412. Trigger 408 includes a housing 414 having a backwall 416 and a pair of sidewalls 418 with trigger 408 pivotably mounted within housing 414 with a pin 420. Further, second trigger 410 includes a similar housing with sidewalls and a rear wall, however, the second trigger is disposed further downstream than first trigger 408. Sidewall 418 of first trigger 408 includes an actuator leg 422 which is arranged to engage actuator 424 and can press a moveable pin 426 within switchbox 412. Further, second trigger 410 includes an actuator leg 428 similar to actuator leg 422 wherein the actuator leg is operated by trigger 410 and contacts an actuator 430 to displace switch 432. Actuator legs 422 and 428 are secured with a mounting bracket 431, spacers 433, and a pin 435. Thus, each actuator leg operates independently of one another to contact a respective switch and cause some sort of movement within the second stop or drop box as discussed below.

Actuator leg 422 is displaceable in a direction associated with arrows 434 and then causes displacement of actuator 424 as it pivots about a pivot point 436 and forces a top. portion 438 of the actuator in a direction associated with arrows 440. Advantageously, second trigger 410 operates in the same way with actuator leg 428 being displaced in the direction associated with arrows 434 to contact actuator 430 to pivot the actuator about pivot point 436 and force a top portion 438 of actuator 430 in a direction associated with arrows 440 to compress switch 432.

Figure 29:
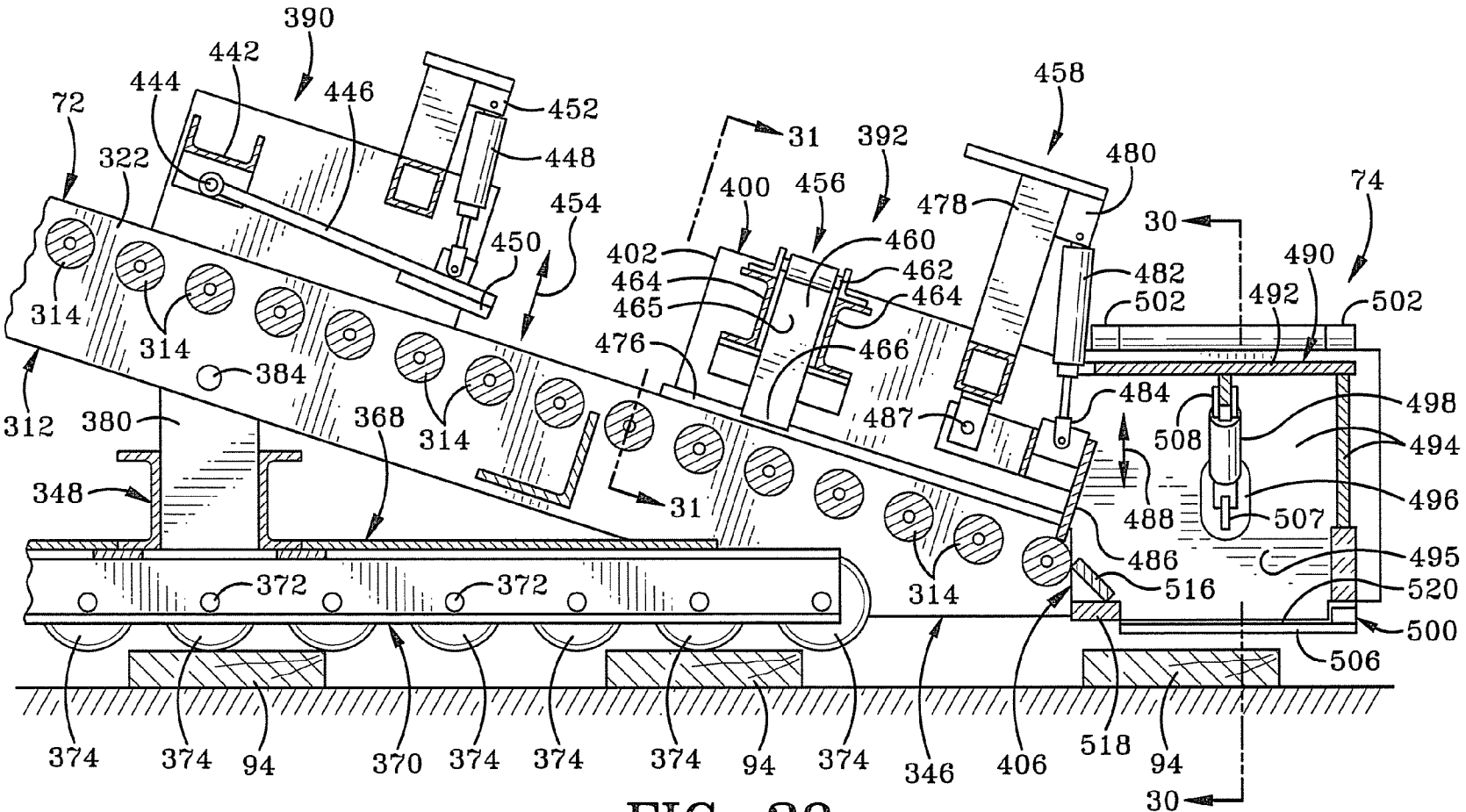
FIG. 29 is a cross-sectional view taken generally about line 29-29 in FIG. 22.
Figure 30:
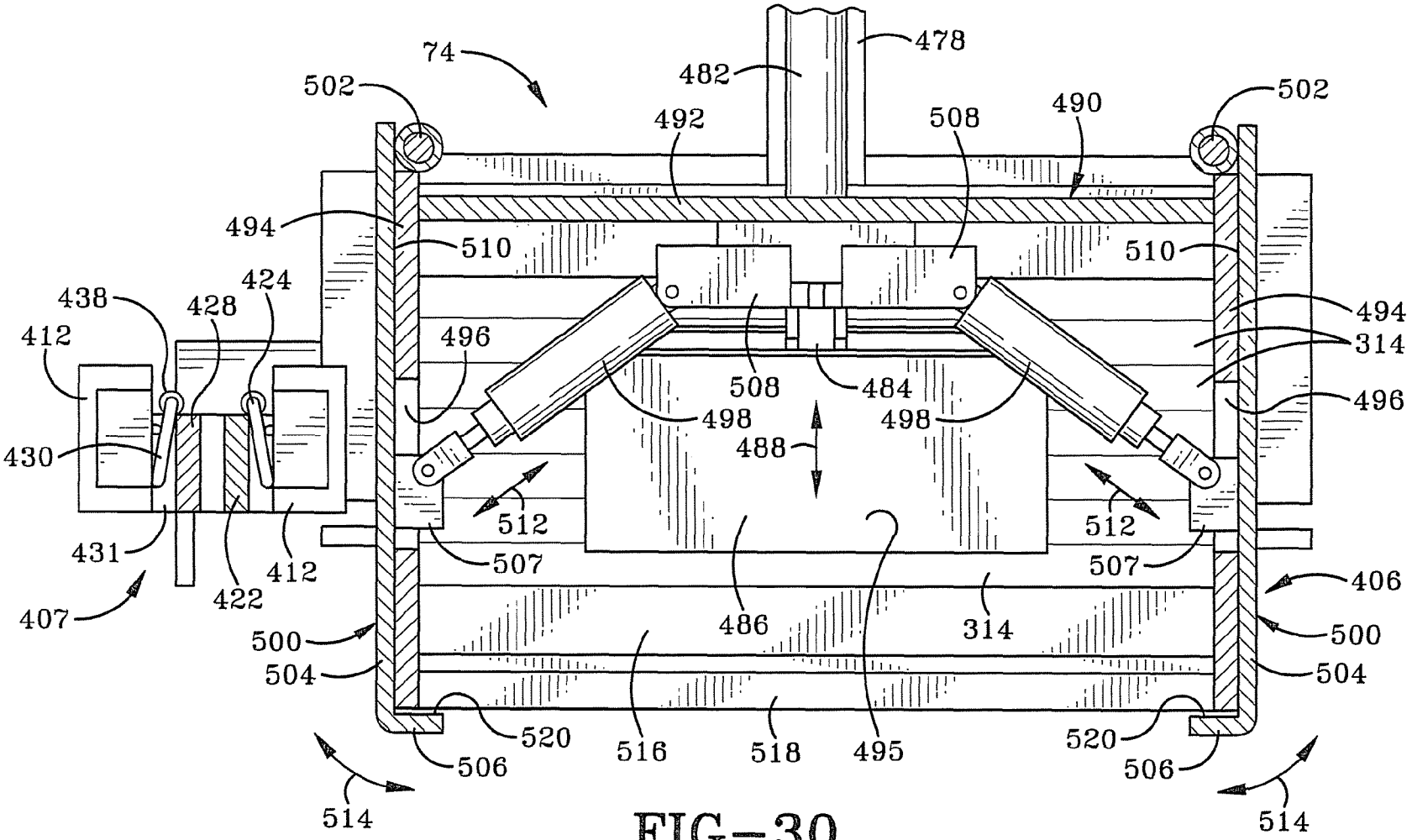
FIG. 30 is a cross-sectional view taken generally about line 30-30 in FIG. 29.
Figure 31:
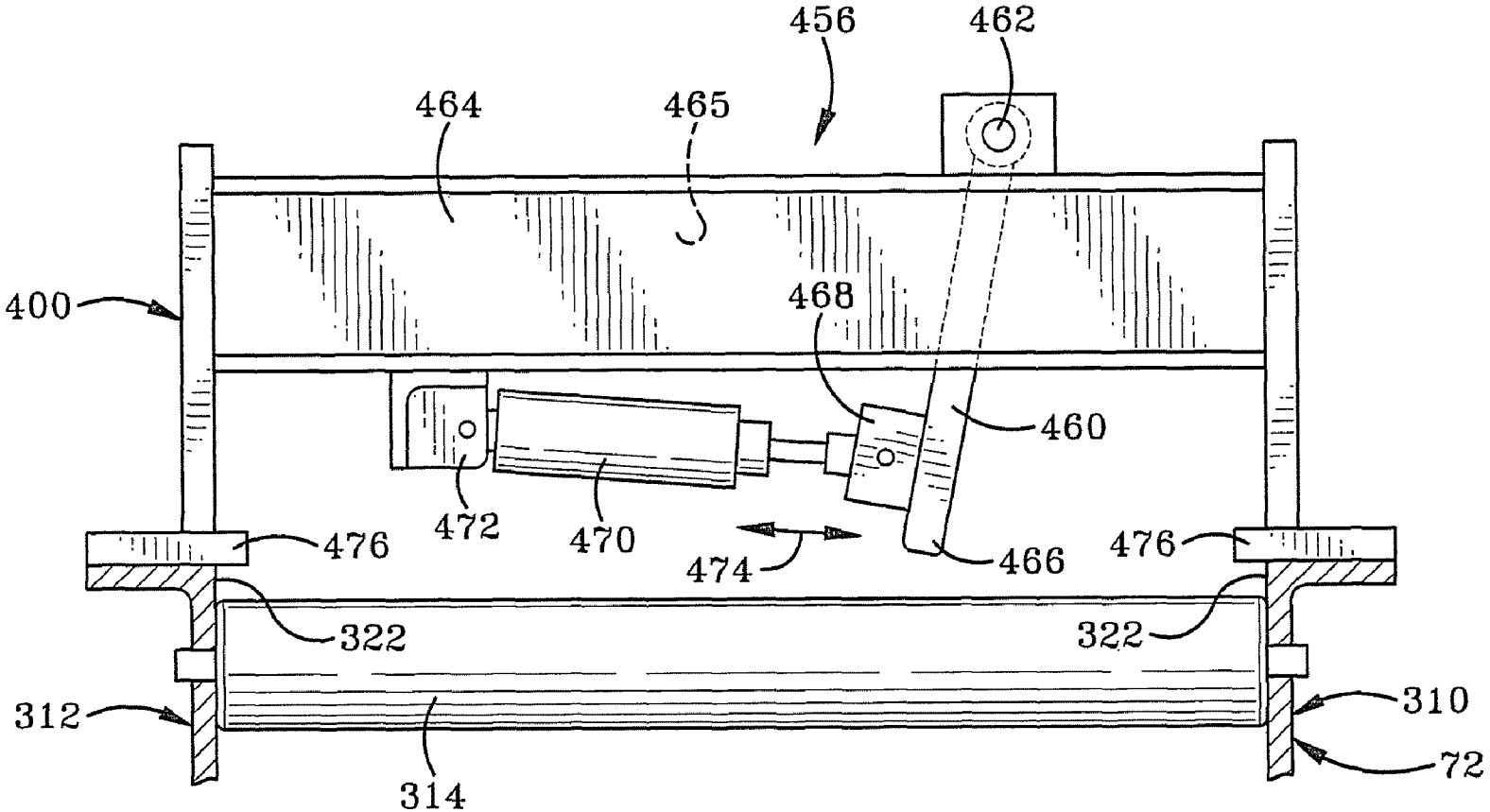
FIG. 31 is a cross-sectional view taken generally about 31-31 in FIG. 29.

Referring now to FIGS. 29 through 31, first stop 390 includes a front mount 442 having a stud 444 arranged to receive stop arm 446 to permit pivotable movement about stud 444 by movement of actuator 448. Specifically, actuator 448 is connected between a stop end 450 of lever arm 446 and an actuator mount 452 connected to housing 394. Thus, vertical movement of actuator or cylinder 448 imparts movement of second end 450 and pivots the lever arm about stud 444 to provide vertical movement of stop end 450 in the direction associated with arrows 454.

Second stop 392 preferably includes a stop 456, while a third stop 458 controls access to drop mechanism 74. As particularly seen in FIG. 31, second stop 456 includes a lever arm 460 pivotably mounted to beams 464 with a stud 462 within opening 465. Lever arm 460 also includes a terminal end 466 extending beyond a cylinder connection block 468 that is secured to an actuator or cylinder 470. Cylinder 470 is also connected to a mount 472 so that the cylinder can move in the direction associated with arrows 474 during operation. Second stop 456 also preferably includes a pair of guide rails 476 on each side to help trap a tie plate during normal operation as will be described in greater detail below.

Referring specifically now to FIGS. 29 and 30, third stop 458 preferably includes a riser beam 478 having a top actuator mount 480 arranged to secure actuator or cylinder 482. Actuator 482 includes a second end 484 connected to a moveable wall 486 that functions as the final stop prior to entering drop mechanism 74. Moveable wall 486 is pivotably connected at pivot 487 so that operation of actuator 482 may also impart a slightly angled vertical movement or arc shaped movement.

In particular, actuator 482 imparts vertical movement in the direction associated with arrows 488 during operation.

Drop mechanism 74 is preferably formed with an inner platform 490 having a top wall 492 and sidewalls 494 at least partially defining a cavity 495. The left and right sidewall each include an aperture 496 arranged to receive cylinders 498 controlling the pivotable movement of outer walls 500 until the doors contact a door stop 501. In particular, outer walls 500 are pivotably secured to drop mechanism 74 via pivot joints 502 proximate top wall 492 and sidewalls 494. Outer walls 500 preferably include an elongated side portion 504 and a lower lip 506 extending inward at a generally perpendicular orientation from side portion 504. Further, actuators 498 are mounted to an inner mount 508 on a first end and an inner portion 510 of side portion 504 through aperture 496 with an outer mount 507.

During operation, the actuators extract and retract in the direction associated with arrows 512 and may cause pivotable movement about joints 502 to rotate lip portion 506 in the direction associated with arrows 514 until lip portion 506 is located outward of sidewalls 494. Still further, drop mechanism 74 also preferably includes an alignment ramp 516 located on a spacer 518 which works in conjunction to ensure that a tie plate rests properly on a top side 520 of lower lip 506. As will be discussed below in greater detail, first trigger 408 controls actuators 498 to open and close outer walls 500, while second trigger 410 operates second stop 392 and third stop 458.

Having described the structure of a preferred embodiment, a preferred method of operation will be described in detail and should be read in light of FIGS. 1 through 56 and particularly FIGS. 32 through 56.

Figure 32:
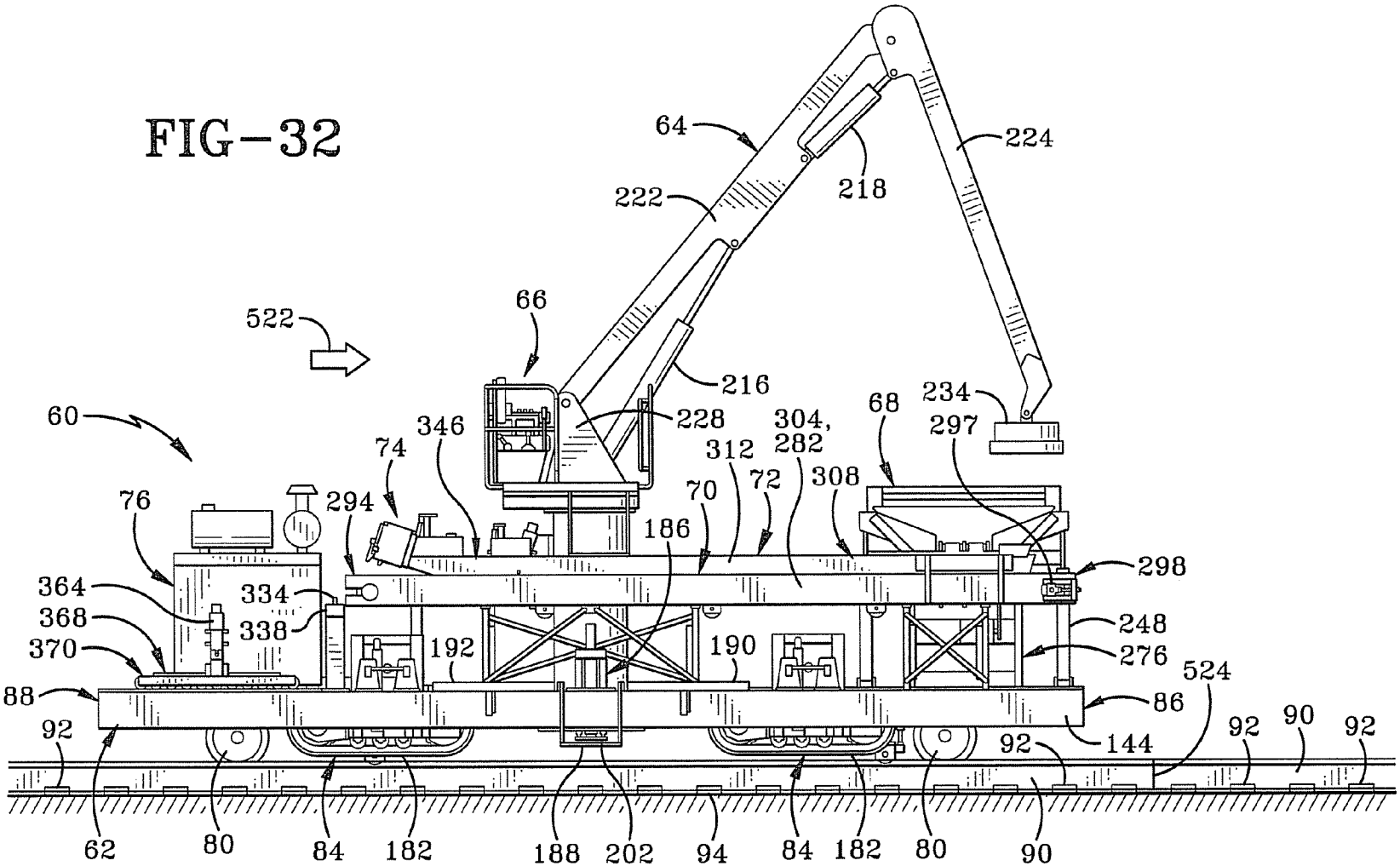
FIG. 32 illustrates the machine traveling down the rails on the railroad wheels.

FIG. 32 illustrates machine assembly 60 traveling down the rails in the direction associated with arrow 522. In this arrangement, railroad wheels 80 are engaged with a pair of railroad rails 90 due to the fact that the rail that is to be replaced has not ended and tie plates are not immediately necessary. However, as the machine travels in the direction associated with arrow 522, it ultimately encounters the end of one of rails 90 and is then prepared for the next step during the operation.

Figure 33:
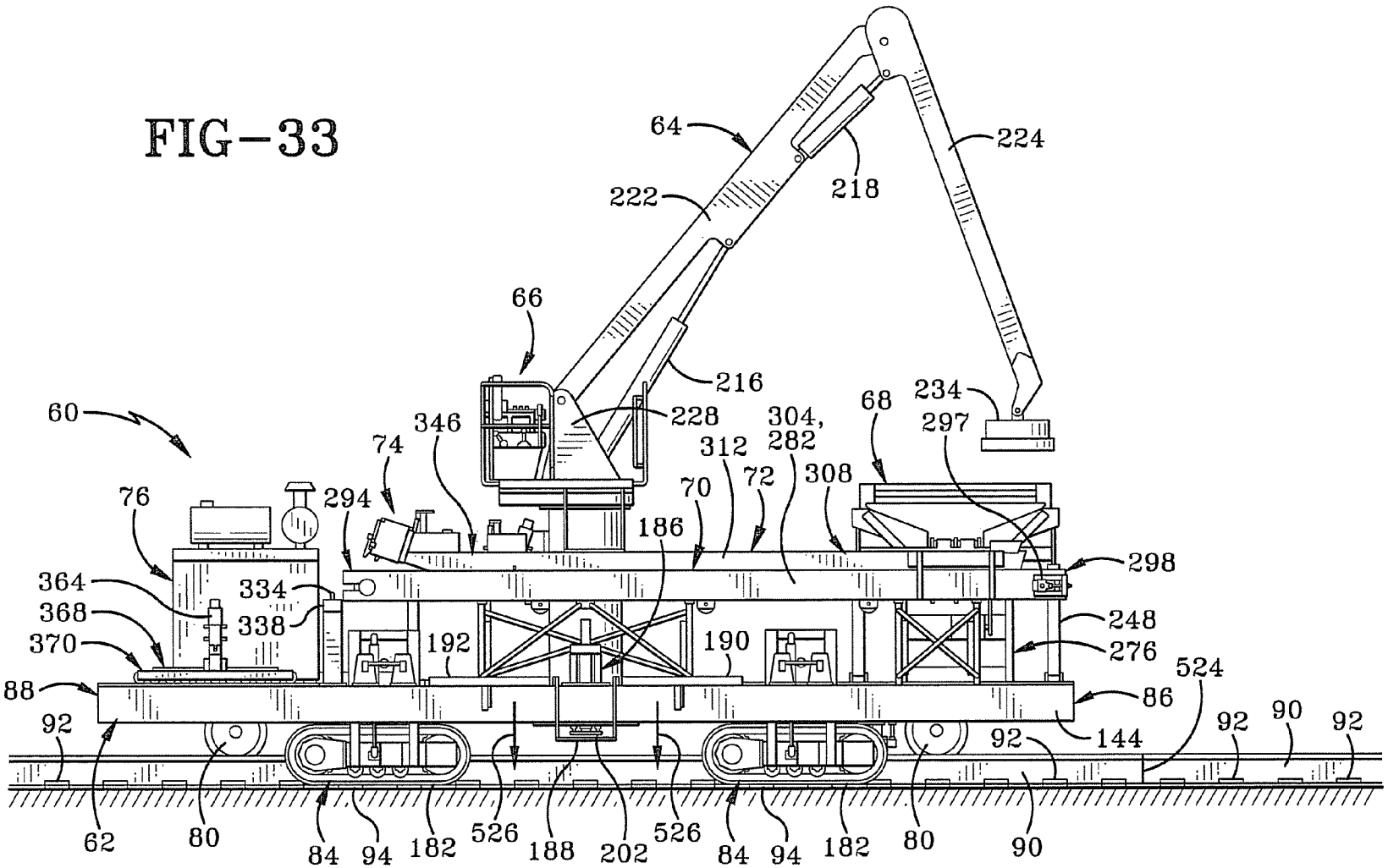
FIG. 33 illustrates the crawlers being lowered outside of the railroad ties.
Figure 34:
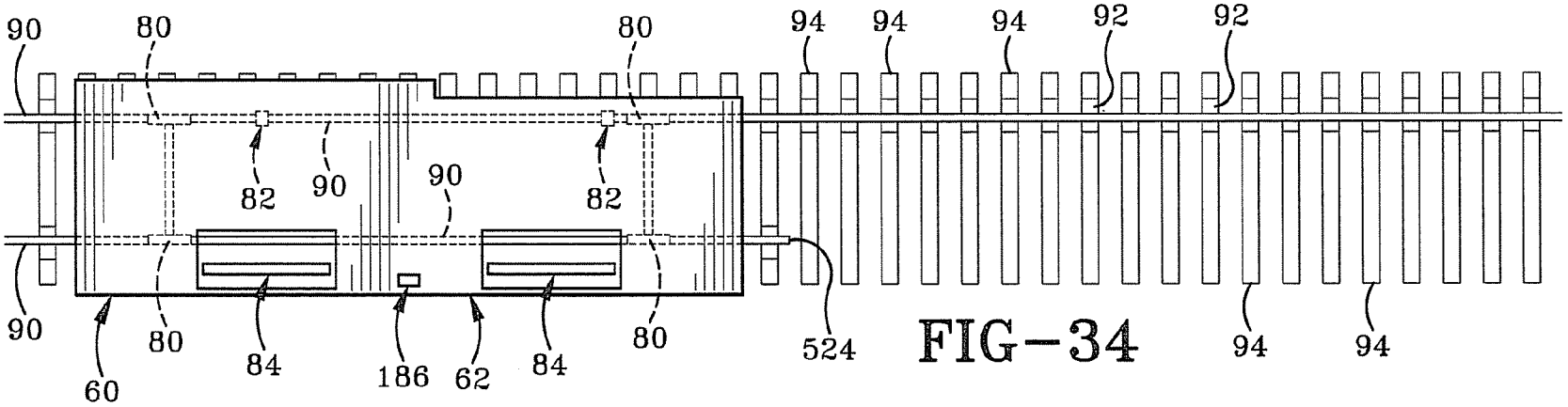
FIG. 34 illustrates the machine on the railroad rails and the crawlers located outside of the rails.
Figure 35:
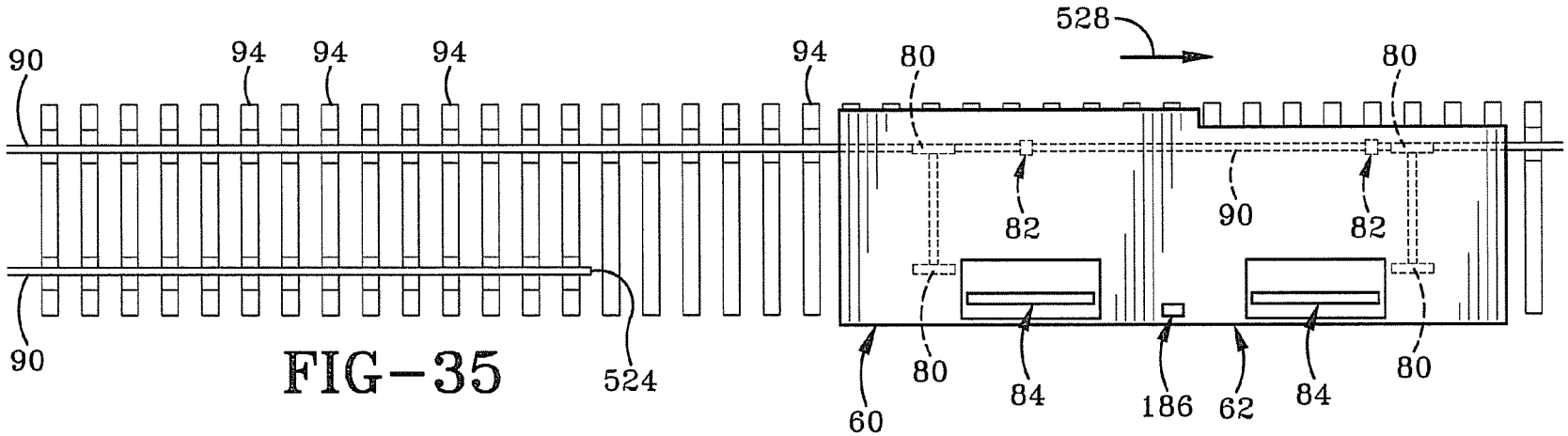
FIG. 35 illustrates the crawler moving beyond the edge of one of the railroad rails.
Figure 36:
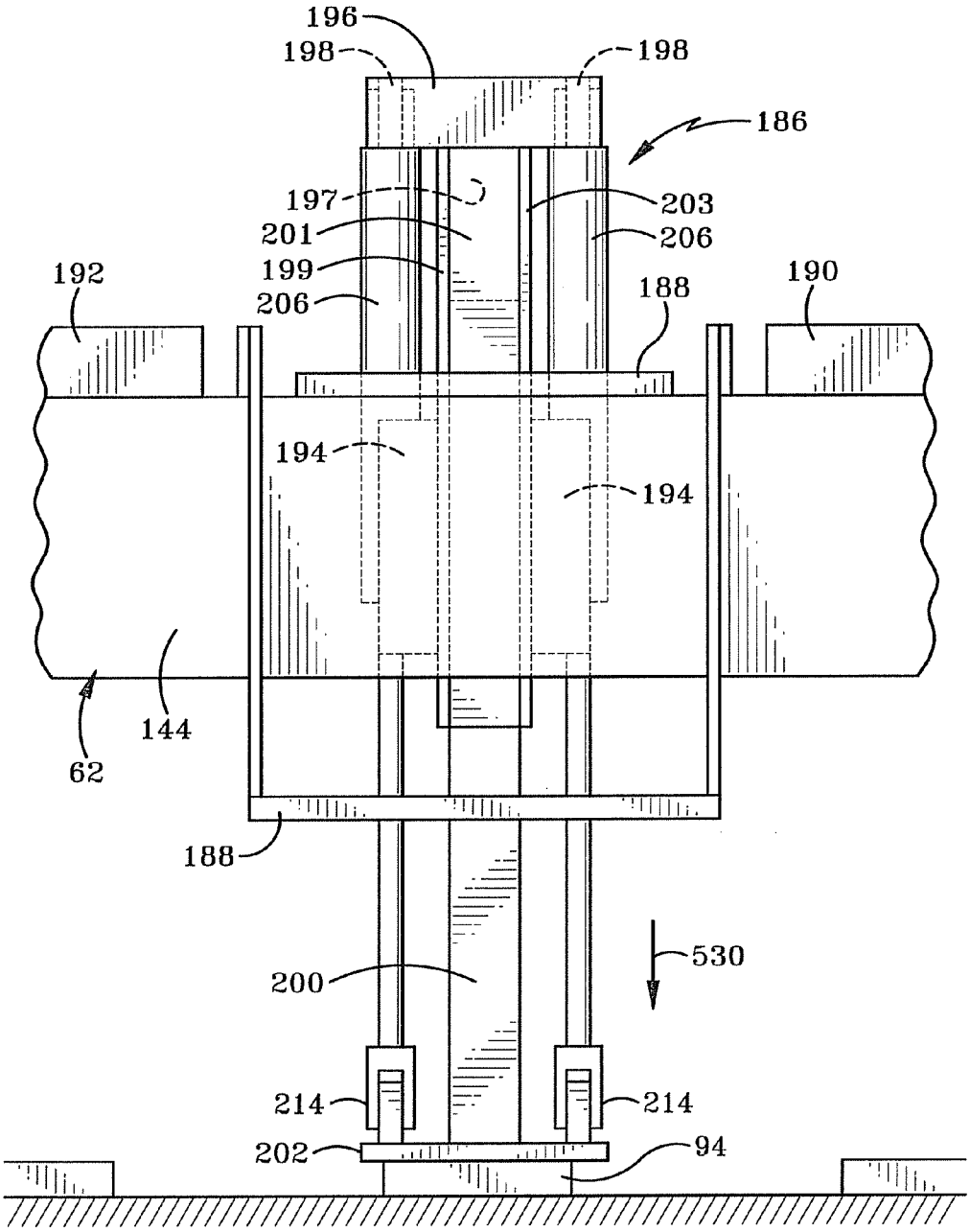
FIG. 36 illustrates the lifting assembly supporting the crawler side of the machine.
Figure 37:
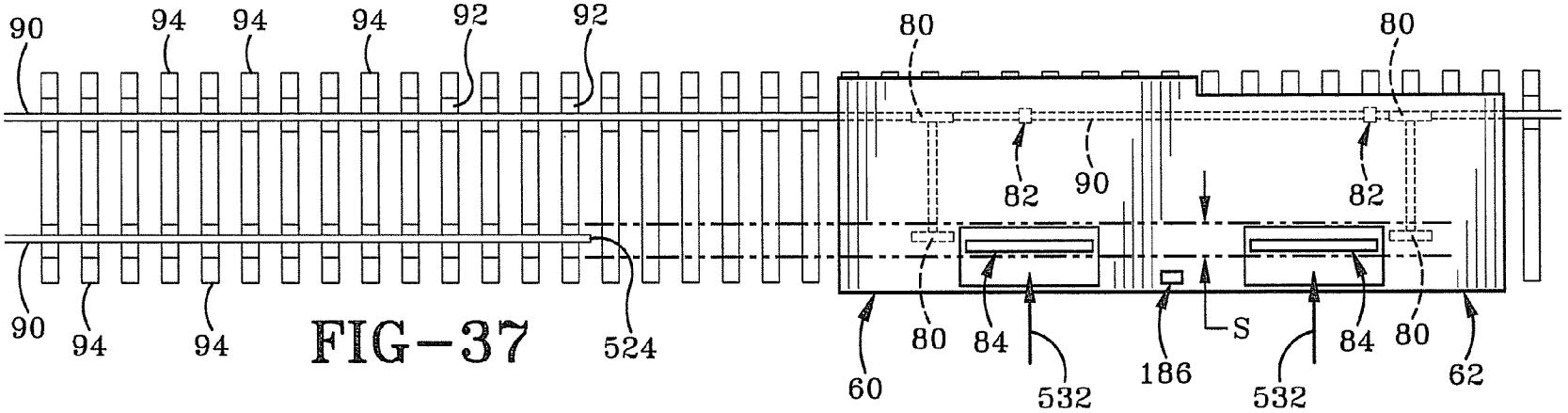
FIG. 37 illustrates the crawler being moved in a direction inward and aligned with the railroad rail.

Referring to FIG. 33, as the machine travels down the rail, it stops short of the end of the rail 524 and crawlers 84 are lowered in the direction associated with arrows 526 until the crawlers contact an outer portion of railroad ties 94 or the ground proximate the railroad ties. Advantageously, the crawlers are used in combination with railroad wheels 80 until both the railroad wheels 80 and crawlers 84 support the weight of the machine assembly on one particular side. FIG. 34 illustrates crawlers 84 with the tread located outside of rail 90 prior to the machine passing the end 524 of the rail. FIG. 35 illustrates the railroad wheels 80 of one side being disengaged with rail 90 as crawlers 84 are used to move the machine in the direction associated with arrow 528 as the rail 90 ends and tie plates 92 must be dropped by machine assembly 60 in accordance with the operation of the vehicle.

As machine 60 passes rail end 524, lift assembly 186 extends downward in the direction associated with arrow 530 until platform 202 contacts the ground or railroad tie 94 and raises the crawlers off the ground. Advantageously, lift assembly 186 is arranged between the crawlers and particularly on the side of the machine assembly that the rail ends and tie plates are necessary. The lift assembly raises one side of the machine assembly and thereby removes the crawlers from connection with railroad ties 94 or the ground. Now viewing FIG. 37, the crawlers, and particularly crawler belt 82, is moved inward in the direction associated with arrow 532 a distance S so that the crawlers are aligned with railroad wheels 80 to properly support the machine during operation. Further, during this crawler reorientation, as well as during the remainder of the operation, guides 82 are used to maintain the positioning of the side of the machine that is in contact with the rail during the entire operation to prevent any unwanted and detrimental movement.

Figure 39:
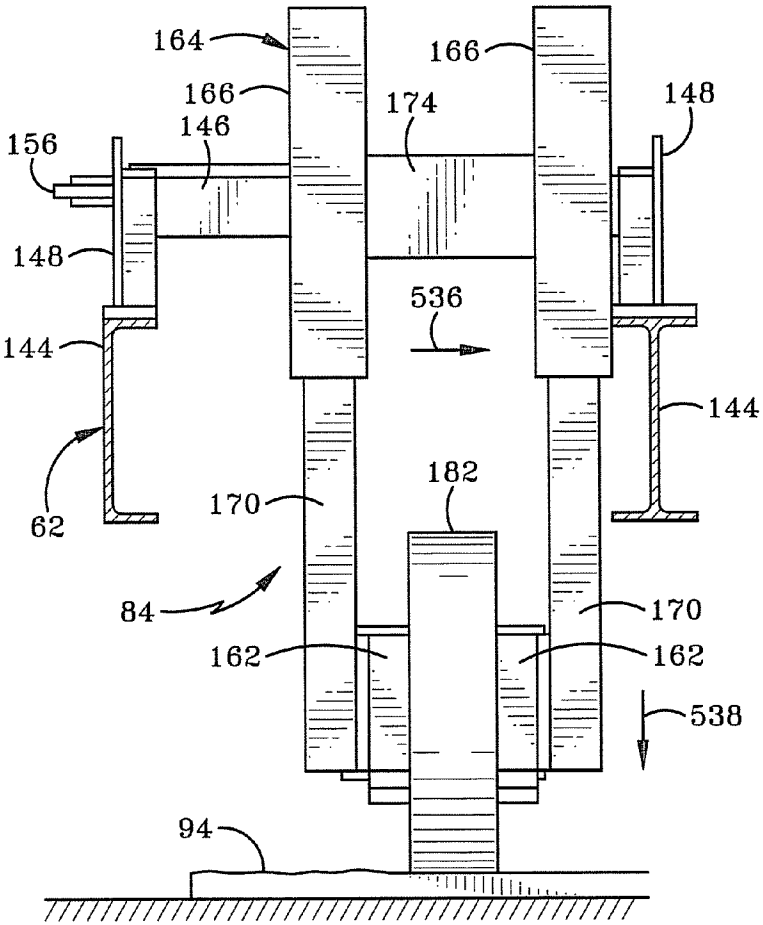
FIG. 39 illustrates the crawler being moved inward towards the rail and directed downwards back onto the railroad tie.
Figure 38:
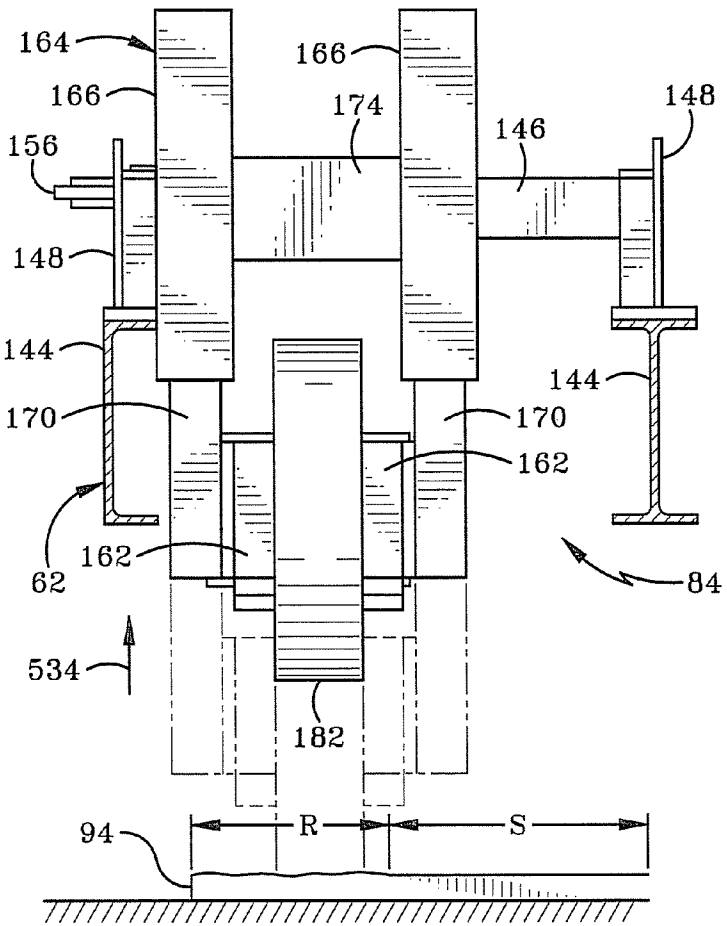
FIG. 38 is a front view of the crawler being pulled upwards while the machine is supported by the lift member.
Figure 40:
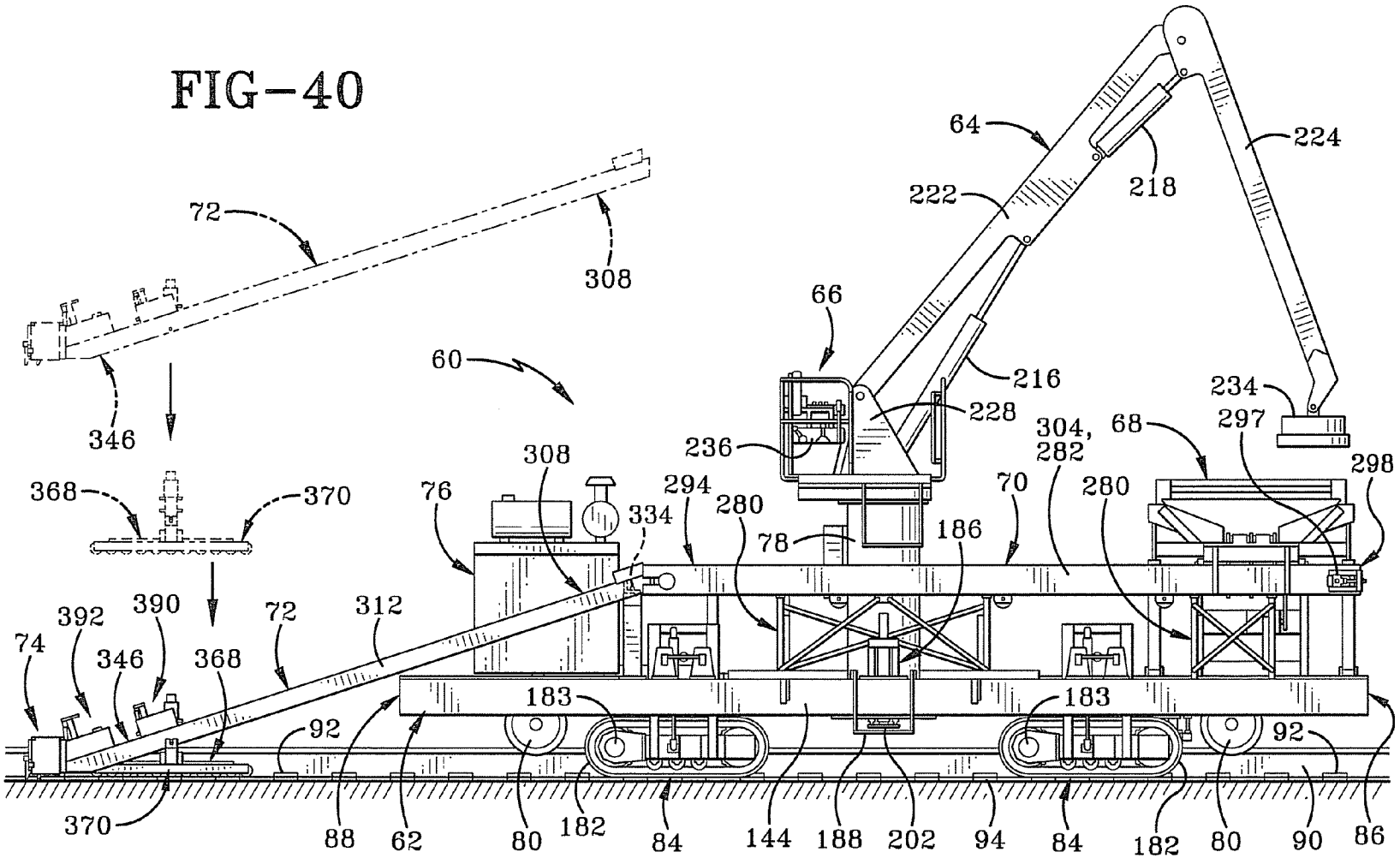
FIG. 40 illustrates the placing conveyor and the alignment track being located on the railroad ties.

FIGS. 38 and 39 illustrate the movement of crawlers 84 while lift assembly 186 has raised one side of the machine. In particular, crawlers 84 are raised in the direction associated with arrow 534 by actuator 152, then moved in the direction associated with arrow 536 by horizontal actuator 150, and then lowered back into contact with railroad tie 94 by cylinder 152 in the direction associated with arrow 538. Advantageously, the crawler moves from a rough area R to a smooth area S of railroad ties 94.

Having now located crawlers 84 within the smooth area of the railroad ties and preferably in line with railroad wheels 80, the lift assembly 186 is then raised upward so that the crawlers 84 are now in contact with the railroad ties while railroad wheels 80 and guides 82 on the opposing side remain in contact with rail 90. Next, roller assembly 368 is located on railroad ties 94 and placing conveyor 72 is moved from a transit position to an operating position and particularly locates studs 384 of the placing conveyor within notches 382 of the roller assembly and locates locking pin 386 within locking cavity 388. Further, placing conveyor hole 330 is located proximate mounting pin 334 and particularly mounting pin 334 extends through hole 330 to locate first end 308 of placing conveyor 72 proximate second end 294 of conveyor 70 to permit the pivotable movement about the mounting pin as well as permit the tie plate to travel from conveyor 70 onto placing conveyor 72.

Figure 41:
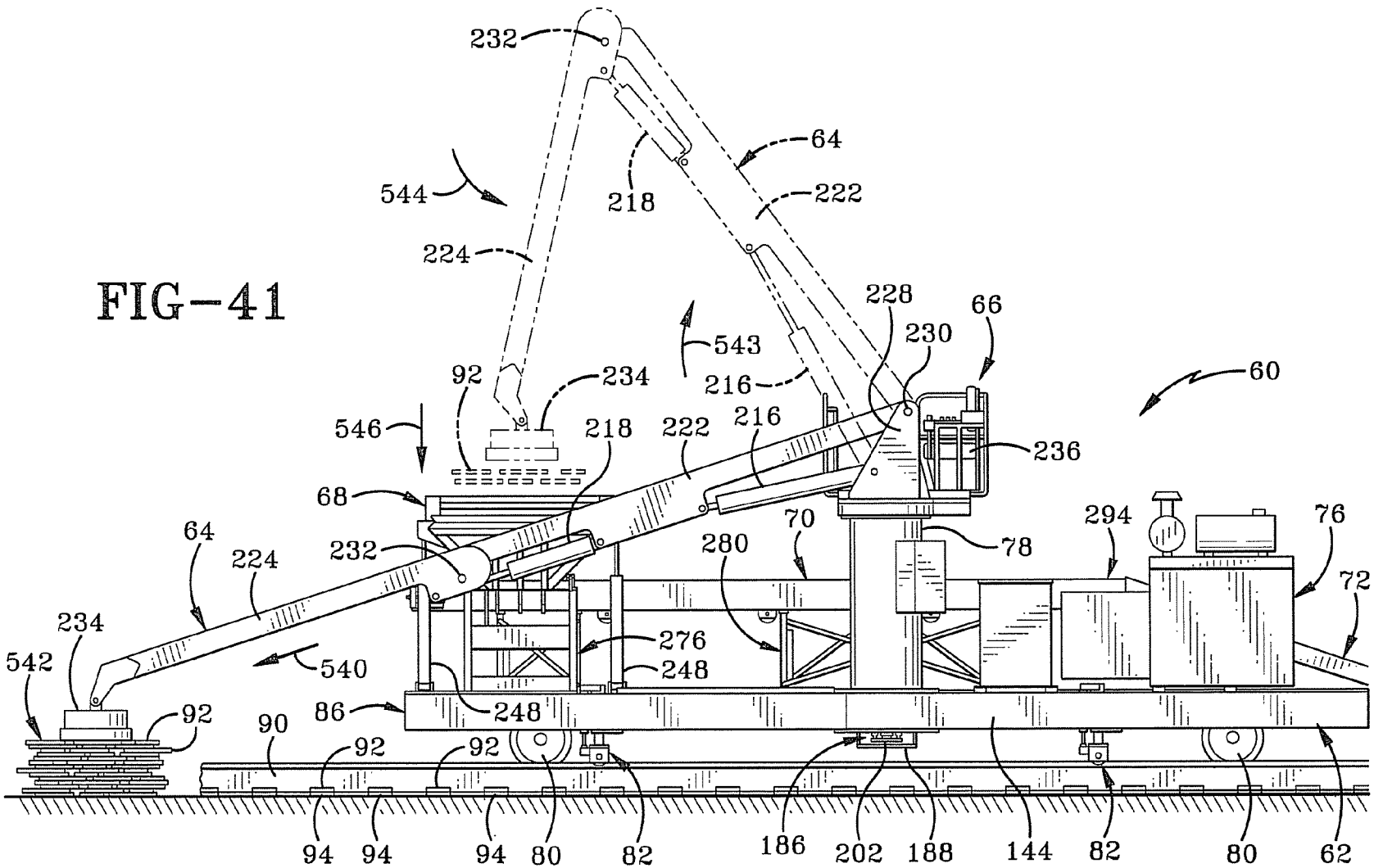
FIG. 41 illustrates operation of the boom to pick-up tie plates and locating the tie plates within a hopper.
Figure 42:
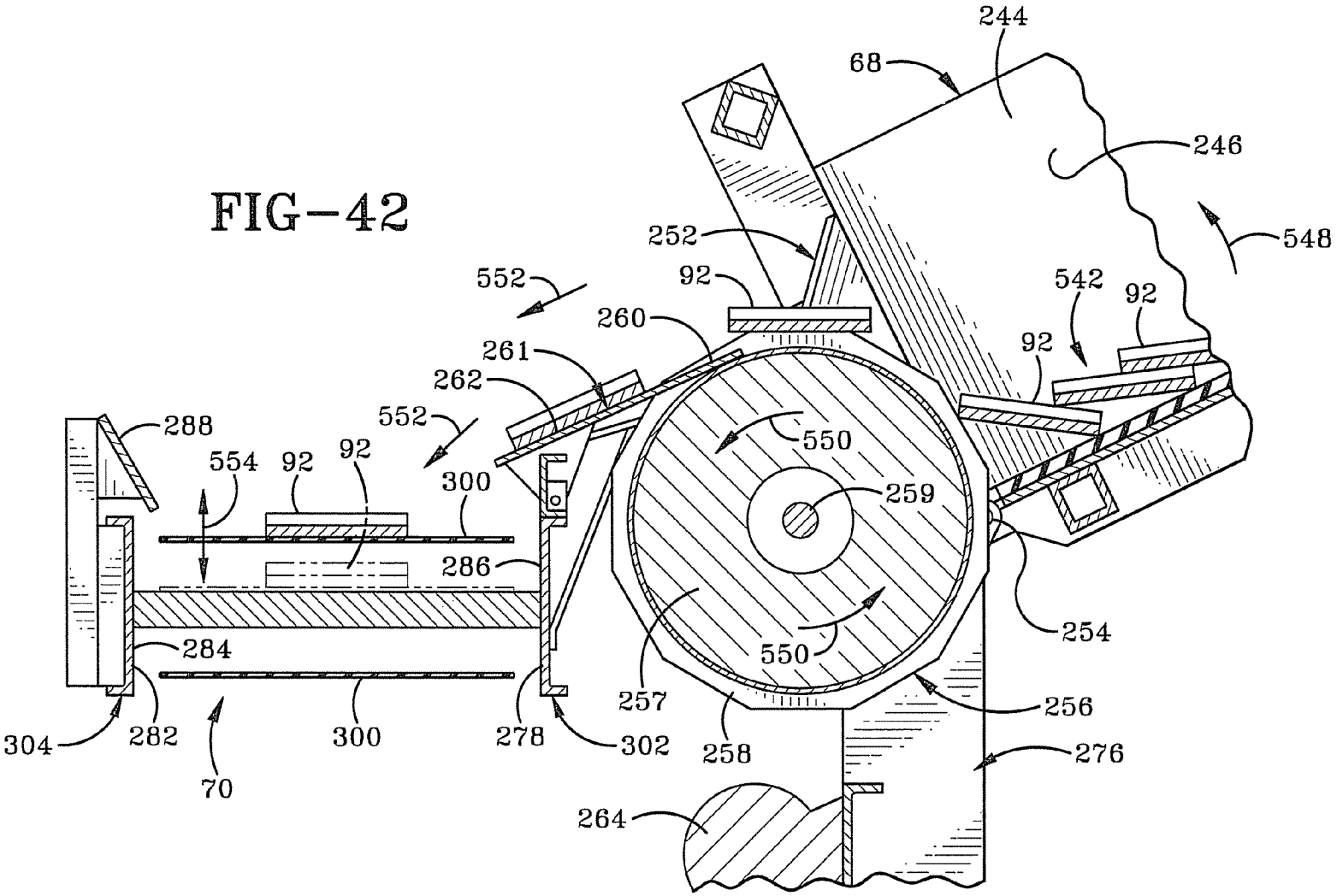
FIG. 42 illustrates tie plates within the hopper operating in conjunction with being loaded with a magnet wheel to locate the tie plates on the conveyor.

Referring now to FIG. 41, the machine is ready for continuous operation with the placing conveyor and roller assembly in place and the crawlers in their proper positions. Boom 64 is then extended in the direction associated with arrow 540 until the magnet 234 is proximate and preferably above a stack of tie plates 542. After activating the magnet, the boom pivots upward in the direction associated with arrow 543 and preferably pivots the second member 224 in the direction associated with arrow 544 until the magnet and the stack of tie plates are proximate hopper 68. The operator then lowers the stack of tie plates 542 and magnet 234 in the direction associated with arrow 546 until the tie plates are at least partially within or proximate hopper 68.

After the hopper has been loaded with the stack of tie plates 542, the operator then pivots the hopper in the direction associated with arrow 548 until the magnet wheel 256 can contact the tie plates while rotating in the direction associated with arrows 550 and pull the tie plates from the hopper cavity 246. As the magnet wheel rotates in the direction associated with arrow 550, the tie plates contact ramp 260 to disengage the tie plate from magnet wheel 256 and gravity forces the tie plate down the ramp in the direction associated with arrow 552 and ultimately on to conveyor belt 300. During this movement, the weight of tie plate 92 may cause belt 300 to flex in the direction associated with arrows 554 due to the drop from ramp 260 to belt or track 300.

Figure 43:
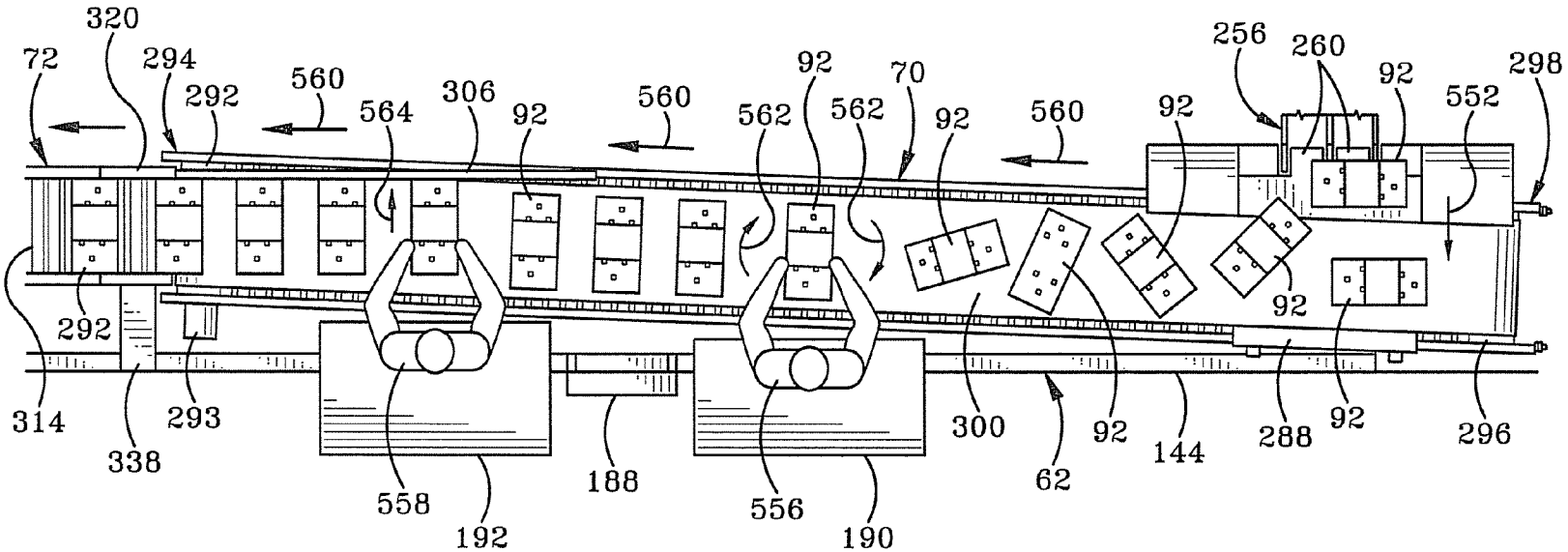
FIG. 43 illustrates the tie plates being directed down the conveyor and a pair of workers orienting and aligning the tie plates.

FIG. 43 illustrates an operator 556 and 558 standing on operator pads 190 and 192 respectively. As tie plates 92 are forced on to conveyor track 300 by magnet wheel 256, the orientation of the tie plates is not as precise as is necessary. After the tie plates are located on conveyor track 300, they travel in the direction associated with arrows 560 and operator 556 rotates the tie plates in the direction associated with arrows 562 to properly orient the tie plates. As discussed above, the tie plates have a specific orientation in order to ensure that the rail is properly angled. After operator 556 orients the tie plates, operator 558 forces the tie plates into contact with alignment wall 306 by forcing the tie plates in the direction associated with arrow 564. After the rails have been properly rotated and forced against the alignment wall, the tie plates are now ready to be installed on railroad ties 94.

Figure 44:
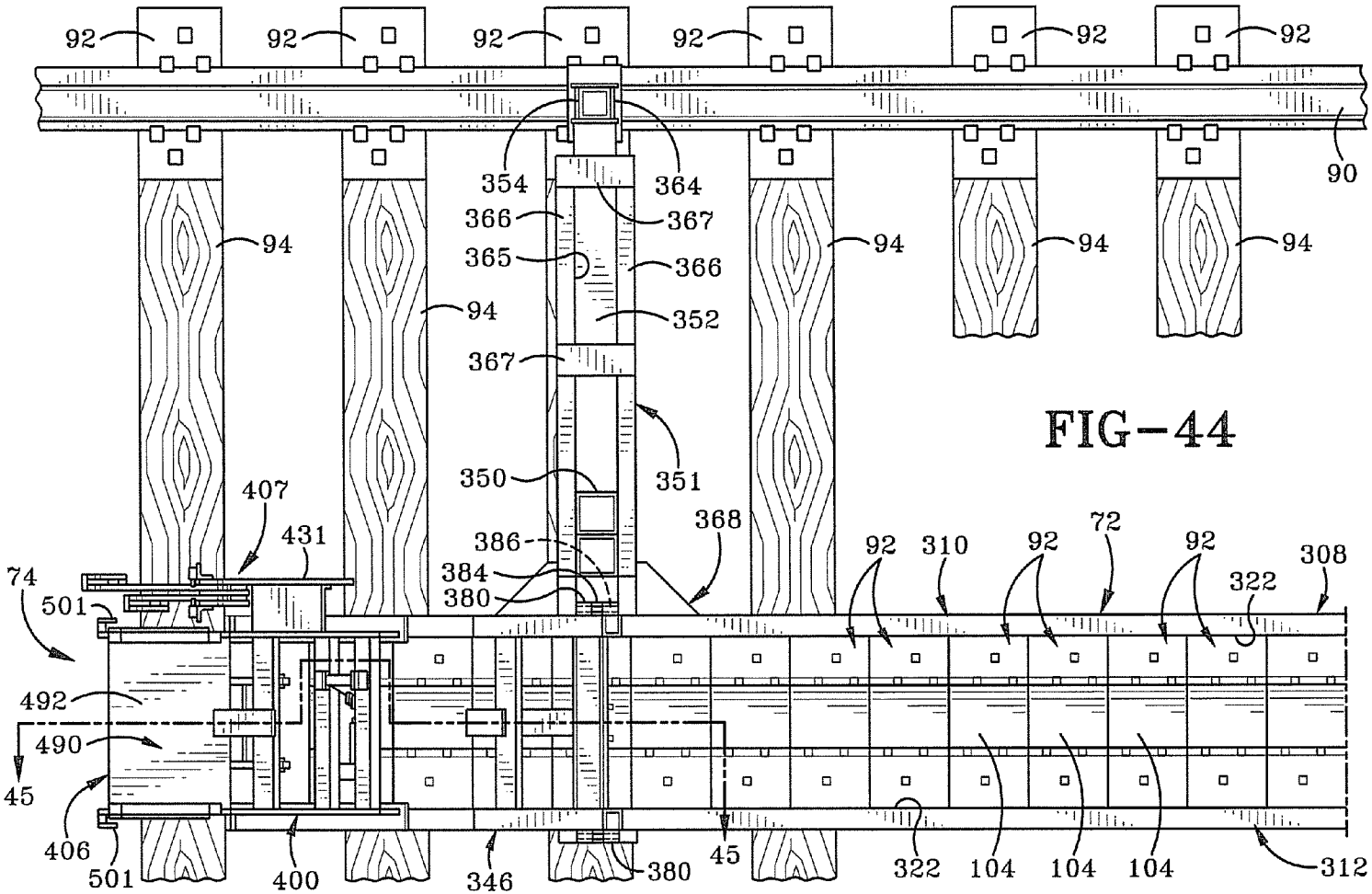
FIG. 44 illustrates tie plates extending down the placing conveyor.
Figure 45:
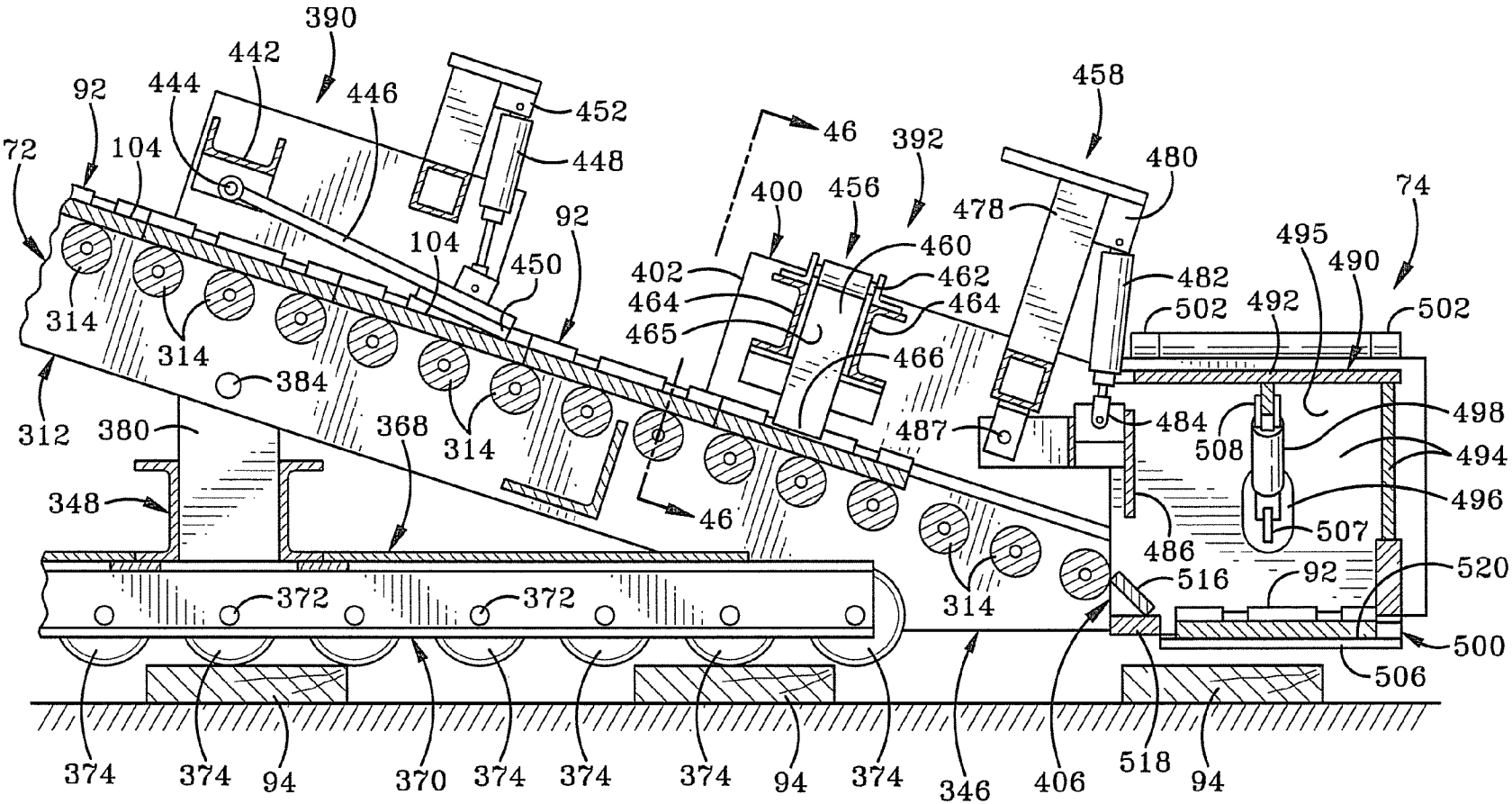
FIG. 45 illustrates a cross-sectional view taken generally about line 45-45 in FIG. 44 with tie plates at various staging positions during operation.
Figure 46:
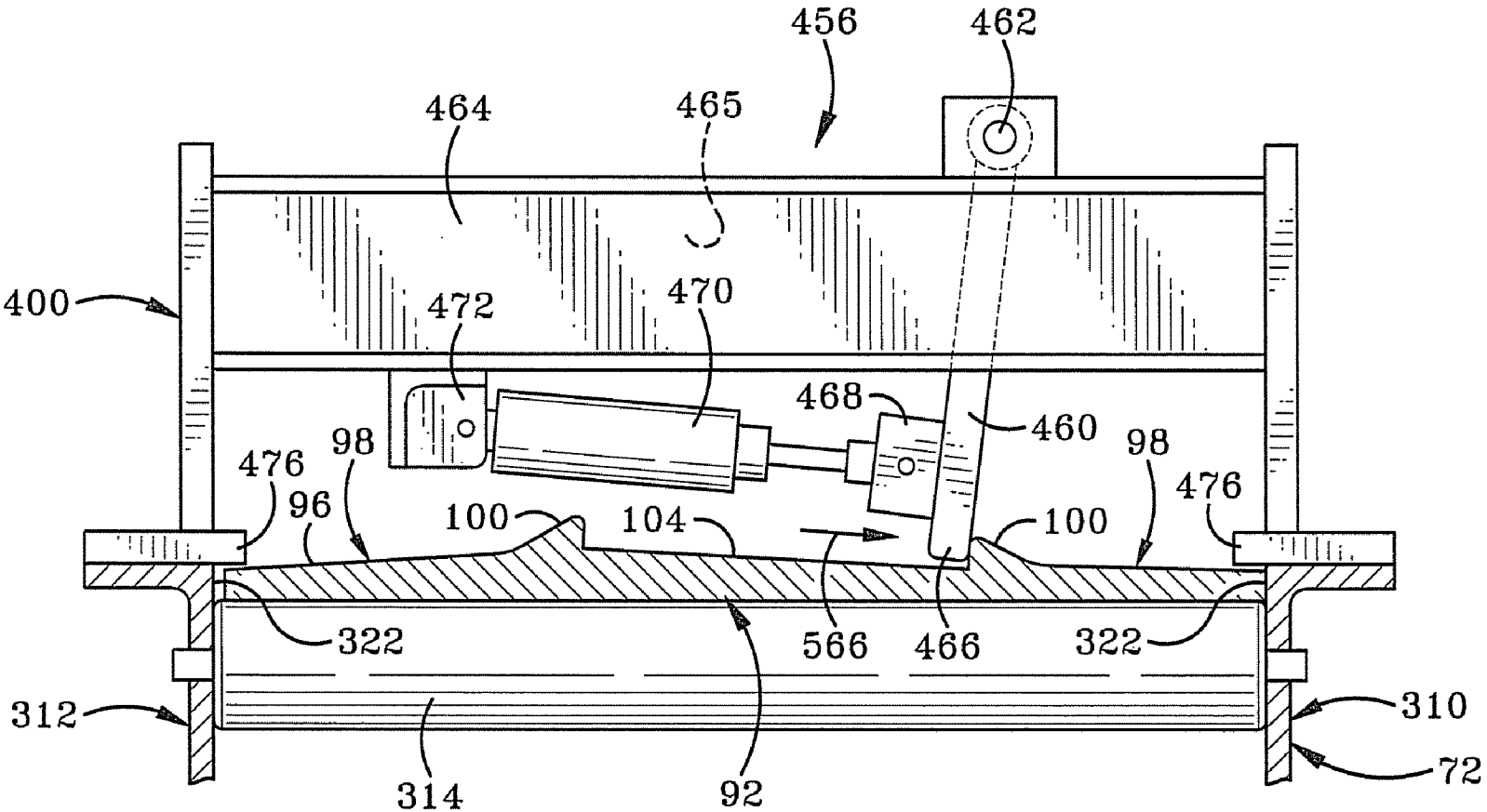
FIG. 46 is a cross-sectional view taken generally about line 46-46 in FIG. 45.

FIG. 44 illustrates a top view of a plurality of tie plates properly aligned and waiting to be installed by drop mechanism 74. FIG. 45 illustrates a tie plate located within drop mechanism 74 with outer walls 500 maintaining the tie plate within the drop mechanism. Further, second stop primary stop 456 is engaged to prevent a second tie plate from extending into drop mechanism 74. Still further, first stop 390 is also activated and prevents the tie plates from gathering proximate second stop 392. FIG. 46 particularly shows second stop primary stop 456 forcing a tie plate in the direction associated with arrow 566 into guides 476 so that the tie plate can be quickly and easily released when necessary.

Figure 47:
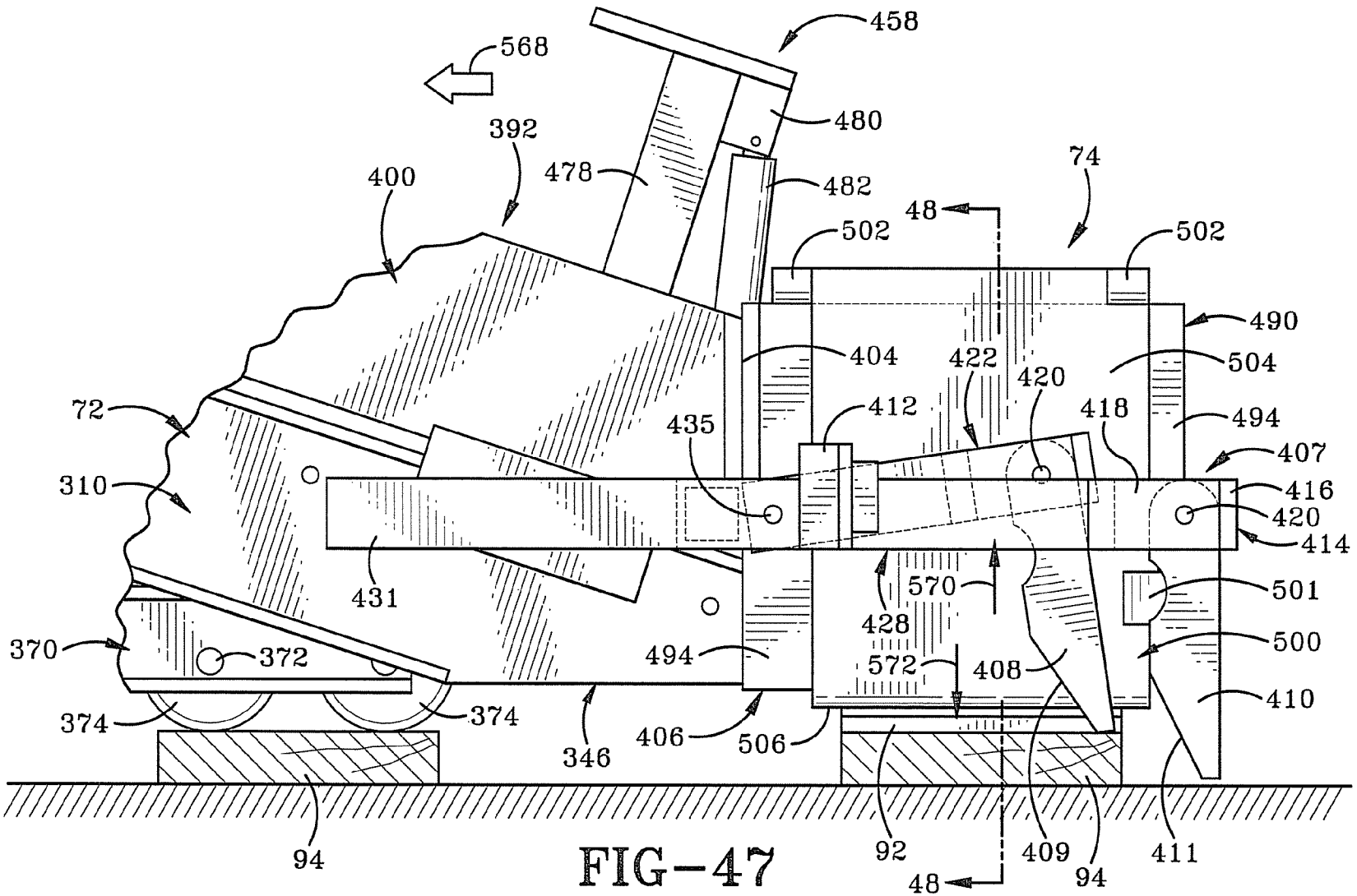
FIG. 47 illustrates the operation of the first trigger.
Figure 48:
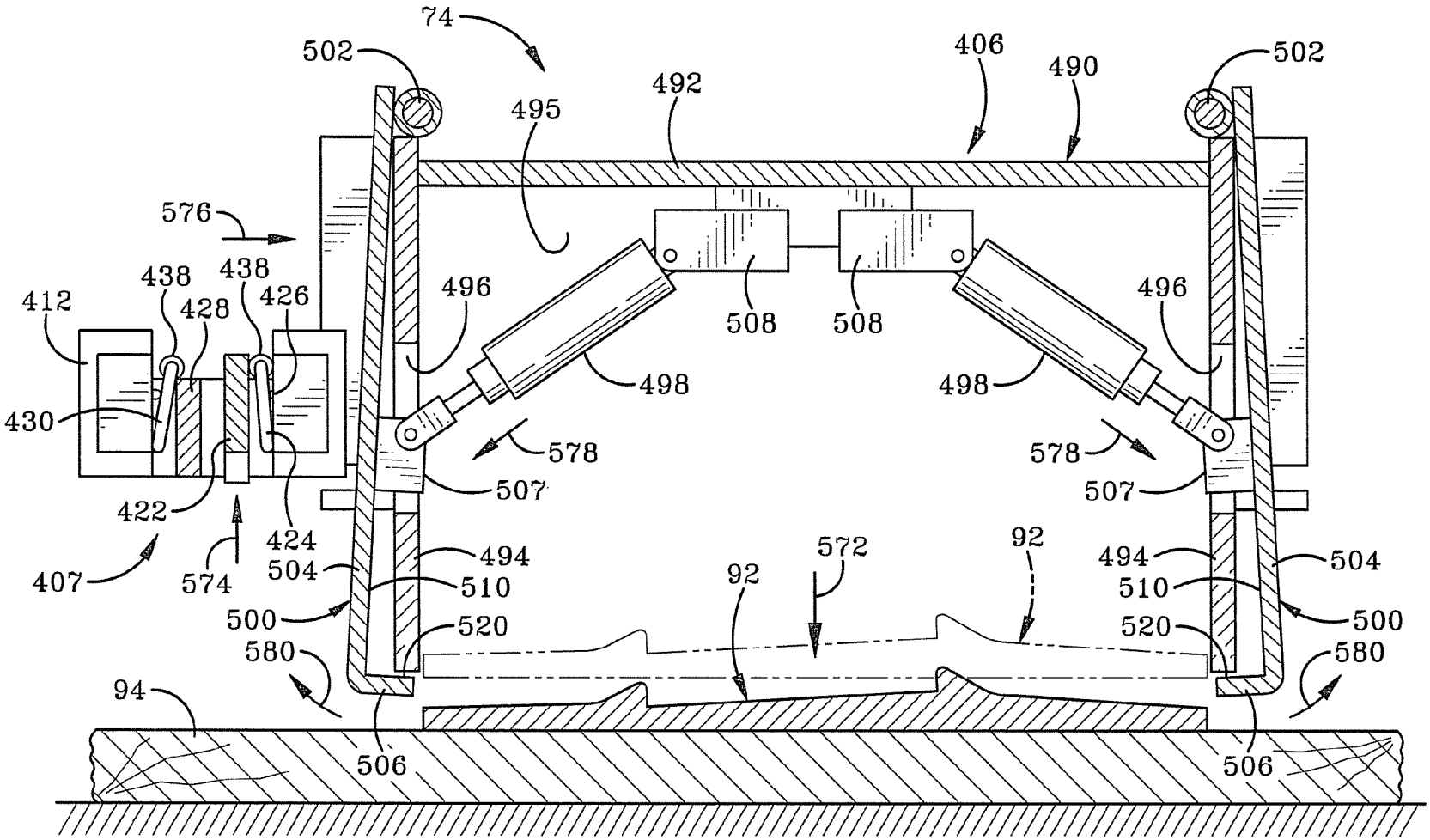
FIG. 48 is a cross-sectional view taken generally about line 48-48 in FIG. 47 and illustrating the operation of the drop mechanism.

FIG. 47 illustrates machine assembly 60 traveling in the direction associated with arrow 568 and first trigger 408 contacting railroad tie 94 and forcing trigger 408 upwards in the direction associated with arrow 570 thereby dropping tie plate 94 in the direction associated with arrow 572. FIG. 48 illustrates the inner workings of drop mechanism 74 when first trigger 408 is activated. As trigger 408 raises actuator leg 422 in the direction associated with arrow 574, actuator 424 forces switch 426 in the direction associated with arrow 576 to move actuators 498 in the direction associated with arrows 578 and pivot outer walls 500 in the direction associated with arrows 580. This rotation of outer walls 500 in the direction associated with arrows 580 removes the bottom support from tie plates 92 and gravity forces tie plate 92 in the direction associated with arrow 572. Accordingly, tie plate 92 is then located on railroad tie 94.

Figure 49:
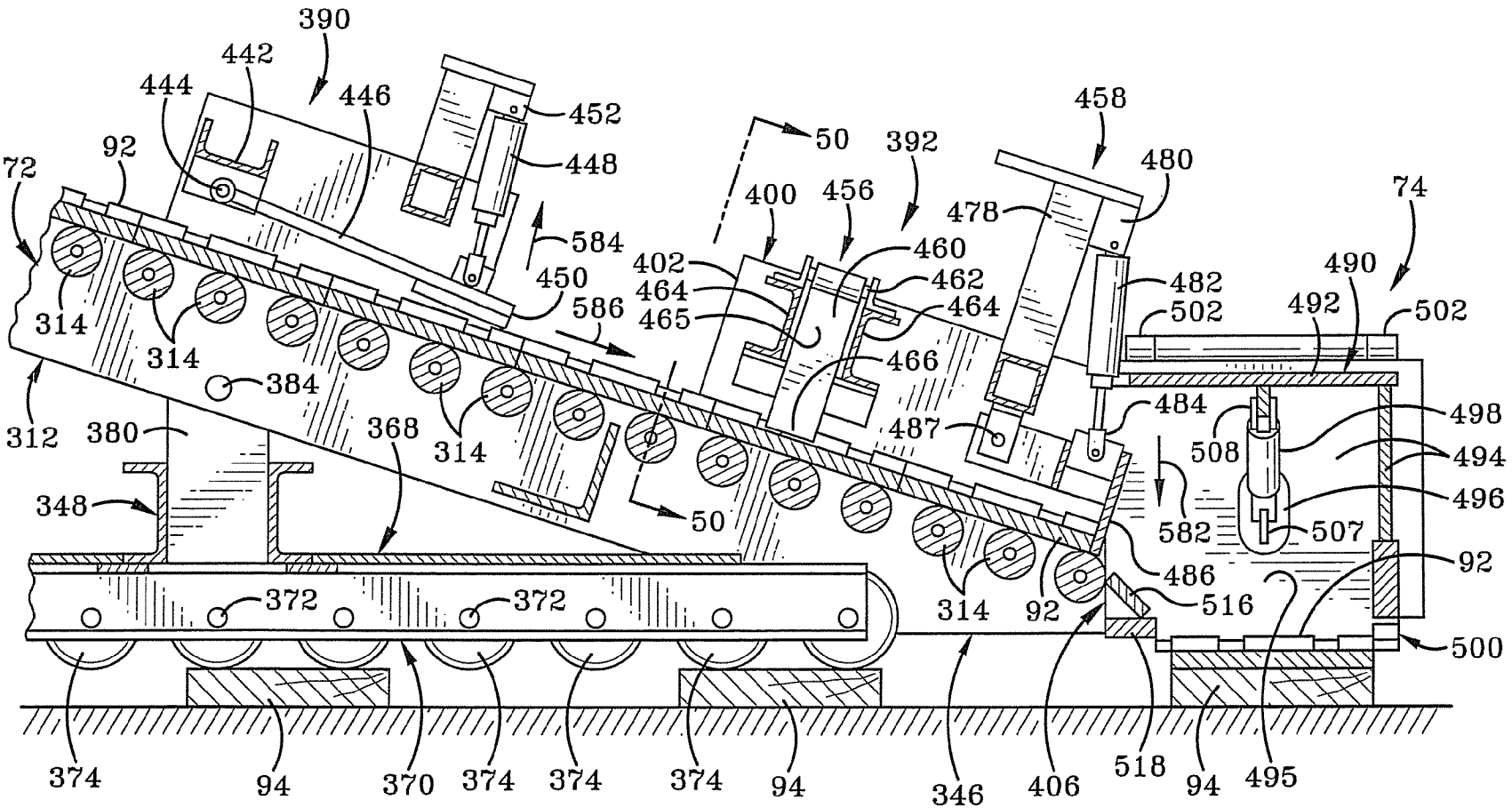
FIG. 49 illustrates a cross-sectional view of the plates being released from the first staging area and stopped at the second staging area.
Figure 50:
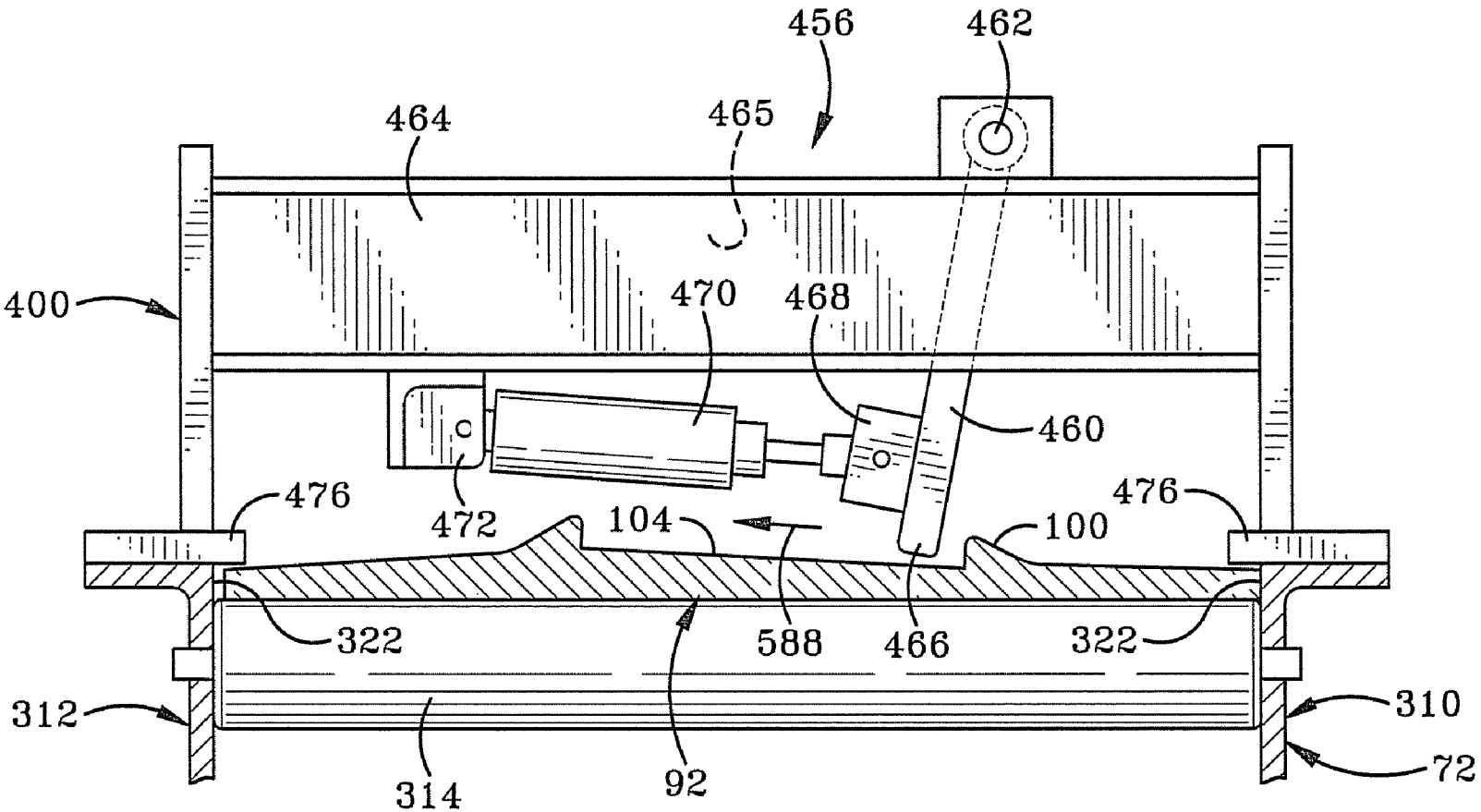
FIG. 50 is a cross-sectional view taken generally about line 50-50 in FIG. 49.

Referring now to FIGS. 49 and 50, actuation of first trigger 408 also forces stop 458 in the direction associated with arrow 582 to prevent any additional tie plates 92 from entering drop mechanism 74. Further, first stop 390 is opened by moving actuator 448 upwards in the direction associated with arrow 584 to permit tie plates to travel down the placing conveyor in the direction associated with arrow 586 and ultimately contacting second stop primary stop 456. Further, as seen in FIG. 50, second stop primary stop 456 is released and actuator 470 is retracted in the direction associated with arrow 588 to permit tie plate 92 to extend beyond the primary stop and contact the second stop secondary stop 458.

Figure 51:
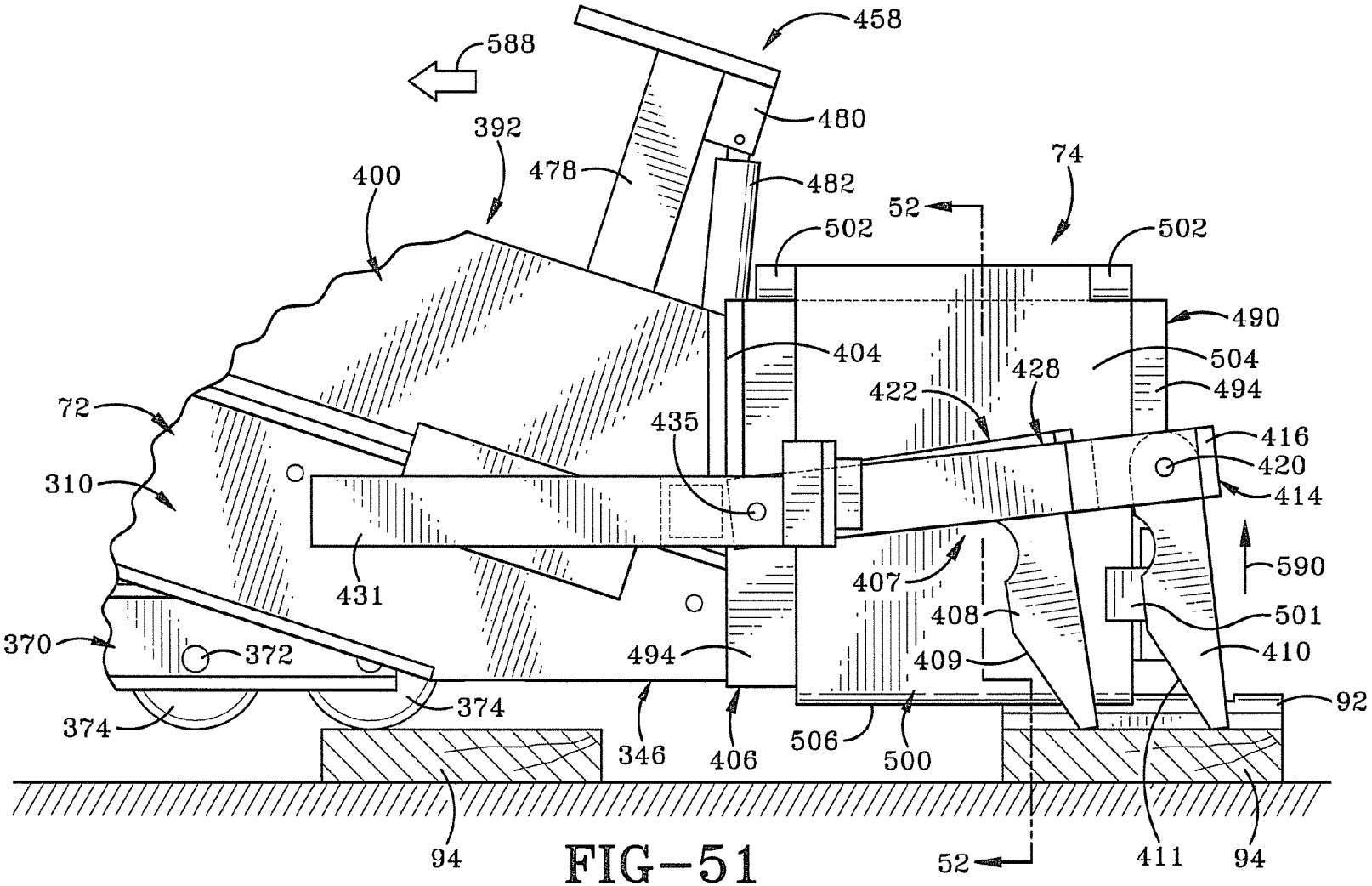
FIG. 51 is an enlarged view of the second trigger being activated by a railroad tie.
Figure 52:
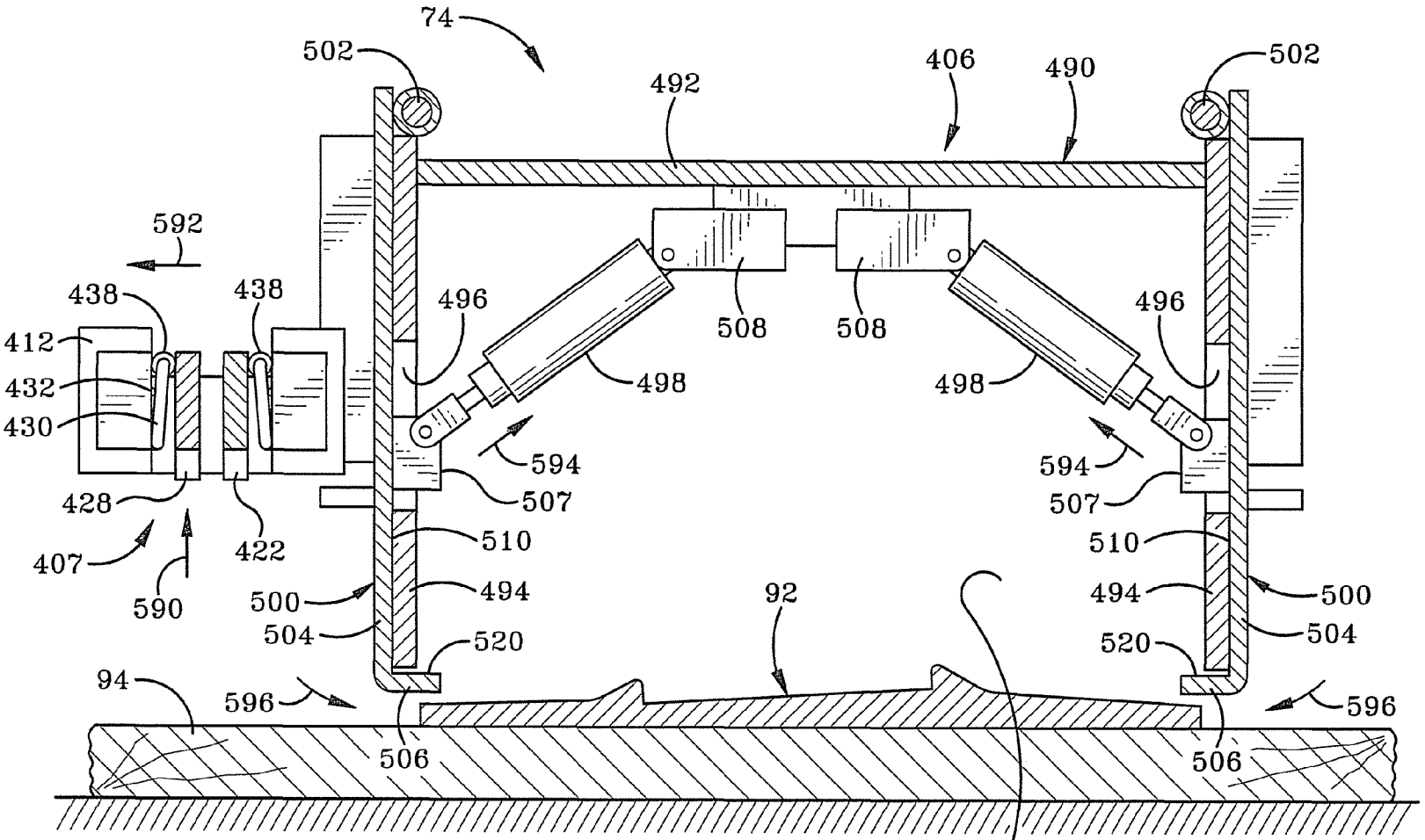
FIG. 52 is a cross-sectional view taken generally about line 52-52 in FIG. 51.
Figure 53:
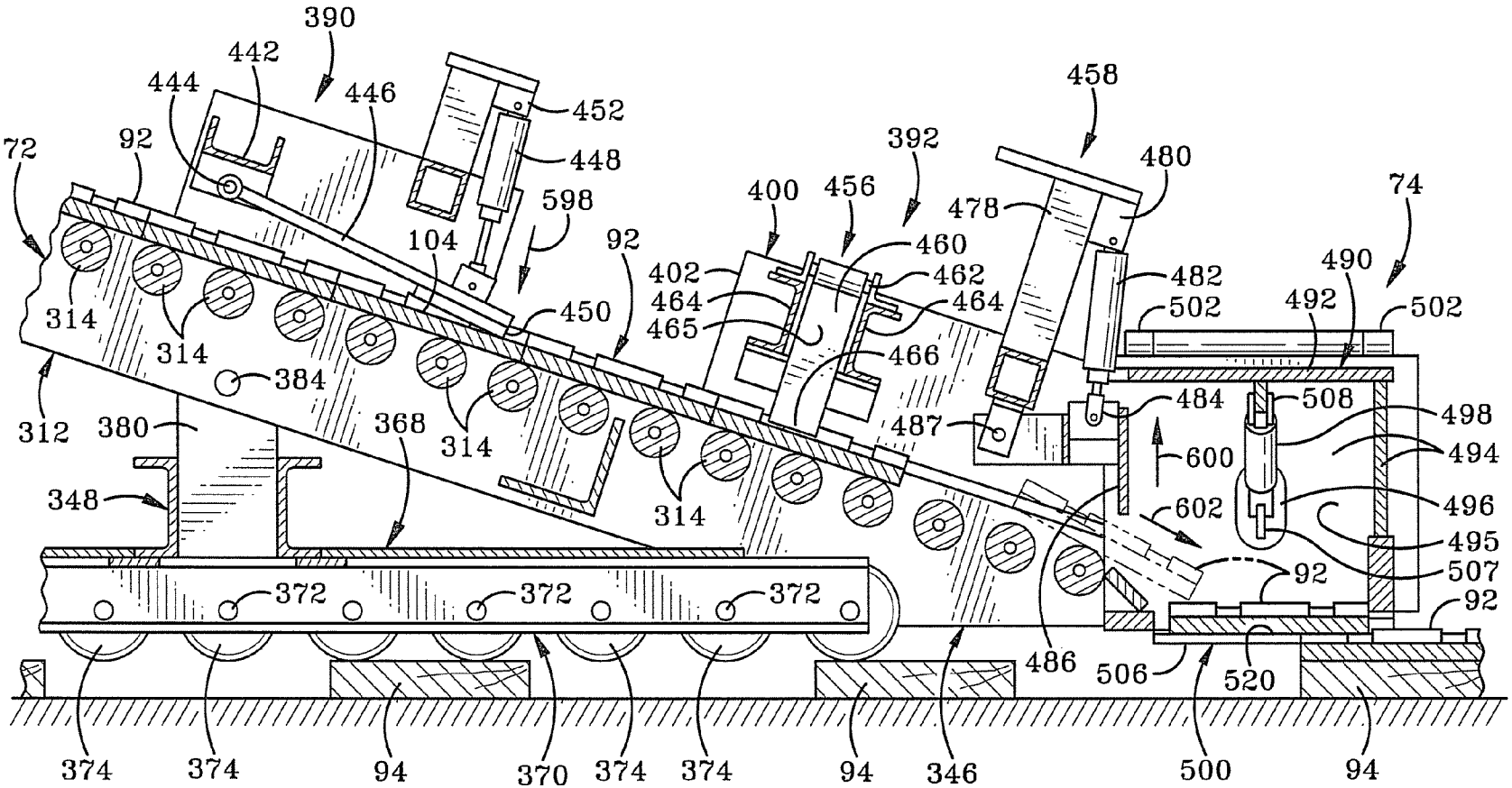
FIG. 53 is a cross-sectional view illustrating a tie plate being directed into the drop mechanism and a first staging area preventing further tie plates from moving down the placing conveyor.

Referring now to FIGS. 51 through 53, and having already dropped a first tie plate, the machine assembly continues to travel in the direction associated with arrow 588 until second trigger 410 is activated and forces actuator leg 428 upwards in the direction associated with arrow 590. The movement of actuator leg 428 in the direction associated with arrow 590 forces actuator 30 in the direction associated with arrow 592 and closes switch 432. Closing switch 432 retracts actuators 498 in the direction associated with arrow 594 thereby pivoting outer walls 500 in the direction associated with arrows 596 to return the outer wall lip portions 506 for receiving a tie plate 92. Further, since the first tie plate has already been dropped, the drop mechanism is now ready to receive another tie plate. Activating the second switch also forces actuator 448 downward in the direction associated with arrow 598 and forces stop end 450 against the tie plates to prevent additional tie plates from extending beyond the first stop. Further, the second switch forces actuator 482 upward in the direction associated with arrow 600 to raise moveable wall 486 and permit tie plates 92 to enter drop mechanism 74 in the direction associated with arrow 602. Thus, the machine has now completed a full cycle of tie plate dropping and reloading.

Figure 55:
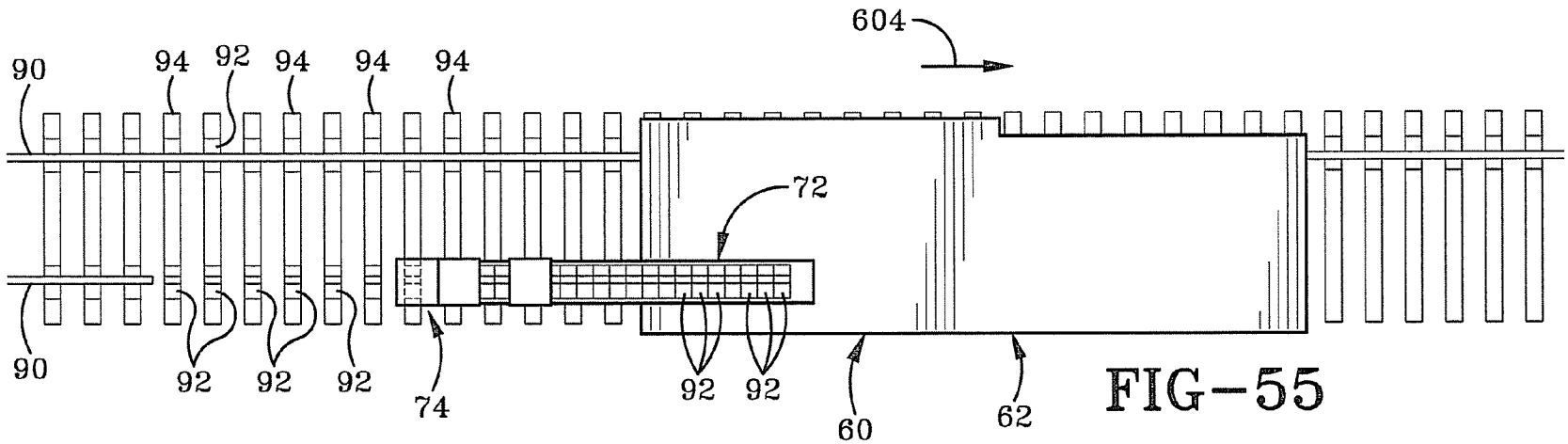
FIG. 55 illustrates a top view of the machine illustrating the machine continuing down the line and continuing the railroad tie placing process; and, FIG. 56 illustrates the machine traveling in the opposite direction with the triggers folding inward as they contact a railroad tie.
Figure 54:
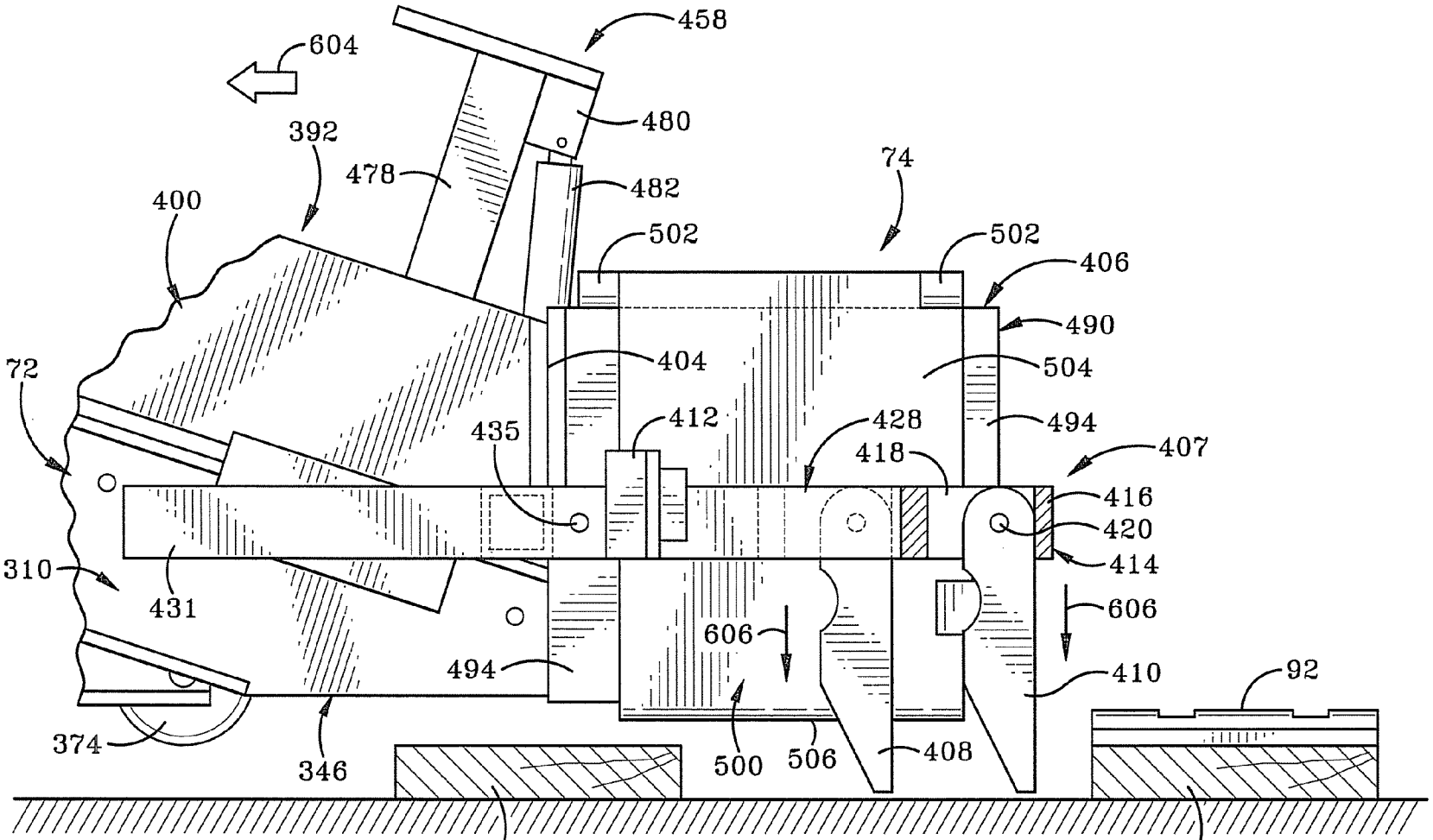
FIG. 54 illustrates the first and second triggers deactivated after passing a first railroad tie.

FIGS. 54 and 55 illustrate the machine 60 traveling in the direction associated with arrow 604 having completed a full cycle of tie plate dropping after passing railroad tie 94. In particular, after passing the railroad tie, first and second trigger 408 and 410, respectively are returned to their original position by being moved downward in the direction associated with arrows 606. Further, the drop mechanism 74 is prepared to place another tie because the second trigger has already contacted the previous tie plate to close the outer walls 500 and permit a tie plate to pass through the first and second stops and rest on lips 506 of outer walls 500. Advantageously, this process can be achieved quickly and efficiently requiring only fractions of a second between tie plates. The quick pace of the triggers and the drop mechanism as well as the staging positions and stops allows the machine assembly to travel down the track at a much quicker pace without stopping between railroad ties to drop the railroad tie plates by each railroad tie.

FIG. 56 illustrates the machine traveling in the direction associated with arrow 608 which is opposite the normal direction of travel. This may be necessary if something has been dropped or forgotten and the operator needs to go back towards tie plates that have already been passed. In this arrangement, triggers 408 and 410 are pivotably mounted therein to rotate in the directions associated with arrow 610 to pivot without actuating switches 426 and 432, thereby preventing tie plates from being dropped during this reverse movement. In particular, triggers 408 and 410 may also have notches 612 cut in them to prevent the triggers from contacting the respective actuator legs 422 and 428 that would activate switches 426 and 432. This arrangement allows the machine to travel in both directions while only dropping tie plates in the preferred direction of travel.

Thus, the machine provides a mechanism for easily and efficiently locating tie plates along railroad ties without stopping the machine at each railroad tie. Further, the placing conveyor is pivotably mounted to the machine and ensures that the tie plates are dropped in the proper position, including going around a curve, with the assistance of a roller support assembly beneath the placing conveyor. Still further, an alignment device ensures that the second end of the placing conveyor in combination with the roller support assembly maintains the proper positioning of the drop mechanism regardless of the position of the machine assembly.

It will be evident to one skilled in the art that a variety of changes can be made without departing from the spirit and scope of the invention. For instance, the drop mechanism may be any suitable device that precisely and quickly places the tie plates but does not have to be outer sidewalls on the left and right, but could be the front and back, or a single door. Still further, the placing conveyor could be integrally mounted on the machine and a continuous unit from the hopper instead of a removable secondary conveyor. In addition, a self-automated alignment and positioning robot may be utilized instead of additional operators along conveyor 70.

Accordingly, the apparatus for retrieving and placing tie plates is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features discoveries, and principles of the invention, the manner in which the apparatus for retrieving and placing tie plates is construed and used, the characteristics of the construction, and the advantageous new and useful results obtained; the new and useful structures, devices, elements, arrangement, parts, and combinations are set forth in the appended claims.

The invention claimed is:

1. A vehicle comprising:
a machine having wheels;
a placing conveyor secured to the machine and having a distal end with a drop mechanism;
a door carried by the drop mechanism; and
a trigger operatively connected to the door; and
wherein the drop mechanism door is opened over a railroad tie when the trigger contacts an edge of the railroad tie with the machine moving; and
the placing conveyor is pivotable about a vertical axis and secured to the machine.

2. The vehicle of claim 1 further comprising a stabilizing arm connected to the placing conveyor distal end adapted to engage a rail and for positioning the placing conveyor distal end.

3. The vehicle of claim 1 wherein the placing conveyor further comprises an alignment track proximate the placing conveyor distal end.

4. The vehicle of claim 3 wherein the alignment track further comprises a plurality of wheels extending along a plurality of railroad ties.

5. The vehicle of claim 1 further comprising a machine conveyor in communication with the placing conveyor; and
having a gradually decreasing width as the machine conveyor approaches the placing conveyor.

6. The vehicle of claim 1 wherein the placing conveyor is inline with the drop mechanism.

7. The vehicle of claim 1 wherein the placing conveyor is towed behind the machine.

8. A vehicle comprising:
a machine having wheels;
a placing conveyor secured to the machine and having a distal end with a drop mechanism;
a door carried by the drop mechanism;
a trigger operatively connected to the door; and
a staging trigger operatively connected to a staging arm; and
wherein the drop mechanism door is opened over a railroad tie when the trigger contacts an edge of the railroad tie with the machine moving; and
wherein the staging arm permits the railroad tie plate to pass the staging arm when the staging trigger contacts the edge of the railroad tie.

9. The vehicle of claim 8 wherein the staging arm prevents more than one railroad tie plate from entering the drop mechanism at one time.

10. The vehicle of claim 8 wherein the staging arm is separate from the drop mechanism.

11. The vehicle of claim 8 wherein the trigger and the staging trigger are spaced approximately nineteen and one half inches apart.

12. A vehicle comprising:
a machine having wheels;
a placing conveyor secured to the machine and having a distal end with a drop mechanism;
a door carried by the drop mechanism; and
a trigger operatively connected to the door;
wherein the drop mechanism door is opened over a railroad tie when the trigger contacts an edge of the railroad tie with the machine moving;
the placing conveyor is towed behind the machine; and
the placing conveyor is removably secured to a pin extending upwardly from the machine.

13. A vehicle comprising:
a machine having wheels;
a placing conveyor secured to the machine and having a distal end with a drop mechanism;
a door carried by the drop mechanism;
a trigger operatively connected to the door;
a hopper on the machine;
a rotatable drum, and
a machine conveyor;
wherein the drop mechanism door is opened over a railroad tie when the trigger contacts an edge of the railroad tie with the machine moving; and
wherein the rotatable drum transfers the railroad tie plates from the hopper to the machine conveyor.

14. The vehicle of claim 13 further comprising a boom for transferring a plurality of railroad tie plates into the hopper.

15. A method of placing railroad tie plates comprising the steps of:
locating a railroad tie plate on a placing conveyor perpendicular to a railroad tie longitudinal axis;
stopping the railroad tie plate at a first staging position;
stopping the railroad tie plate within a drop box;
controlling a drop box door with a trigger;
actuating the trigger;
opening the drop box door to place the railroad tie plate on the railroad tie.

16. The method of claim 15 further comprising the steps of removing the placing conveyor from a transport position to an operation position; and
aligning a stabilizing arm with a railroad rail.

17. The method of claim 15 further comprising the steps of:
picking up a plurality of the railroad tie plates with a boom;
placing the railroad tie plates within a hopper;
rotating a drum within the hopper;
transferring the railroad tie plates from the hopper to a machine conveyor with the drum; and
aligning the railroad tie plates on a decreasing width position of the machine conveyor.

18. The method of claim 17 further comprising the steps of transferring the railroad tie plates from the machine conveyor to the placing conveyor.

19. The method of claim 15 further comprising the steps of
moving a machine along a railroad track which comprises the railroad tie;
towing the placing conveyor behind the machine; and
pivoting the placing conveyor relative to the machine about a vertical axis as the machine moves along the railroad track.

20. The method of claim 15 wherein the step of actuating the trigger comprises actuating the trigger by contacting the trigger on an edge of the railroad tie as the placing conveyor moves along a railroad track which comprises the railroad tie; and further comprising the steps of
providing the placing conveyor with a staging trigger operatively connected to a staging arm;

actuating the staging trigger by contacting the staging trigger on the edge of the railroad tie as the placing conveyor moves along the railroad track; and permitting the railroad tie plate to pass the staging arm in response to the step of actuating the staging trigger.

21. The method of claim 15 further comprising the steps of moving a machine along a railroad track which comprises the railroad tie;

removably securing the placing conveyor to a pin extending upwardly from the machine; and towing the placing conveyor behind the machine while secured to the pin.

22. A vehicle comprising:

a machine having wheels;

a placing conveyor secured to the machine and having a distal end with a drop mechanism;

a door carried by the drop mechanism; and a trigger operatively connected to the door;

wherein the drop mechanism door is opened over a railroad tie when the trigger contacts a first edge of the railroad tie with the machine moving in a first direction; and the drop mechanism door is not opened when the trigger contacts a second opposed edge of the railroad tie with the machine moving in a second direction opposite the first direction.

23. The vehicle of claim 22 wherein the trigger is pivotable about a pivot so that when the trigger contacts the first edge of the railroad tie as the machine moves in the first direction, the trigger and pivot move upwardly, and so that when the trigger contacts the second opposed edge of the railroad tie as the machine moves in the second direction, the trigger rotates about the pivot without the pivot moving upwardly.

24. The vehicle of claim 22 wherein the drop mechanism further comprises a leg which is pivotable about a first pivot and which is pivotally connected to the trigger by a second pivot so that when the trigger contacts the first edge of the railroad tie as the machine, leg and trigger move in the first direction, the leg and trigger rotate about the first pivot without the trigger rotating about the second pivot; and so that when the trigger contacts the second opposed edge of the railroad tie as the machine, leg and trigger move in the second direction, the trigger rotates about the second pivot without the leg rotating about the first pivot.

25. The vehicle of claim 22 wherein the drop mechanism further comprises a leg on which the trigger is movably mounted; the drop mechanism door is operatively connected to the leg so that when the leg is actuated, the drop mechanism door is opened; when the trigger contacts the first edge of the railroad tie as the machine, leg and trigger move in the first direction, the leg is actuated; and when the trigger contacts the second opposed edge of the railroad tie as the machine, leg and trigger move in the second direction, the trigger moves relative to the leg and the leg is not actuated.

26. A vehicle comprising:

a machine having wheels;

a placing conveyor secured to the machine and having a distal end with a drop mechanism;

a door carried by the drop mechanism;

a first trigger operatively connected to the door so that the drop mechanism door is opened over a railroad tie when the first trigger contacts an edge of the railroad tie with the machine moving; and a second trigger operatively connected to one of (a) the drop mechanism door and (b) a staging arm, so that when the second trigger contacts the edge of the railroad tie, one of (c) the drop mechanism door closes and (d) the staging arm stops railroad tie plates on the placing conveyor, respectively.

27. The vehicle of claim 26 wherein the second trigger is operatively connected to the drop mechanism door so that when the second trigger contacts the edge of the railroad tie, the drop mechanism door closes.

28. The vehicle of claim 26 wherein the second trigger is operatively connected to the staging arm, so that when the second trigger contacts the edge of the railroad tie, the staging arm stops railroad tie plates on the placing conveyor.

* * * * *